US005196083A

United States Patent [19]

Baker et al.

[11] Patent Number: 5,196,083

[45] Date of Patent: Mar. 23, 1993

[54] SYSTEM AND METHOD FOR PRODUCING ITEMS IN SELECTED CONFIGURATIONS

[75] Inventors: Walter J. Baker, Stratford; Michael A. Brown, Norwalk; David W. Hubbard, Stamford; Samuel W. Martin, Weston; Carl A. Miller, Fairfield; William V. Pickering, Jr., New Canaan; Christopher S. Riello, Hamden; Arthur Rubinstein, Norwalk; Morton Silverberg, Westport; Steven A. Supron, Norwalk, all of Conn.

[73] Assignee: Pitney Bowes Inc., Stamford, Conn.

[21] Appl. No.: 493,016

[22] Filed: Mar. 12, 1990

[51] Int. Cl.[5] ..... B43M 3/00; B43M 5/00

[52] U.S. Cl. ..... 156/364; 156/362; 156/363; 156/441.5; 156/442.1; 156/442.2; 156/442.3; 156/442.4; 156/443; 156/556; 156/383; 156/384; 270/1.1; 270/4; 270/58; 493/420; 493/421

[58] Field of Search ..... 156/441.5, 442.1, 442.2, 156/442.3, 442.4, 443, 362, 363, 364, 52, 53, 55, 505, 67, 350, 383, 384, 387, 388, 556; 270/58, 4, 1.1, 32, 45, 37; 493/420, 421-320

[56] References Cited

U.S. PATENT DOCUMENTS

| | | | |
|---|---|---|---|
| 891,277 | 6/1908 | Makoe | 156/441 |
| 1,935,767 | 11/1933 | Delaney . | |
| 3,172,656 | 3/1965 | Mestre | 271/48 |
| 3,265,382 | 7/1966 | Sherman | 270/45 |
| 3,336,726 | 8/1967 | Mayer et al. | 53/20 |
| 3,382,778 | 5/1967 | Berkowitz | 93/61 |
| 3,396,726 | 8/1967 | Mayer et al. | 53/20 |
| 3,442,185 | 6/1967 | Buescher | 93/61 |
| 3,457,696 | 7/1967 | Berkley | 53/31 |
| 3,510,122 | 5/1970 | Gavaghan | 290/68 |
| 3,761,080 | 9/1973 | Larson . | |
| 3,820,447 | 6/1974 | Grendron et al. | 93/23 |
| 3,897,720 | 7/1975 | Hiersteiner | 93/61 |

(List continued on next page.)

FOREIGN PATENT DOCUMENTS

| | | | |
|---|---|---|---|
| 232372 | 11/1985 | Japan | 270/34 |
| 197336 | 9/1986 | Japan | 270/34 |

*Primary Examiner*—Caleb Weston
*Assistant Examiner*—J. Sells
*Attorney, Agent, or Firm*—Robert H. Whisker; Melvin J. Scolnick

[57] ABSTRACT

An apparatus for producing items in selected configurations and a system, and method for controlling the same. More particularly, an apparatus for producing mail pieces and a system and method for controlling it to produce mail pieces in a variety of configurations are disclosed. The apparatus includes a laser printer and folding sealing apparatus controlled by a data processor. The folder sealer apparatus combines sheets printed by the laser printer with pre-printed sheets and envelope forms, which also may be printed by the laser printer or may be windowed envelopes, folds the sheets as necessary and folds and seals the envelope form about the folded sheets to produce a mail piece. A user inputs a configuration for the mail piece which is translated by the data processor into a data structure and transmitted to the controller of the folder sealer apparatus. The controller controls devices comprised in the laser printer and the folder sealer by executing state routines in accordance with the data structure to produce the mail piece in the defined configuration. Concurrently the data processor transmits text from an output file to the laser printer for printing on printed sheets and envelope forms. The data processor also controls the laser printer to print an address for the mail piece either on an envelope form or on a printed sheet in a position where it will be visible through the envelope. Thus the apparatus is controlled to process an output file stored in the data processor into a mail run having a selected configuration.

49 Claims, 34 Drawing Sheets

U.S. PATENT DOCUMENTS

| | | | |
|---|---|---|---|
| 4,012,268 | 3/1977 | Johnsen | 156/200 |
| 4,014,535 | 3/1977 | Kleid et al. | 270/19 |
| 4,022,457 | 5/1977 | Marin et al. | 270/86 |
| 4,031,818 | 6/1977 | Kehoe | 93/63 |
| 4,033,807 | 7/1977 | Neill et al. | 156/384 |
| 4,063,398 | 12/1977 | Hoffman | 53/31 |
| 4,067,171 | 1/1978 | Herbert et al. | 156/384 |
| 4,101,121 | 7/1978 | Rastorguyeff | 270/68 A |
| 4,312,169 | 1/1982 | Golicz et al. | 53/206 |
| 4,346,882 | 8/1982 | Pessina | 271/221 |
| 4,411,643 | 10/1983 | Higginson | 493/188 |
| 4,437,852 | 3/1984 | Volk, Jr. et al. | 156/384 |
| 4,530,730 | 7/1985 | Bradley et al. | 156/227 |
| 4,530,731 | 7/1985 | Bradley | 156/227 |
| 4,531,993 | 7/1985 | Bradley | 156/227 |
| 4,543,082 | 9/1985 | Stenner | 493/216 |
| 4,573,672 | 3/1986 | Lehmann et al. | 270/45 |
| 4,575,121 | 3/1986 | Conti | 281/2 |
| 4,603,846 | 8/1986 | Miles | 271/240 |
| 4,619,101 | 10/1986 | Havey, Jr. et al. | 53/117 |
| 4,668,211 | 5/1987 | Lubotta et al. | 493/188 |
| 4,694,632 | 9/1987 | Gunther, Jr. | 53/55 |
| 4,700,941 | 10/1987 | Shill | 271/3.1 |
| 4,701,233 | 10/1987 | Beck et al. | 156/217 |
| 4,706,878 | 11/1987 | Lubotta et al. | 229/73 |
| 4,709,850 | 12/1987 | Wagner | 229/73 |
| 4,717,134 | 1/1988 | Iida et al. | 270/39 |
| 4,731,048 | 3/1988 | Marella et al. | 493/188 |
| 4,731,741 | 3/1988 | Allen | 364/518 |
| 4,733,856 | 3/1988 | Gunther, Jr. | 270/1.1 |
| 4,776,510 | 10/1988 | Jenkins | 229/73 |
| 4,784,317 | 11/1988 | Chen et al. | 229/92.3 |
| 4,797,832 | 1/1989 | Axlerod et al. | 270/1.1 |
| 4,799,989 | 1/1989 | Marzullo | 156/442.1 |
| 4,800,506 | 1/1989 | Axelrod et al. | 364/478 |
| 4,900,391 | 2/1990 | Mandel et al. | 156/364 |
| 4,917,366 | 4/1990 | Murakami et al. | 493/421 |
| 4,966,353 | 10/1990 | Lehmann et al. | 270/45 |

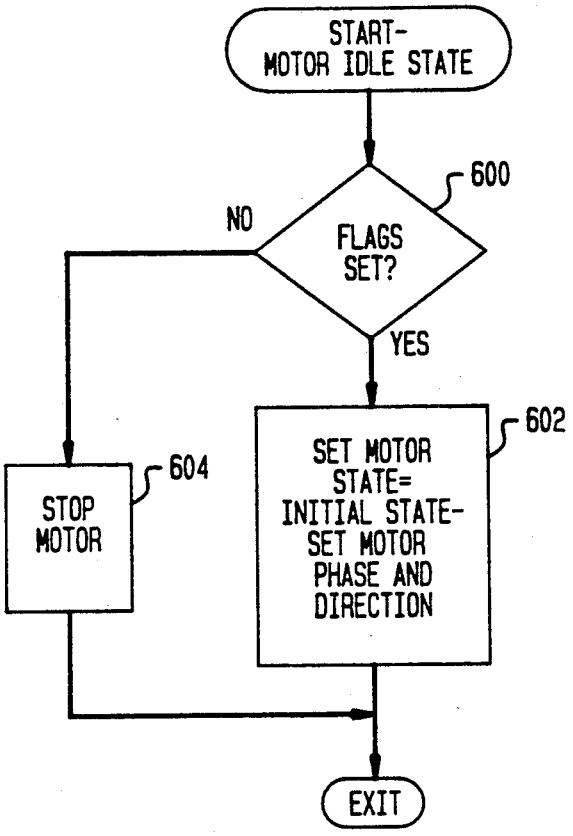
FIG. 11A
FIG. 11B
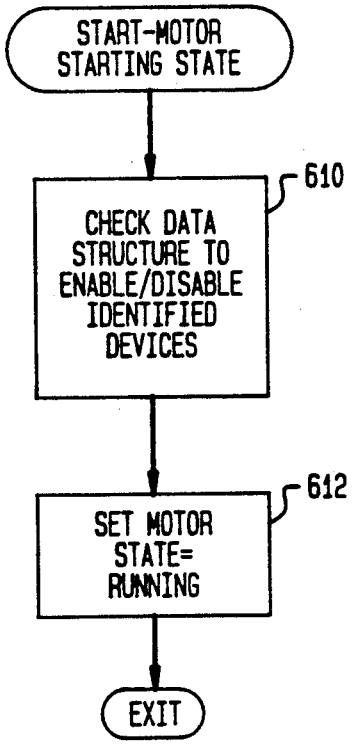

SYSTEM AND METHOD FOR PRODUCING ITEMS IN SELECTED CONFIGURATIONS

RELATED APPLICATIONS

The subject application is one of the following group of commonly assigned patent applications, all filed on even date herewith, all of which relate to a particular development effort conducted for the assignee of the subject application and which share common elements of disclosure.

| | |
|---|---|
| Ser. No. 492043 | Envelope Form for Preparing a Multi-Sheet Mail Piece |
| Ser. No. 491871 | System and Method for Controlling an Apparatus to Produce Mail Pieces in Non-Standard Configurations |
| Ser. No. 492039 | System and Method for Controlling an Apparatus to Produce Mail Pieces in Selected Configurations |
| Ser. No. 493016 | System and Method for Producing Items in Selected Configurations |
| Ser. No. 491881 | Mechanism and Method for Accumulating and Folding Sheets |
| Ser. No. 491875 | Flap Opening Mechanism and Method |
| Ser. No. 491886 | Mechanism and Method for Folding and Sealing the Upper and Side Flaps of an Envelope Form |
| Ser. No. 491887 | Mechanism and Method for Laterally Aligning an Accumulation of Sheets |
| Ser. No. 492035 | Sheet Feeder |

BACKGROUND OF THE INVENTION

This invention relates to apparatus for producing items in a variety of configurations. More particularly, it relates to an apparatus and process which produces mail pieces in a selected one of a plurality of possible configurations.

Self-mailers are mail pieces which are produced from pre-cut forms which are folded and sealed to form a mail piece, and are well known, as is apparatus for printing and forming such self-mailers. Commonly assigned, co-pending U.S. application, Ser. No. 407,583, to: Samuel W. Martin, filed Sep. 14, 1989 discloses one such self-mailer wherein a pre-cut form is printed on a laser printer, or similar computer output printer, and fed to a folding and sealing apparatus to produce a self-mailer. Similarly, U.S. Pat. No. 3,995,808 to: Kehoe, issued Sep. 7, 1976 discloses another self-mailer wherein a web of forms is printed, folded longitudinally and sealed, and separated to form individual self-mailers. U.S. Pat. No. 4,063,398 to: Huffman, issued: Dec. 20, 1977 discloses another self-mailer wherein a web of forms is folded transversely to produce self-mailers. Huffman also provides for insertion of preprinted pieces or "stuffers".

In general self-mailers as taught by the prior art are useful as a means of generating large numbers of mail pieces, but are limited in that they can be formed into only a small number of configurations. (By configurations, as applied to mail pieces herein, is meant variations such as use of a windowed or a printed envelope, variations in the number and type of printed pages, and variations in the number and type of pre-printed inserts.) At most, like Huffman they may provide for an ability to insert "stuffers". Further, with the exception of the above mentioned U.S. application, Ser. No. 407,583 the equipment for producing such self-mailers has generally been physically large and suitable only for use in environments such as large computing centers.

Where it has been necessary to provide greater flexibility in the configuration of a mail piece which may be produced the solutions taught by the prior art have generally involved the use of inserters. An inserter is a transport system having a plurality of stations and along which a "control document" is transported from station to station. At selected stations pre-printed inserts maybe accumulated with the control document and at the last station the entire accumulation is inserted in a preformed envelope. A typical use of such inserter systems would be by a bank mailing monthly statements to its customers, where the control document would be individual statements printed on the bank mainframe computer and the inserts would include each individual's canceled checks. Such inserter systems are described, for example, in U.S. Pat. No. 3,935,429; to: Branecky et al.; for: Process and Apparatus for Controlling Document Feeding Machines From Indicia Contained on a Document Fed Therefrom; issued: Jan. 27, 1973.

Inserters do provide a high degree of flexibility in producing mail pieces in a number of configurations, and have proven very satisfactory for users such as banks and credit card companies. However, they suffer also from major limitations. First, because inserter systems generally do not operate under the control of the computer which prints the control document, a very significant problem exists in assuring that the proper inserts are matched with the correct control document. Because of this difficulty it has generally been necessary to use window envelopes with inserter systems rather than printed envelopes, so that an address pre-printed on the control document could be used to deliver the mail piece. Finally, inserters, like equipment for producing self-mailers, are generally quite physically large and suitable for use only in a large computer operation or production mail room.

Another approach to the problem of producing mail pieces was developed by Pitney Bowes Inc., assignee of the subject invention, under contract with the U.S.P.S. This equipment, known as PPHE (for Printing and Paper Handling Equipment) printed a continuous web, collated and separated the web to form sheets, folded the collated sheets longitudinally, and wrapped an envelope form around the wrapped sheets. The PPHE had a capability to add "stuffers" to a mail piece and was intended for production applications only, as the equipment was tens of feet long. The PPHE lacked capability to print envelope forms or handle variable length sheets.

Thus, it is an object of the subject invention to provide an apparatus and method for producing a mail piece in a selected one of a plurality of possible configurations.

It is another object of the subject invention provides such a system and method which are suitable for use with a personal computer.

BRIEF SUMMARY OF THE INVENTION

The above objects are achieved and the disadvantages of the prior art are overcome in accordance with the subject invention by means of an apparatus and method for forming a mail piece which include input of text signals, input of a sheet, and input of an envelope form. A printer is responsive to the text signals to print corresponding text on at least one of the sheet or the form. After the text is printed folder sealer apparatus forms and folds an accumulation including the sheet and the envelope form and seals the envelope form to form the mail piece.

In accordance with one aspect of the subject invention the envelope form and the sheet are folded simultaneously so that the envelope form surrounds the sheet.

In accordance with another aspect of the subject invention the accumulation is folded transversely to its direction of motion through the folder sealer apparatus.

In accordance with still another aspect of the subject invention the length of the sheet is selected to be either three thirds or two thirds of a predetermined length, and if the sheet is selected to of three thirds length the sheet is folded to two thirds length prior to folding the accumulation.

In accordance with yet another aspect of the subject invention the sheet is selectively folded in one of two ways so that after folding the accumulation results in either a "C" or a "Z" fold of the sheet.

In accordance with still another aspect of the subject invention the envelope form includes a window and the printer responds to the text signals to print an address on the sheet, positioned on the sheet to be visible through the window.

In accordance with still another aspect of the subject invention the printer responds to the text signals to print an address on the envelope form.

In accordance with still yet another aspect of the subject invention the sheet is pre-printed.

And in accordance with another aspect of the subject invention the mail piece further includes a business return envelope.

Thus it can be seen that the subject invention advantageously achieves the above objects. Other objects and advantages of the subject invention will be readily apparent to those skilled in the art from consideration of the attached drawings and of the Detailed Description set forth below.

BRIEF DESCRIPTIONS OF THE DRAWINGS

FIGS. 11A through 11E show flow charts of State Routines for motors shown in FIG. 6.

DETAILED DESCRIPTION OF PREFERRED EMBODIMENTS OF THE SUBJECT INVENTION

Figure 1:
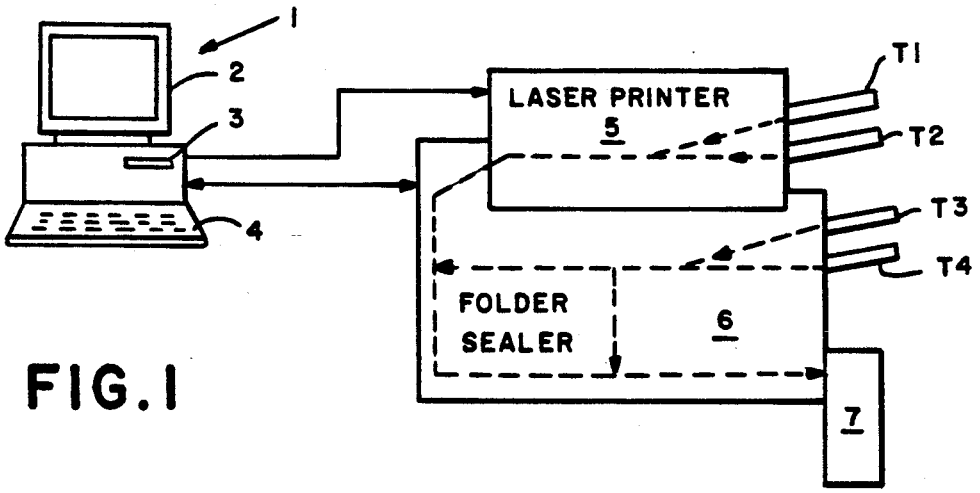
FIG. 1 shows a schematic block diagram of apparatus in accordance with the subject invention.

FIG. 1 shows a system for producing mail pieces and with which the form of the subject invention may be used. The system includes a personal computer 1 including a monitor 2, a hard disk 3 with at least one megabyte of available storage, and a keyboard 4. Computer 1 also requires a minimum of 640K of RAM memory in the subject invention. Optionally a computer "mouse" (not shown) may be provided for operator input. Computer 1 communicates with laser printer 5 through a conventional parallel interface, which is preferably the well known Centronix interface. Preferably, Laser printer 5 is a commercially available Laser printer such as those marketed by the Hewlett Packard Corporation under the trademark "Laser Jet". Other printers, including ink jet and impact printers, may also may be used in the subject invention.

Laser printer 5 includes trays T1 and T2 from which sheets are fed to laser printer 5 for printing, as will be described further below. Tray T1 may be used for envelope forms, and tray T2 may be used for either three-thirds sheets or two-thirds length sheets.

Laser printer 5 is mounted on, and physically connected to, folder sealer 6 so that, after printing, sheets are passed from laser printer 5 to folder sealer 6 where they are accumulated with an envelope form, folded and sealed, and output to stacker 7. Folder sealer 6 also includes trays T3 and T4 which may be used to add pre-printed sheets to the mail piece. Tray T3 and tray T4 may be used to supply either three-thirds, two-thirds, or one-thirds length pre-printed sheets or pre-printed business reply envelopes (BRE's) to be added to the mail pieces. Tray T3 may also be used to provide a window envelope form so that the address of the mail piece may be printed on a printed sheet rather than a separate (non-window) envelope form.

Figure 2:
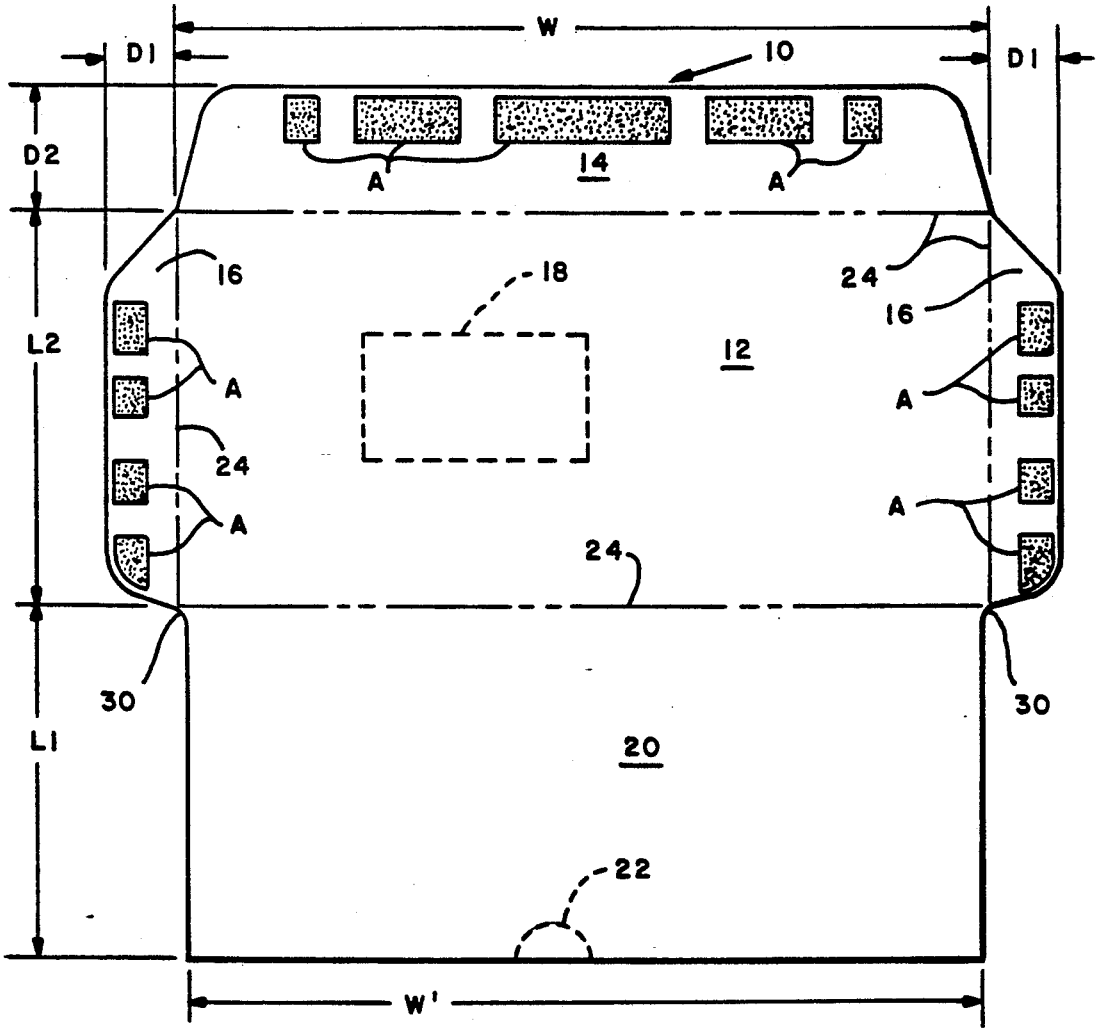
FIG. 2 shows a plan view of an envelope form suitable for use with the apparatus of FIG. 1.

FIG. 2 shows a unique envelope form, which is designed to function optimally with the apparatus of the subject invention. Form 10 includes upper panel 12 having an upper (or trailing) flap 14 and a pair of side flaps 16. Panel 12 may also be provided with a window 18 so that the mail piece formed when form 10 is folded and sealed may be delivered to an address printed on a sheet in the mail piece. An adhesive A is applied to flaps 14 and 16 to provide for sealing of form 10 to form an envelope. Preferably adhesive A is applied to flaps 14 and 16 as spaced stripes or spots so that form 10 may be driven through the apparatus of the subject invention by segmented rollers contacting form 10 in the spaces between the stripes or spots of adhesive A, so that the rollers will not be contaminated by adhesive A when it is moistened prior to sealing, and, also, to reduce curling of the form. Adhesive A is preferably a remoistenable adhesive (such as from 0.0006 to 0.001 inches of dextrin/resin adhesive) which is moistened for sealing as will be described further below; but the use of self-adhesive or other suitable methods of sealing is within the contemplation of the subject invention. Flaps 14 and 16 are attached to upper portion 12, as is a rectangular lower portion 20, along preformed fold lines 24, which are preferably pre-creased to facilitate uniform folding.

To form a mail piece, sheets, which may be three thirds, two-thirds, or one-thirds sheets or BRE's, are accumulated with form 10, and form 10, together with the accumulated sheets, is folded about a fold line 24 so that the accumulated sheets are enclosed between panels 12 and 20. Adhesive A is moistened, and after folding of panels 12 and 20 and the accumulated sheets, flaps 16 are folded inwards about fold lines 24 and flap 14 is than folded downwards about fold lines 24, and the resulting mail piece is sealed.

Note that three-thirds length sheets are prefolded to two-thirds length so that the resulting mail piece is approximately one-third the length of a three-thirds sheet.

Form 10 also may be provided with expansion fold lines parallel to and outwards of lines 24, to allow for mail pieces having a maximum thickness and lower panel 20 may be provided with a notch 22 to facilitate removal of the sheets when the mail piece is opened.

Form 10 is designed for optimal performance with the apparatus of the subject invention. The width W of upper panel 12 is chosen to be slightly greater than the width of the sheets to be used in the mail piece and the length L1 of lower panel 20 is chosen to be approximately equal to one-third the length of a full size sheet to be used with the mail piece. The length L2 of panel 12 is chosen to be substantially greater than length L1 to allow for increase tolerance in positioning these sheets on form 10. The width W' of lower panel 20 is equal to the width of the sheets to be used in the mail piece. By providing width W' equal to the width of the sheets automatic centering guides may be used to center the sheets with respect to form 10 before it is folded, as will be described further below. Further, a narrower lower panel 20 allows greater skew tolerance in folding the lower panel, and aids in enveloping the contents of thicker mail pieces by permitting side flaps 16 to wrap more gradually about the mail piece.

Because lower panel 20 is substantially shorter than upper panel 12 the width D of side flaps 16 and length D2 of upper flap 14 are chosen to be sufficient to assure that the sealed mail piece completely encloses these sheets. Upper flap 14 is also formed to be substantially rectangular to assure that the envelope is closed across its full width, and lower panel 20 is provided with bevels 30 so that it flares to the full width of upper panel 12 to assure that the lower corners of the completed mail piece are closed. It should also be noted that adhesive A on side flap 16 is applied so that it extends no further than lower panel 20 when the envelope is folded and does not come into contact with the sheets within the mail piece.

For a standard $8\frac{1}{2}\times 11$ size three-thirds sheet the following approximate dimensions have been found to be satisfactory for form 10.

Figure 3:
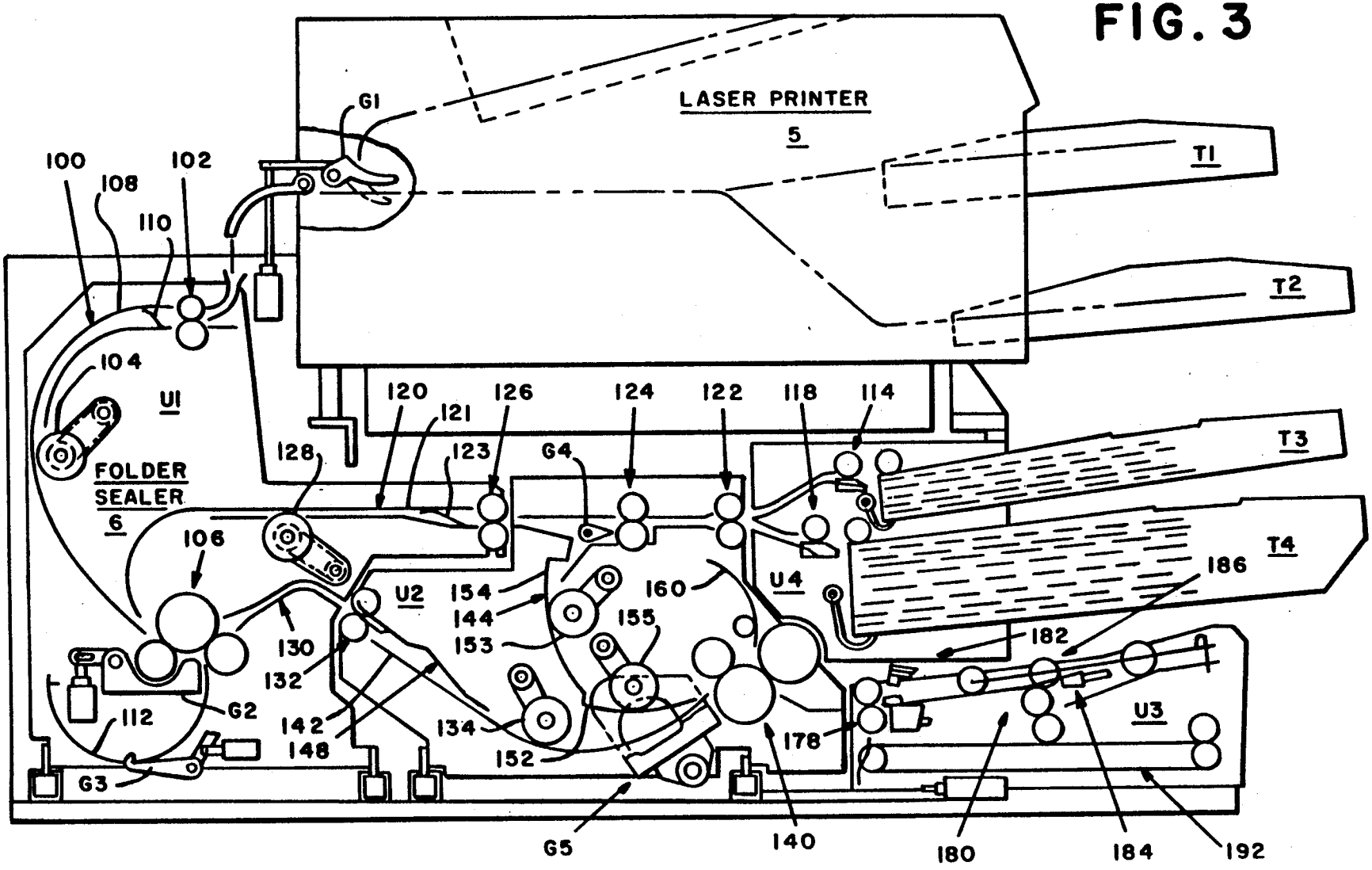
FIG. 3 shows a semi-schematic side view of a printer and a folder sealer apparatus in accordance with the subject invention.

D1=0.75 inches
D2=1.31 inches
L1=3.75 inches
L2=4.13 inches
W=8.70 inches
W'=8.50 inches Turning now to FIG. 3 a semi-schematic side view of folder sealer 6 is shown. As a printed envelope form 10 or a printed sheet exit laser printer 5 it is driven along guides 100 by roller pair 102 and then urged into the nip of accumulator folder assembly 106 by urge roller 104. (As used herein a sheet is "urged" when it is moved by an "urge roller" constructed to slip or stall on the sheet before the sheet will buckle under the load. This contrasts with sheets which are driven by roller pairs in a positive manner, substantially without slipping.)

Normally the first item will be an envelope form 10 and gate G2 will be in the activated (closed) state diverting form 10 for further processing as will be described further below. Normally following items will be printed sheets and motor M1 (shown in FIG. 6), which drives folder accumulator assembly 106 will be stopped and the sheets will be driven into the nip of assembly 106 by urge roller 104, which will continue to rotate. Because guide 100 is curved to increase the stiffness of the sheets roller 104 will slip on the sheets as they are driven into the nip of assembly 106 before the sheets will buckle. Relief 108 and spring 110 are provided in guide 100 so that the tail of any three-third sheets is held clear of roller pair 102 so that following printed sheets may pass over previous sheets and be accumulated in the nip of assembly 106.

If the sheets accumulated in the nip of assembly 106 include a three-thirds sheet gate G2 is deactivated (open) and motor M1 is started and the accumulated sheets are driven into curved, open, one sided buckle chute 112. Such chutes are described in U.S. Pat. No. 4,834,699 to: Martin, the disclosure of which is hereby incorporated by reference.

If the sheets to be printed have a significant curl it may prove necessary or desirable to use conventional closed buckle chutes, or to provide some other means of controlling the folding of curled sheets predisposed to fold in the wrong direction.

The accumulated sheets are folded by assembly 106 to a two-thirds length and exit assembly 106 for further accumulation with the previously passed form 10. Gate G3 may be activated for a "Z" fold (normally used with a window envelope); as will be described further below.

Alternatively a window envelope or pre-printed sheets, of three-thirds length, may be fed from trays T3 or T4 by feeder assemblies 114 or 118 and, with gate G4 deactivated, driven along curved guides 120 by roller pairs 122, 124, and 126 and urged by urged roller 128 for processing by accumulator folder assembly 106 in the same manner as described above for printed envelope forms 10 and printed sheets. Relief 121 and spring 123 are provided to assure that following sheets pass over previous sheets for accumulation.

If the sheets accumulated in the nip of assembly 106 are all two-thirds length the assembled sheets exit assembly 106 along guide 130 without folding.

The previously processed form 10, followed by the accumulated sheets, is moved along guides 130 by roller pair 132 and urge roller 134 until it is urged into the nip of accumulator folder assembly 140. Motor M2 (shown in FIG. 6), which drives assembly 140 is off (or, possibly, operating in reverse) and the leading edge of the accumulated sheets is aligned with the edge of lower panel 20 of form 10 in the nip of assembly 140. In the same manner as previously described, guides 130 are curved to increase the stiffness of form 10 and the accumulated sheets. Relief 142 operates as described above so that the accumulated sheets will clear form 10 and progress to the nip of assembly 140.

Since laser printer 5 will normally have a feed path designed for a conventional paper size (e.g. approximately 8½") envelope form 10, when feed through printer 5, is fed with flaps 16 folded into the closed position. Accordingly, an opening mechanism 148 is provided along path 130 to open flaps 16 before form 10 is accumulated with the following sheets.

Lateral guides G5 are provided to assure that the sheets are centered with panel 20 of form 10.

If two-thirds sheets, one-third sheets, or BRE's are fed from trays T3 or T4 along guides 120 gate G4 is activated and these sheets are diverted to guides 144. The diverted sheets are urged by urge rollers 146 and 148 into the nip of assembly 140 and are accumulated in the manner described above in the nip of assembly 140 with the previously processed envelope form 10, and any pre-folded printed or pre-printed three-thirds sheets. Guides 144 include relief 152 for one-thirds pre-printed sheets and BRE's and relief 154 for two-thirds pre-printed sheets.

After all sheets are accumulated with form 10, motor M2, which drives accumulator folder assembly 140, is started and drives the completed accumulation into buckle chute 160 so that the completed accumulation is folded about fold line 24 between upper panel 12 and lower panel 20 of form 10. As the folded accumulation exits from assembly 140 it is captured by roller pair 178 and carried into flap folder sealer assembly 180. There adhesive A is moistened by moistener 182, side flaps 16 are closed by closing mechanism 184 and tailing flap 14 is closed, and all flaps are sealed, by roller assembly 186. At this point form 10 and the accumulated sheets have been formed into a sealed mail piece. The sealed mail piece than is transported by transport 192 and exits folder sealer 6.

As sheets are driven into the nips of assemblies 106 and 140 with motors M1 and M2 not operating, any slight skew of the sheets with respect to the path of travel will be corrected as the leading edge of the sheets (or envelope form) are driven into the stationary nip. However, if the skew of the sheets is too great the leading corner may bind in the nip preventing correction of the skew. To avoid this it may prove desirable to briefly operate motors M1 or M2 in a reverse direction to allow the leading edges of the sheets to align themselves parallel to the nips as they are driven against them.

As will be described below appropriate velocity profiles for motors M1 and M2 are readily achieved since motors M1 and M2 are stepper motors having readily controllable velocity profiles. (While stepper motors have proven adequate other forms of motor, such as conventional brushless d.c. gear motors, which have better low speed torque characteristics, are within the contemplation of the subject invention and may prove preferable.)

Figure 4:
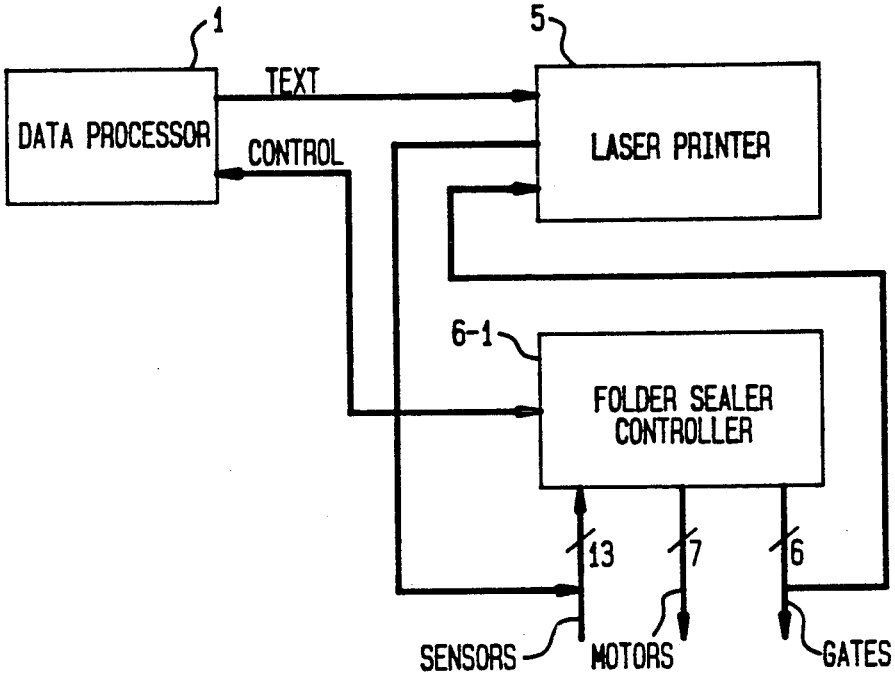
FIG. 4 shows a schematic block diagram of the flow of control and text information signals in accordance with the subject invention.

Turning to FIG. 4 the control architecture for the system of the subject invention is shown. As described above data processor 1 controls laser printer 5 through a parallel interface in a conventional manner to print text. Folder sealer 6 is controlled through a conventional serial communications port, such as an RS232 port. Folder sealer 6 is controlled by controller 6-1, which includes an integrated circuit microcontroller, which is preferably a model 80C196KB manufactured by the Intel Corporation of California. As will be described below controller 6-1 receives data structures defining the configuration for mail pieces in a given mail run, from data processor 1, as well as specific information for each mail piece, such as ID numbers and variable numbers of printed sheets to be included in the mail piece. Controller 6-1 than controls devices, (i.e. sensors, motors, and gates) in folder sealer 6 to produce mail pieces in accordance with the data structures and specific mail piece information. As can be seen in FIG. 4, minor modifications, easily within the skill in the art, have been made to laser printer 5 to allow controller 6-1 to read sensors S1, S2 and S3 provided in laser printer 5 and control gate G1 which is also part of laser printer 5.

Figure 5:
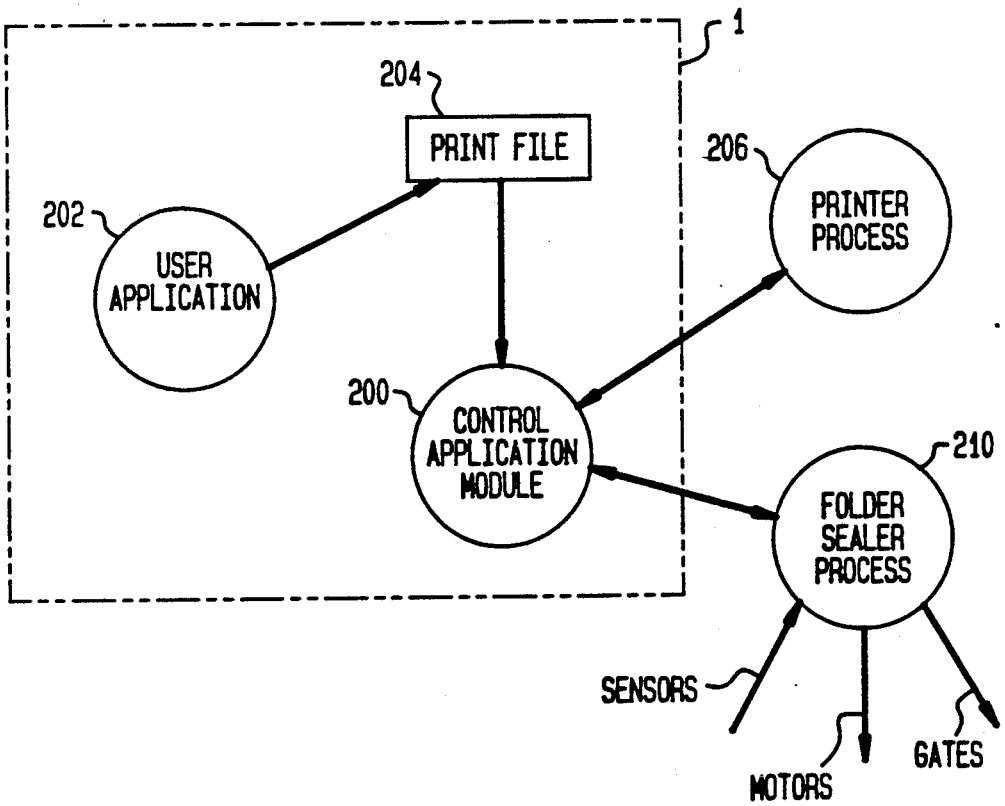
FIG. 5 shows a data flow diagram in accordance with the subject invention.

FIG. 5 shows the software architecture for the subject invention. In accordance with the subject invention data processor 1 runs a Control Application Module 200 to process documents produced by a conventional user application program 202 and output to a conventional print file 204. Control Application Module 200 includes a conventional printer driver to communicate with Printer Process 206 to print text from the documents in file 204 in a known, conventional manner, and a conventional, serial communications driver to communicate with folder sealer process 210, which runs in folder sealer controller 6-1. Module 200 also includes a Control Application Program which enables a user to define the mail piece configuration for a particular mail run. Data structures defining this configuration, as well as specific mail piece information are communicated to process 210 by the Communication Driver, and process 210 controls motors and gates in response to sensors to produce mail pieces comprising documents produced by the user application 202 and having a configuration in accordance with the data structures and specific mail piece information; as will be described further below.

Figure 6:
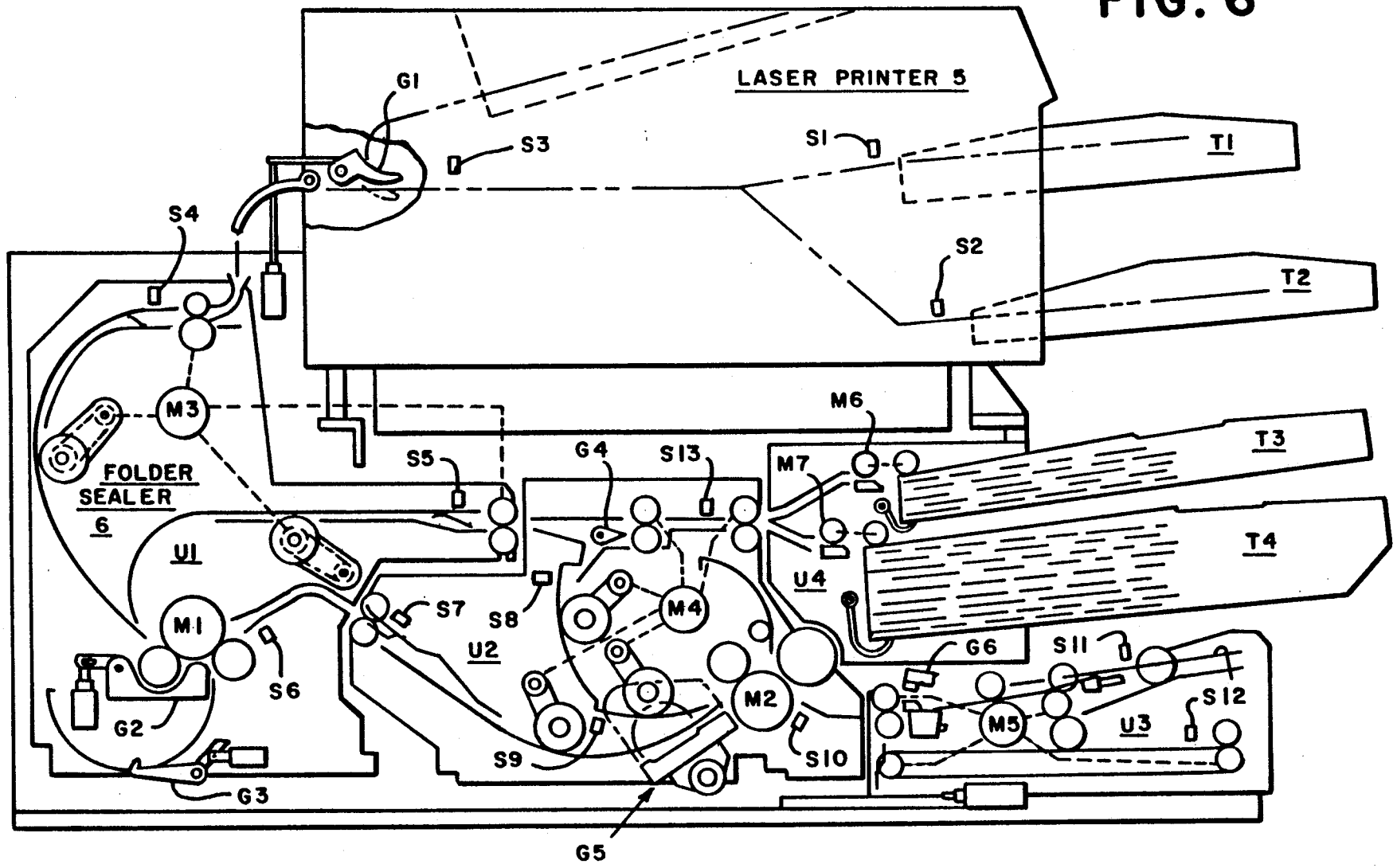
FIG. 6 shows the view of FIG. 3 showing the relationships of sensors, gates, and motors which are controlled in accordance with the subject invention to produce mail pieces having a particular configuration.

FIG. 6 is a schematic diagram of the sensors, motors and gates used in the prefer embodiment of the subject invention shown in FIG. 3. Sensors S1, S2 and S3 are part of commercially available laser printer 5. In the embodiment shown sensors S1 and S2 are provided by monitoring the feed signals to trays T1 and T2, though optical sensors to positively detect passage of sheets are, of course, within the contemplation of the subject invention. Sensor S3 is an optical sensor also provided in laser printer 5 which monitors output of sheets after printing. Gate G1 is a mechanical gate, also part of laser printer 5, which diverts sheets for output on top of laser printer 5, and as noted, has been modified so that it operates under control of controller 6-1. Sensor S4 is an optical sensor provided in folder sealer 5 to detect passage of a printed sheet from laser printer 5 to folder sealer 6 along guides 100. Sensor S5 is an optical sensor which detects the presence of pre-printed sheets on guides 120 downstream of gate G4. Sensor S6 detects the presence of sheets output from accumulator folder assembly 106 on guides 130, and sensor S7 detects the presence of sheets accumulated in the nip of accumulator folder assembly 140. Sensors S8 and S9 detect the presence of two-thirds and one-thirds sheets, respectively, which have been diverted from guide 120 by gate G4 to accumulator apparatus 140. Sensor S10 is an optical sensor which detects the presence of a folded envelope form 10 and accumulated sheets output from apparatus 140 and sensor S11 is an optical sensor which detects the presence form 10 and the accumulated sheets in trailing flap folder sealer 180. Sensor S12 is an optical sensor which detects the output of a folded and sealed mail piece. Sensor S13 is an optical sensor which detects the presence of pre-printed sheets on guides 120 upstream from gate G4.

Gate G1 diverts sheets after printing for output at the top of laser printer 5 so that laser printer 5 may be used as a conventional computer output line printer without printed sheets passing through folder sealer 6, and also to facilitate recovery from jam conditions. When activated gate G2 diverts envelope form 10 and two-thirds length printed sheets through assembly 106 without folding. When activated gate G3 effectively shortens the length of buckle chute 112 so that sheets accumulated for folding by assembly 106 are ultimately folded in a "Z" fold, and when deactivated allows the full length of the accumulated sheets into buckle chute 112 so that these sheets are ultimately folded in a "C" fold. Gate G4 when activated diverts pre-printed two-thirds and one-thirds length sheets and BRE's from guide 120 to guides 144 for accumulation at accumulator folder assembly 140.

As will be described further below gates G5 and G6 are different from the other gates in that they do not change the path followed by sheets as they move through folder sealer 6. However, for control purposes they are handled as gates. Gate G5 is actually a pair of symmetrically movable lateral guides which are operated to assure that sheets accumulated with form 10 and apparatus 140 are laterally aligned with form 10. Gate G6 is part of moistener 182 which moistens adhesive A on flap 14 of form 10 as it enters trailing flap folder sealer 180. Gates G1-G6 are each operated individually under direct control of controller 6-1.

Motors M1 and M2 operate accumulator folder assemblies 106 and 140 respectively. Motor M3 operates urge roller 104 and 128, and roller pairs 102 and 126, and motor M4 operates urge rollers 153 and 155 and roller pairs 122, 124, and 132 (all shown in FIG. 3).

Motor M5 operates flap folder sealer 180 and motors M6 and M7 feed pre-printed sheets from trays T3 and T4, respectively. Motors M1 through M7 are each operated individually under the direct control of controller 6-1.

Consideration of FIGS. 3 and 6 shows that folder sealer 6 is formed of modules, or units, U1, U2, U3 and U4. Module U1 includes assembly 106, urge rollers 104 and 128 and associated guides and roller pairs, as well as gates G2 and G3. As can be seen from FIG. 6 assembly 106 is driven by motor M1 and all urge rollers and roller pairs in U1 are driven by motor M3. Motors M1 and M3 are physically contained in module U1, as are actuators for gates G2 and G3. Module U1 thus is a physically separable unit for forming and folding an accumulation of sheets.

Module U2 includes assembly 140, urge rollers 134, 153 and 155 and associated guides and roller pairs, as well as gate G4 and G5 and side flap opening mechanism 148. As can be seen from FIG. 6 motor M2 drives assembly 140 and all urge rollers and roller pairs are driven by motor M4. As will be described below, motor M4 also actuates gate G5 through a conventional one cycle clutch. Motors M2 and M4 are physically contained in module U2 as is the actuator for gate G4. Module U2 is thus a physically separable unit for accumulating and folding printed and pre-printed sheets with envelope form 10, and also for opening the side flaps of form 10, and for laterally aligning the accumulation before folding.

Module U3 comprises flap folder sealer 180, which includes moistener 182, closing mechanism 184 and roller assembly 186, transport 192, and associated guides and roller pairs. As can be seen from FIG. 6, roller assembly 186, transport 192 and all roller pairs are driven by motor M5. Motor M5 is physically contained in module U3, as is the actuator for gate G6, which is comprised in moistener 182. Module U3 thus is a physically separable unit for moistening, closing and sealing of flaps 14 and 16 of form 10.

Module U4 comprises feeder assemblies 114 and 118, which are driven by motors M6 and M7 respectively. Motors M6 and M7 are contained in module U4, which is thus a physically separable unit for sheet feeding.

Construction of folder sealer 6 as physically separable modules offers significant advantages in manufacturing and particularly in maintenance, where a malfunctioning module may be easily replaced as a unit.

Figure 7:
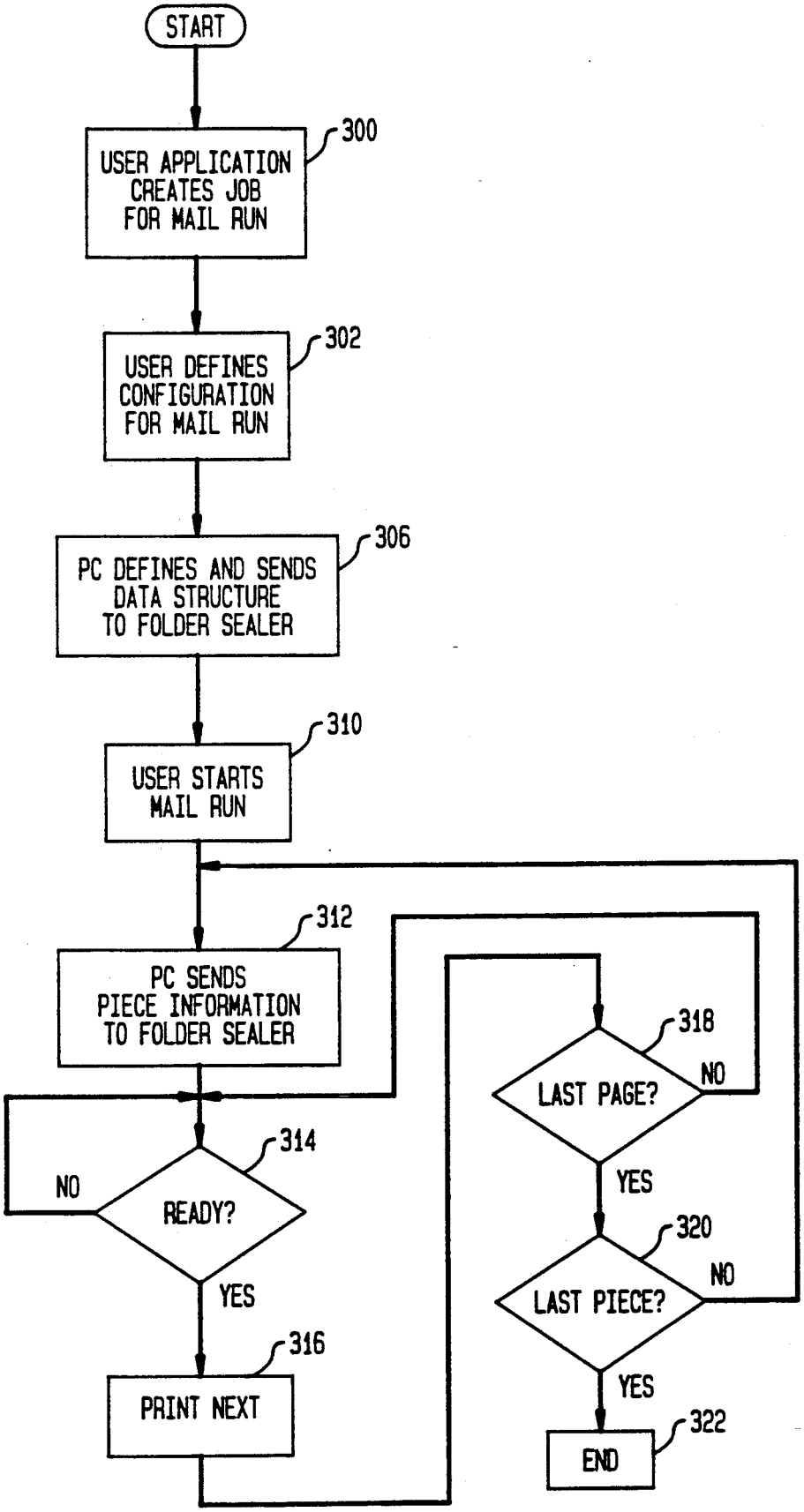
FIG. 7 shows a flow chart of the operation of the data processor of FIG. 1 in producing a mail run in accordance with the subject invention.

FIG. 7 shows a flow chart of the operation of the system FIG. 1 in preparing a mail run. At 300 a user program, which may be any existing program which creates documents which are to be mailed, and outputs a JOB (i.e. a file of documents) to print file 204 in a conventional manner. Thus, in can be seen that the system of the subject invention interfaces with existing user application programs with minimal, if any, modification to those programs.

At 302 the Control Application Program in the Control Application Module interacts with a user who defines a configuration for the mail run by specifying the types of sheets in each of trays T1 through T4 and the number of sheets to be included from each tray in the mail piece, subject to the rules for allowable mail piece configurations specified. Note that within these rules the number of printed pages to be included in a mail piece may vary from mail piece to mail piece within a given mail run. At this point the user may also identify an address block in the documents comprising the JOB and the Control Application Module will cause that address to be printed on a printed envelope form 10 and in selected address fields of printed sheets. Note that the control Applications Program checks to assure that occurrences of a particular address are contiguous. That is, a sheet for form 10 having a particular address may be followed by sheets having no address but a second address must not occur between two occurrences of the same address.

As will be defined further below, the Control Application Program defines a data structure from the information supplied by the user defining the desired configuration for the mail run and sends this data structure to folder sealer controller 6-1. As will also be described further below controller 6-1 controls the sensors, motors, and gates described above in accordance with this data structure to produce mail pieces in the desired configuration.

Once the configuration is defined at 310 the user may initiate a mail run. At 312 the Control Application Program sends specific piece information to folder sealer controller 6-1. Preferably, this information includes date, piece ID, which is used in recovery from jam or error conditions so that if part of a mail piece is lost because of a paper jam the mail piece may be reprinted without loss of data, the number of pages to be printed, which may be variable within the limitations described above, and the type and ID of the device which initiates processing for each mail piece. If the specified configuration includes a printed envelope form 10 the folder sealer operation will begin when sensor S senses printed envelope form 10 being fed into laser printed 5. If the configuration specified includes window envelope form 10 controller 6-1 will initiate operation by activating motor M6 to feed form 10 from tray T3. At 314 and 316 the Control Application Program will activate printer 5 when folder sealer six is ready. If the first sheet is a printed envelope form 10 folder sealer 6 will be ready as soon as it is initialized and has responded to the piece information sent at 312 and the mail run will be initiated by the Control Application Program initiating printing of form 10 by laser printer 5; triggering sensor S1. If a window envelope form 10 is to be processed first controller 6-1 will initiate processing by activating motor M6 and the Control Application Program will respond to signals from controller 6-1 to initiate printing of sheets as required in accordance with the specified configuration. At 318 Control Application Program determines if the last printed sheet has been printed, and if not, returns to 314 to print the next sheet. If the last sheet has been printed at 320 the Control Application Program determines if this is the last mail piece, and if not, returns to 312 to begin printing of the next mail piece. When the last mail piece in a mail run has been processed the Control Application Program ends.

Figure 8A:
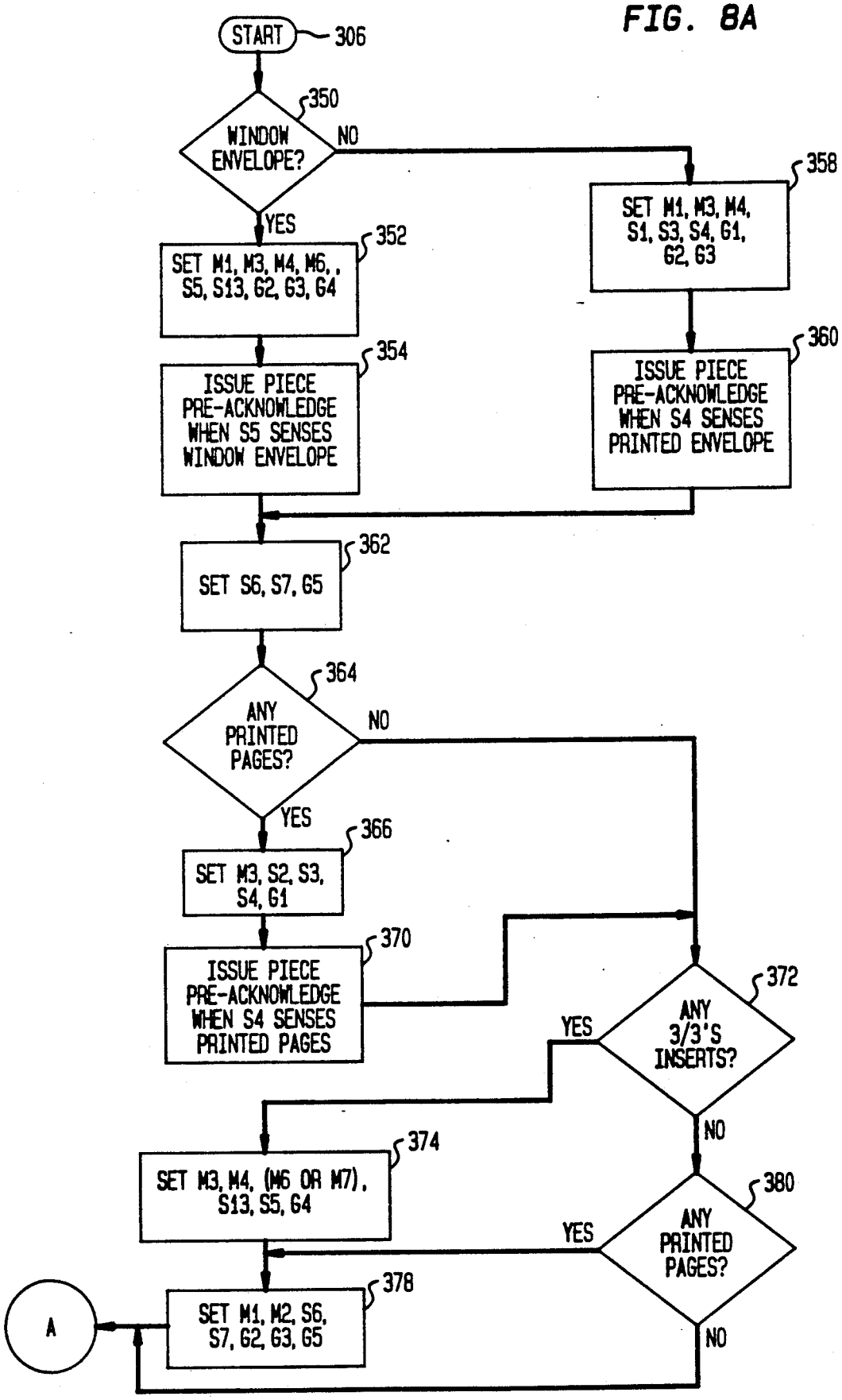
FIGS. 8A and 8B show a flow chart of the operation of the data processor of FIG. 1 in translating configuration information input by a user into a data structure for operation of the apparatus of FIG. 1.
Figure 8B:
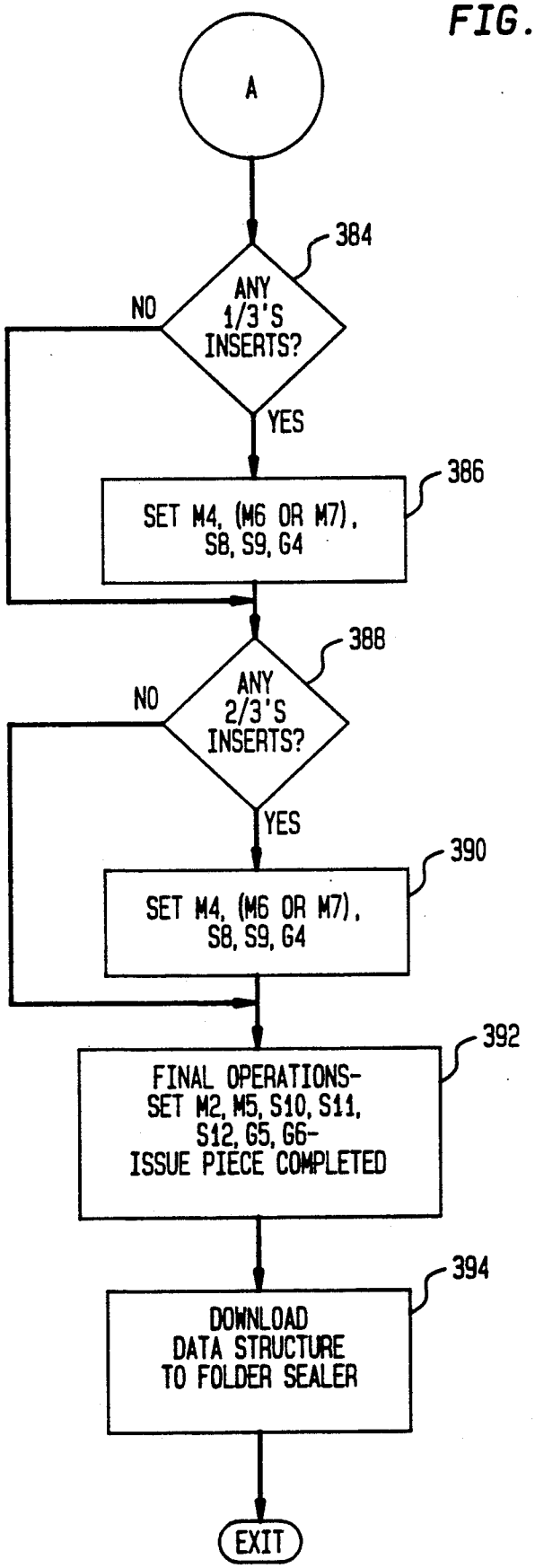

FIGS. 8A and 8B show a flow chart of the operation of the Control Application Program at 306 in translating the mail piece configuration defined by the user at 302 into a corresponding data structure. At 350 the program determines if the user has specified a window envelope. If a window envelope is specified, at 352 the Control Application Program specifies that motor M6 will turn on to feed window envelope form 10 from tray T3, motors M3 and M4 will be turned on to transport form 10 to accumulator folder apparatus 106. Gate G4 will be deactivated so that form 10 is not diverted from guide 120 onto to guide 144. Motor M1 is specified to start to transport form 10 through assembly 106 so that it is further transported by motors M3 and M4 into the nip of accumulator folder assembly 140. Gates G2 and G3 are specified so that form 10 is not folded, and sensors S5 and S13 are specified to monitor the flow of form 10 into apparatus 106. At 354 the data structure is specified so that Piece Pre-Acknowledge is issued when form 10 is sensed by sensor S5.

If the user specified a non-window, printed envelope sensors S1, S3 and S4 are specified to monitor flow of form 10 from laser printer 5 into apparatus 106. Motors M1, M3 and M4 are specified to start to transport form 10 through assembly 106 to the nip of assembly 140. At 360 the data structure is specified so that a Piece Pre-Acknowledge is issued when sensor S4 senses form 10.

In either event, at 362 the data is specified so that sensors S6 and S7 monitor the flow from assembly 106 to 140, and gate G5 is activated to align form 10 (either window or printed) and motor M2 is jogged to align form 10 in the nip of apparatus 140.

This completes the data structure specifying operations on envelope form 10. Then, at 364 the Control Application Program determines if the user has specified any printed pages. If there are printed pages at 366 motor M3 is specified to start to feed sheets after they are printed by printer 5, and sensors S2, S3 and S4 are specified to monitor the flow of the sheet from tray T2 to accumulator folder assembly 106. Gate G1 is specified to be deactivated so that the sheet will pass out of laser printer 5 into folder sealer 6. At 370 the data is specified so that Piece Pre-Acknowledge issues when sensor S4 senses the sheet. Then, or if no printed pages were found at 364, at 372, the program tests to determine if any three-thirds inserts have been specified by the user. If three-thirds inserts are specified at 374 motor M6 will be specified to start to feed pre-printed sheets from trays T3 and motors M3 and M4 will be started to transport the pre-printed sheets along guide 120 into the nip of accumulator folder apparatus 106, where they will be accumulated with any printed sheets. Sensors S5 and S13 are specified to monitor the flow of the pre-printed inserts into the nip of apparatus 106, and gate G4 will be deactivated. Than, at 378, the data is specified so that motor M1 will be started to fold the printed and/or pre-printed sheets which have been accumulated. Gate G2 is deactivated so that the accumulated sheets will enter buckle chute 112 and gate G3 will be activated or deactivated depending upon whether a "C" or "Z" fold is specified. Sensors S6 and S7 monitor the flow of the folded accumulation of three-thirds sheets and gate G5 will be activated to laterally align the accumulated sheets with form 10 in the nip of assembly 140.

Returning to 372, if there are no three-thirds pre-printed inserts at, 380 the program again determines if there were any printed pages, and if there were, again goes to 378 to set motors M1 and M2, sensors S6 and S7, and gates G2 and G3 and G5 as described above. If there were neither any three-thirds pre-printed inserts nor printed pages, or after 378, the data specification for three-thirds pages is completed and the Control Application Program goes to 384 in FIG. **8*b***.

At 384 the program determines if any one-third pre-printed inserts or BRE's had been specified by the user. If any have, then at 386 the data is specified so that motor M7 will be started to feed from tray T4, and gate G4 is activated so that the insert or BRE is transported along guides 144 into the nip of the apparatus 140. Motor M4 will be started to transport the insert or BRE. Sensors S8 and S9 will be specified to monitor the flow of the insert or BRE.

Whether or not there are any one-third inserts at 388 the program will determine if there are any two-thirds inserts. If there are at 399 motors M4 and M6 or M7, sensors S8 and S9, and gate G4 will be set at 386.

This will complete provision for all the parts of the configurations specified by the user, which will be accumulated at the nip of apparatus 140. At 392 the final operations common to all mail pieces are carried out. Motor M2 is specified to start to make the final fold in the mail piece, and motor M5 is specified to start to activate flap folder sealer 180 to fold the side and trailing flaps and finally seal the mail piece. Sensors S10, S11 and S12 are specified to monitor the flow of the mail piece, and gate G6 will be specified to moisten adhesive A on form 10. A Piece Completed is specified when the completed mail piece is sensed by sensor S12.

Once the data structure is completed for the particular configuration specified by the user the completed data structure is downloaded to folder sealer 6 at 394.

The data structure developed by data processor 1, as described above, consists of from 1 to 4 data elements for each device active in processing a particular configuration, each including control parameters for specifying an operation to be performed by one of the sensors, motors, or gates shown in FIG. 6. Each data element is identified by an initial operation index value (or OP STATE) and includes a default initial state; that is the state the device will first enter when it is enabled unless another state is specified. The data element also specifies other devices and routines which are activated by the particular device associated with each data element. The data element specifies which devices may be enabled or disabled and under what conditions during the operation of the particular device the other devices will be enabled or disabled. Each data element may also specify an alternative initial state for another device to be enabled. Each data element will also specify the next operation index value to indicate the next operation to be performed. If the corresponding device performs more than one operation; that is associated with more than one data element, an EXECUTE NEXT control byte is included in the associated data element indicating whether the next operation will be initiated immediately or the device will complete the first operation and return to an Idle State.

The set of data elements comprising the data structure which specifies the configuration selected by the user is executed by controller 6-1 to control the process of forming a mail piece. Controller 6-1 sequentially executes an Idle State to test each of the sensors, gates, or motors to determine if that device is enabled and for each such enabled device executes a state routine which corresponds to the current state and current operation index value for that enabled device. Devices which are not enabled remain in an Idle State.

Figure 9:
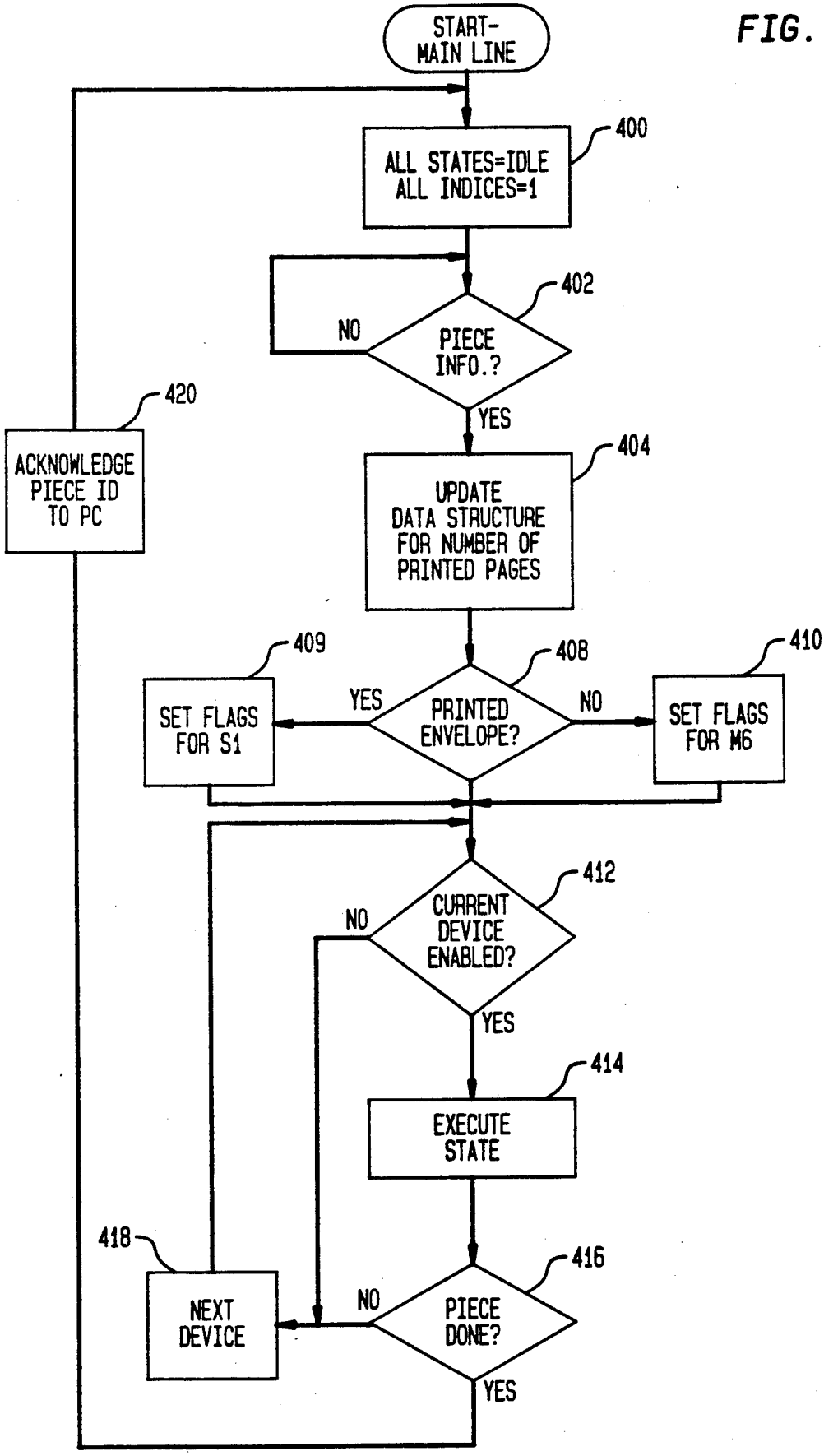
FIG. 9 shows a flow chart of the operation of the controller of FIG. 4 in controlling the devices of FIG. 6 to produce a mail pieces.

FIG. 9 shows a flow chart of the mainline routine which tests each device in folder sealer 6, and sensors S1, S2 and S3, and gate G1 in laser printer 5; which, as noted operate under control of controller 6-1. After the data structure has been downloaded and controller 6-1 has responded to data processor 1, at 400 all devices are in an Idle State and all operation index values are set equal to 1. At 402 controller 6-1 waits for initial piece information from data processor 1. This piece information includes a mail piece identification number, which may be used in recovering from a paper jam or other error condition; the number of printed pages included in a particular mail piece, which as noted above may be variable; and the identification of the particular device which will initiate operation on that mail piece. That is, depending upon whether the mail piece has a non-window, printed envelope or a window envelope, operations on the mail piece will commence either when sensor S1 detects a non-window form 10 being fed from tray T1 as data processor 1 initiates printing, or controller 6-1 will energize motor M6 to feed a window envelope form 10 from tray T3. When the piece information is received at 402 the data structure is updated for the number of printed pages, as will be described further below. It should be noted that only the number of printed pages is allowed to vary, and that in the preferred embodiment described those data elements related to assembling pre-printed sheets and BRE's are fixed in each configuration for a mail run. At 408, depending upon whether the mail piece includes a printed envelope form 10 or a window envelope form 10, the program will either set flags to enable sensor S1 at 408 or set flags to enable motor M6 at 410. In either case, at 412 the mainline routine will b activated to sequentially execute the Idle State for each device to test the devices to identify those which are enabled. If the device currently tested is enabled at 414 the device state routine corresponding to the present operational index and state for that device is executed. At 416 the routine determines if the mail piece has been completed, and if it has not, at 418 indexes to the next device and returns to 412. If the mail piece has been completed controller 6-1 acknowledges completion by transmitting the piece identification to data processor 1, at 420, and returns to 402. The mainline routine will remain in a loop until the mail run is complete and the system is reset.

Alternatively to downloading a new configuration for each mail run a JOB created on the user's application program may be output as a mail run using a previously stored configuration in a matter essentially identical to that described above.

Figure 10A:
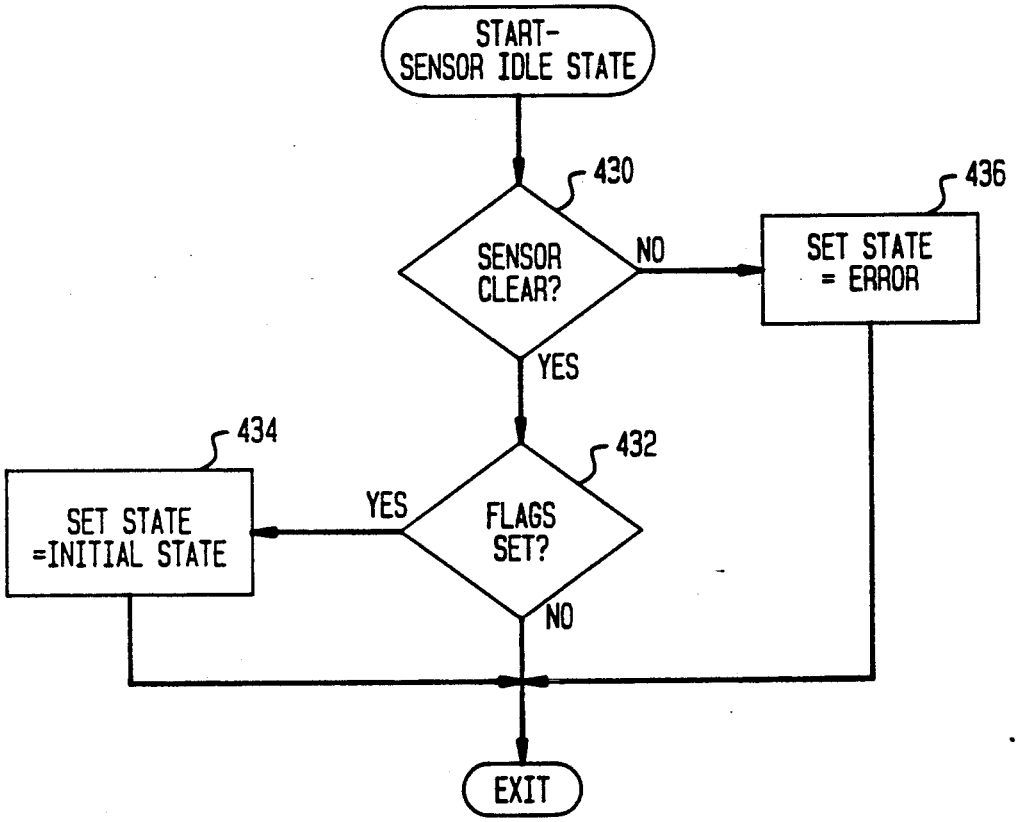
FIGS. 10A through 10H show flow charts of State Routines for sensors shown in FIG. 6.

FIGS. 10A–10H show the state routines for sensors. FIG. 10A shows the sensor's Idle State, where at 430 the routine tests to determine if the sensor is cleared. If it is clear, at 432 the routine tests to determine if the flags for the corresponding sensor are set; that is if the corresponding sensor is enabled. If the corresponding sensor is enabled at 434 the state is set to be the Initial State, either as defined in the current OP STATE or as specified by the controlling device which has enabled the corresponding sensor. Controller 6-1 than exits the routine and returns to the mainline program. If, at 430, the sensor is not clear the state is set to equal Error State and the routine exits.

Figure 10B:
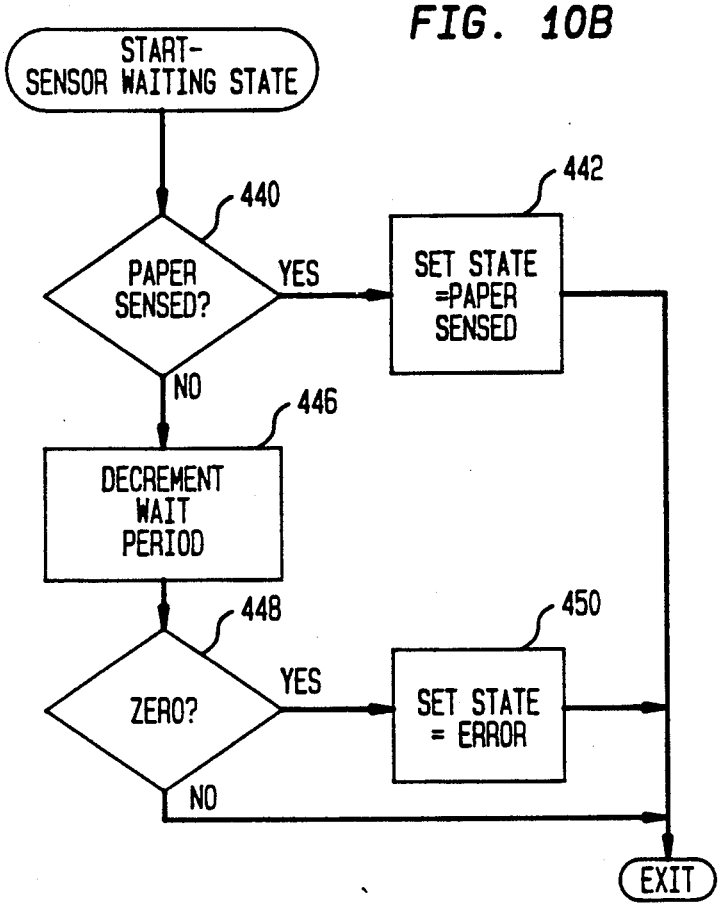

FIG. 10B shows the sensor Waiting State, which is the normal default state for all sensors. At 440 the routine tests to determine if paper has been sensed. If it has, at 442 the state for the corresponding sensor is set to be equal to Paper Sensed and the routine exits. If no paper is sensed, at 446 a wait period is decremented and at 448 the routine test to determine if the wait period has expired. If it has at 450 the state is set to be equal to Error and the system exits, otherwise the system exits at 448.

Figure 10C:
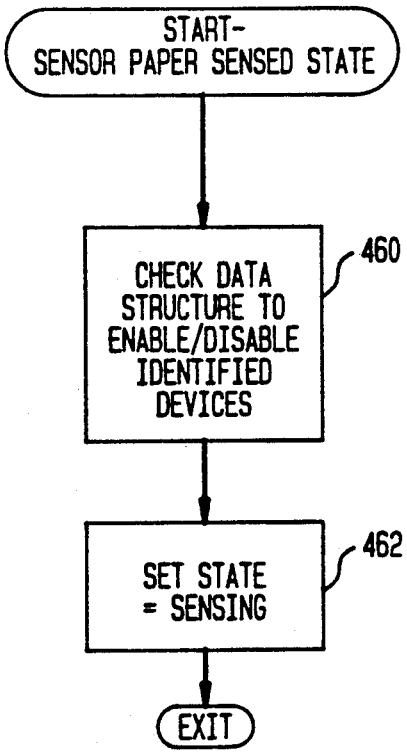

FIG. 10C shows the sensor Paper Sense State. At 460 the routine checks the data structure to access the data element corresponding to the current OP STATE for the corresponding sensor to enable or disable devices and routines identified in the corresponding data elements. Than at 462 the state is set equal to Sensing and the routine exits.

As noted above in the preferred embodiment described herein devices are enabled by setting corresponding flags. Preferably two flags are provided so that devices may be enabled by logically "anding" the occurrence of two events. Similarly, the device may be disabled by resetting these flags.

Figure 10D:
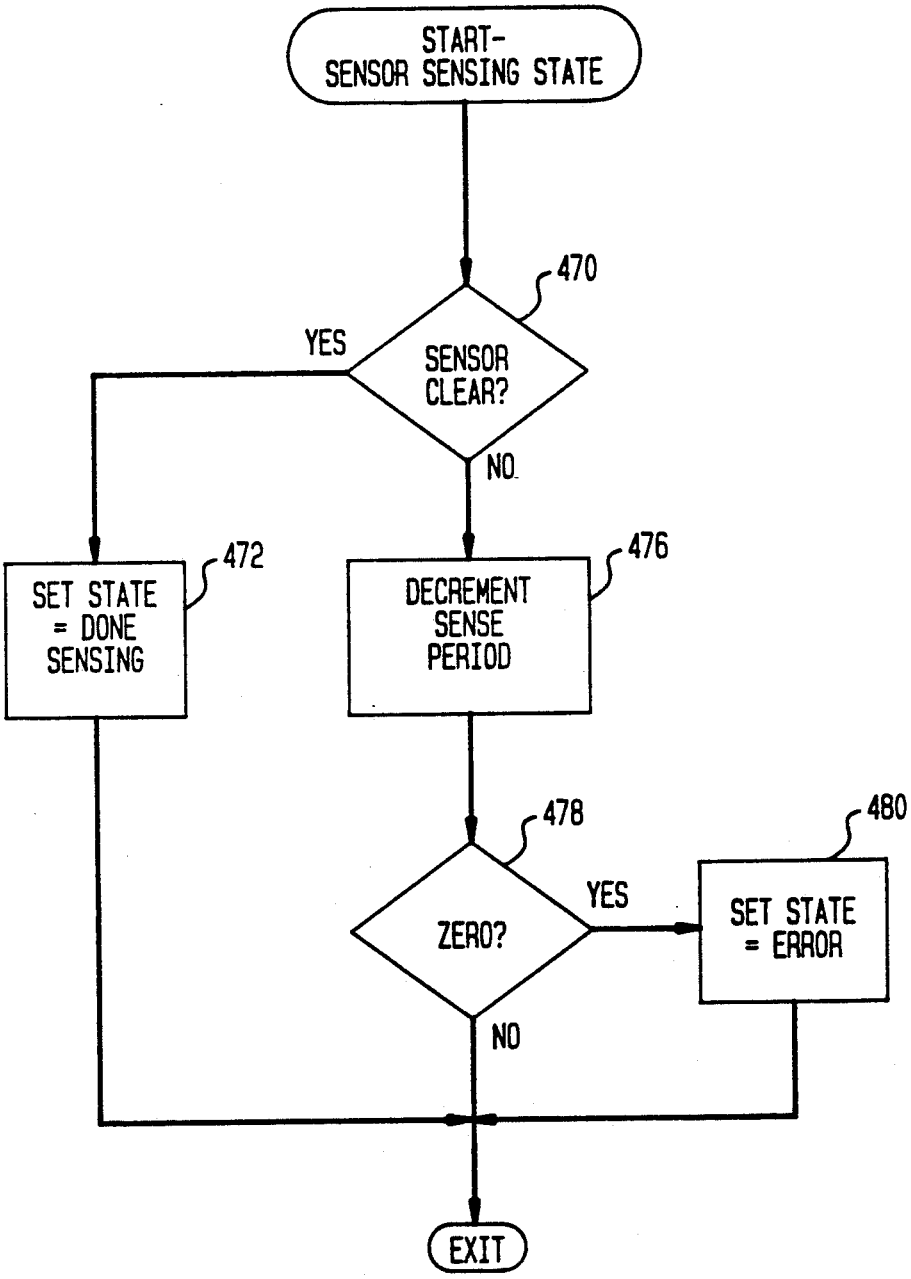

FIG. 10D shows the sensor Sensor Sensing State. At 470 the routine tests to determine if the sensor is clear. If it is, at 472 the state is set to equal Done Sensing and the routine exits. If the sensor is not clear at 470, at 476 the Sense Period is decremented and at 478 the routine determines if the period has expired. If it has, the state is equal to Error at 480 and the routine exits, otherwise the routine exits at 478.

Figure 10E:
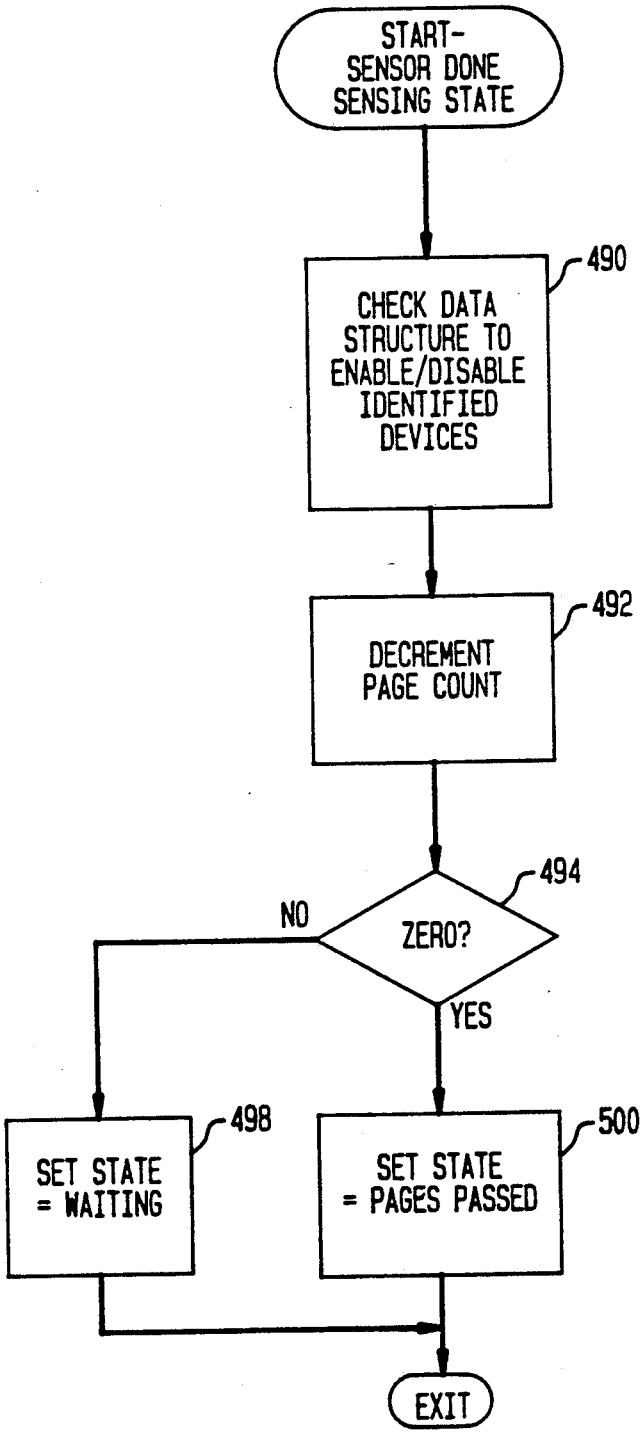

FIG. 10E shows a flow chart of the sensor Done Sensing State. At 490 the routine again checks the corresponding data element in the data structure to identify devices and routines to be enable or disabled. Than at 492 the page count is decremented. As noted above if the current OP STATE relates to processing printed pages this page count may be varied for each mail piece in accordance with the piece information transmitted from data processor 1. For other sheets the page count will remain constant through a mail run. Than at 494 the routine tests to determine if all pages have been processed, If not, than at 498 the state is set equal to Waiting and the system exits. If all pages have been processed the state is set equal to Pages Past at 500, and the routine exits.

Figure 10F:
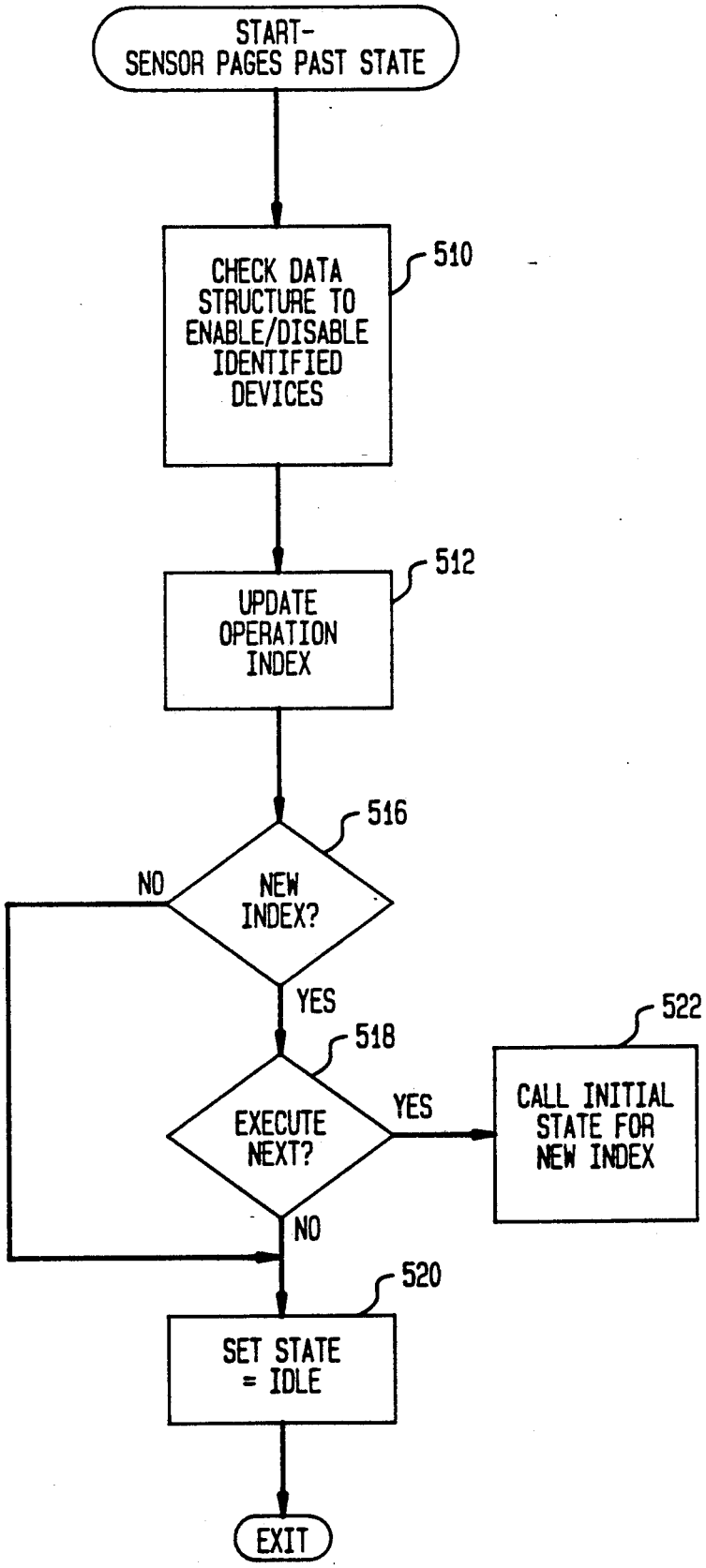

FIG. 10F shows the sensor Pages Passed routine. At 510 the routine again accesses the corresponding data element to enable or disable identified devices and routines. At 512 the routine accesses the data element to update the operation index value, and 516 determines if there is a new index value. If there is, at 518 the routine determines if EXECUTE NEXT is set. If EXECUTE NEXT is not set, or if at 516 the index value is not changed, the state is set equal to Idle State the flags are cleared and the system exits. If EXECUTE NEXT is set, than at 522 the routine directly calls the Initial State for the new operation index value.

Figure 10G:
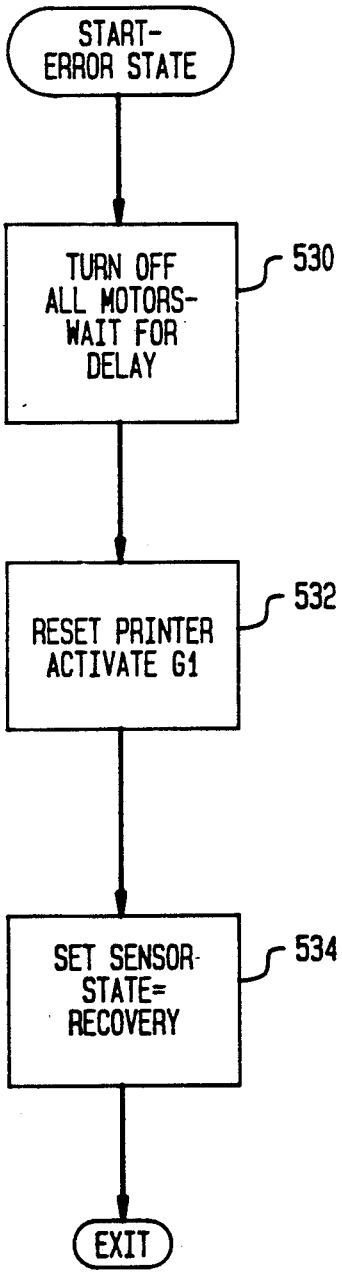

FIG. 10G shows the Error State, which is the same for all sensors. At 530 the routine turns off all motors and waits for a predetermined delay. At 532 controller 6-1 resets printer 5 and activates gate G1 to divert any following printed sheets from folder sealer 6. At 534 the routine sets the state equal Recovery.

Figure 10H:
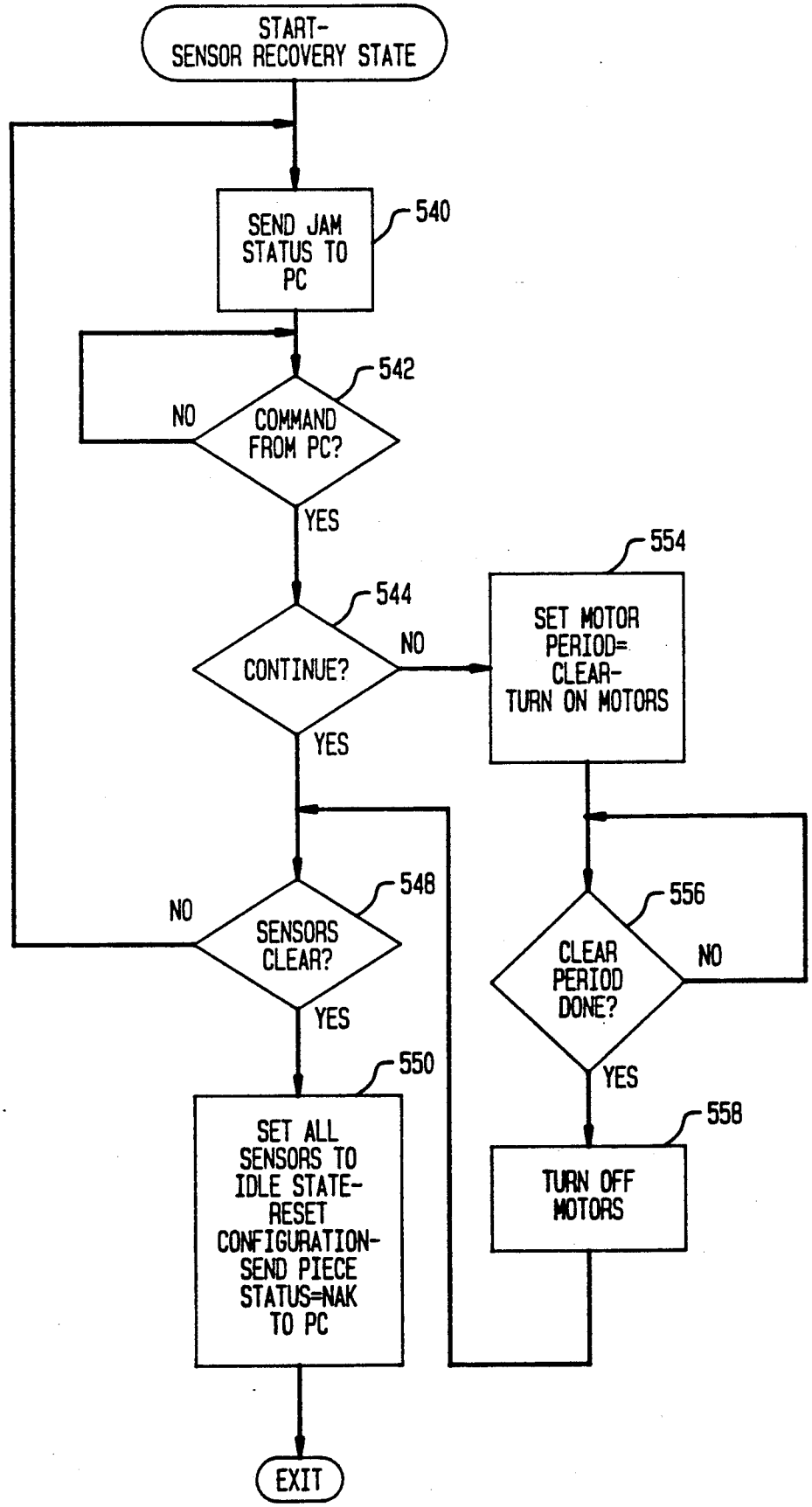

FIG. 10H shows the sensor Recovery State. At 540 the routine sends a jam status to data processor 1 and 542 waits for a command from data processor 1. At 544 the routine determines if the command is Continue, and if so at 548 determines if all sensors are cleared. If all sensors are not clear the routine returns to 540 and again sends status to data processor 1. If all sensors are clear, at 550 all sensors are set to Idle State the data structure defining the configuration for the mail run is reset and a Not Acknowledge piece status is sent to data processor 1 to indicate that processing of the identified mail piece was unsuccessful. If at 544 the command is not Continue then at 554 the motor periods are set to a predetermined clear period and all motors are turned on to attempt to automatically clear the jam. At 556 the routine waits to determine if all motors have run for the clear period and than at 558 turns off all motors. The routine than goes to 548 to test if all sensors are clear; i.e. if the jam has been cleared, if the jam is successfully cleared the routine again goes to 550 and exits. Otherwise the routine returns to 540 and initiates the recovery process again.

FIG. 11A shows the motor Idle State. At 600 the routine tests to determine if both flags are set for the motor corresponding to the device currently being tested by the mainline program. If the flags are set than at 602 the motor state is set equal to the initial State, either as specified by the controlling device or as defined as the default state by the corresponding data element. Also the motor phase and direction are set. If, at 600, the flags are not set than 604 the routine assures that the corresponding motor is stopped, and in either event the routine then exits.

FIG. 11B shows a flow chart for the motor Starting State. At 610 the routine checks the corresponding data element and enables or disables the identified devices and routines. At 612 the motor state is set equal to Running.

Note that normally Starting State will be the default Initial State for all motors.

Figure 11C:
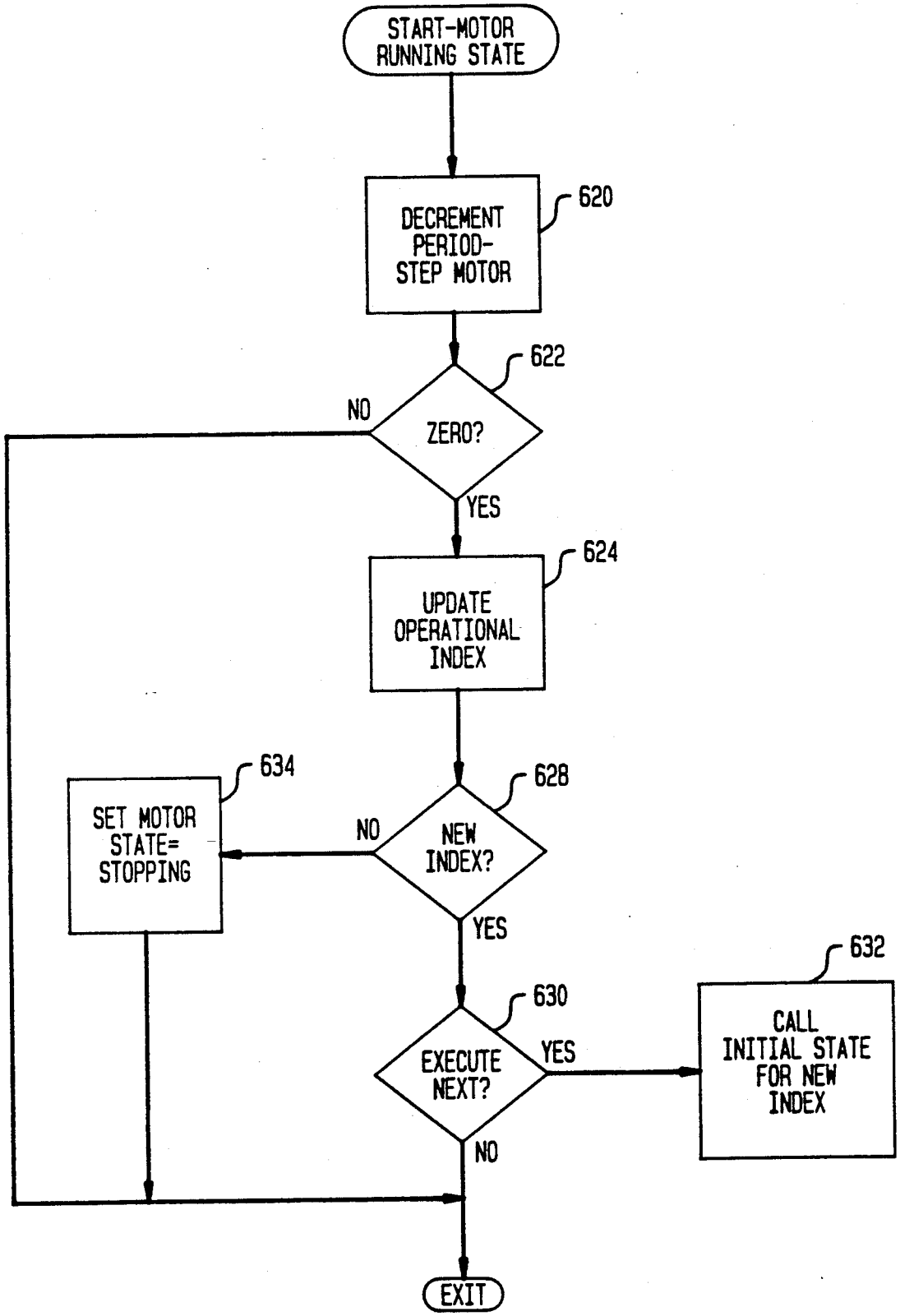

FIG. 11C shows a flow chart for the motor Running State. At 620 a predetermined motor period is decremented and the motor is stepped along a predetermined velocity profile.

As motors M1 through M2 are conventional stepper motors it is well known that they are readily driven on a wide range of velocity profiles by conventional means, which need not be described here for an understanding of the subject invention.

Typically the velocity profile for motors M3 through M7 will be conventional trapezoidal profiles. Thus, tough stepper motors may be used, conventional AC/DC motors will perform acceptably, and are probably preferable for reasons of cost. However, in accordance with preferred embodiments of the subject invention the velocity profiles for motors M1 and/or M2, which drive accumulator folder assemblies 106 and 140 respectively, will cause the velocity to decrease at the point where accumulated sheets are being folded in order to increase the torque while sheets are being folded. These profiles also include a decrease in velocity as the folded sheets exits accumulator folders 106 and 140 to facilitate a smooth hand off of the folded sheets to the next operation.

Next the routine, at 622, tests to determine if the running period is finished. If it is, then at 624 the routine updates the operational index value in accordance with the corresponding data element. At 628 the routine determines if there is a new index. If there is, at 630 the routine determines if EXECUTE NEXT is set. If it is not the routine exits. If it is set, then at 632 the initial state for the new operation index value is directly called. If at 628, the index value remains unchanged, then at 634 the motor state is set equal to Stopping and the routine exits. If at 622 the running period is not completed then the routine again exits.

Figure 11D:
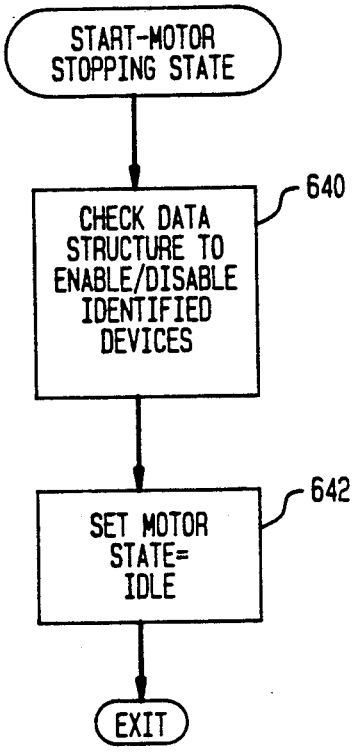

FIG. 11D shows the motor Stopping State. At 640 the routine checks the data structure to enable or disable devices and routines identified by the corresponding data element. At 642 the motor state is set equal to Idle State and the flags are reset.

Figure 11E:
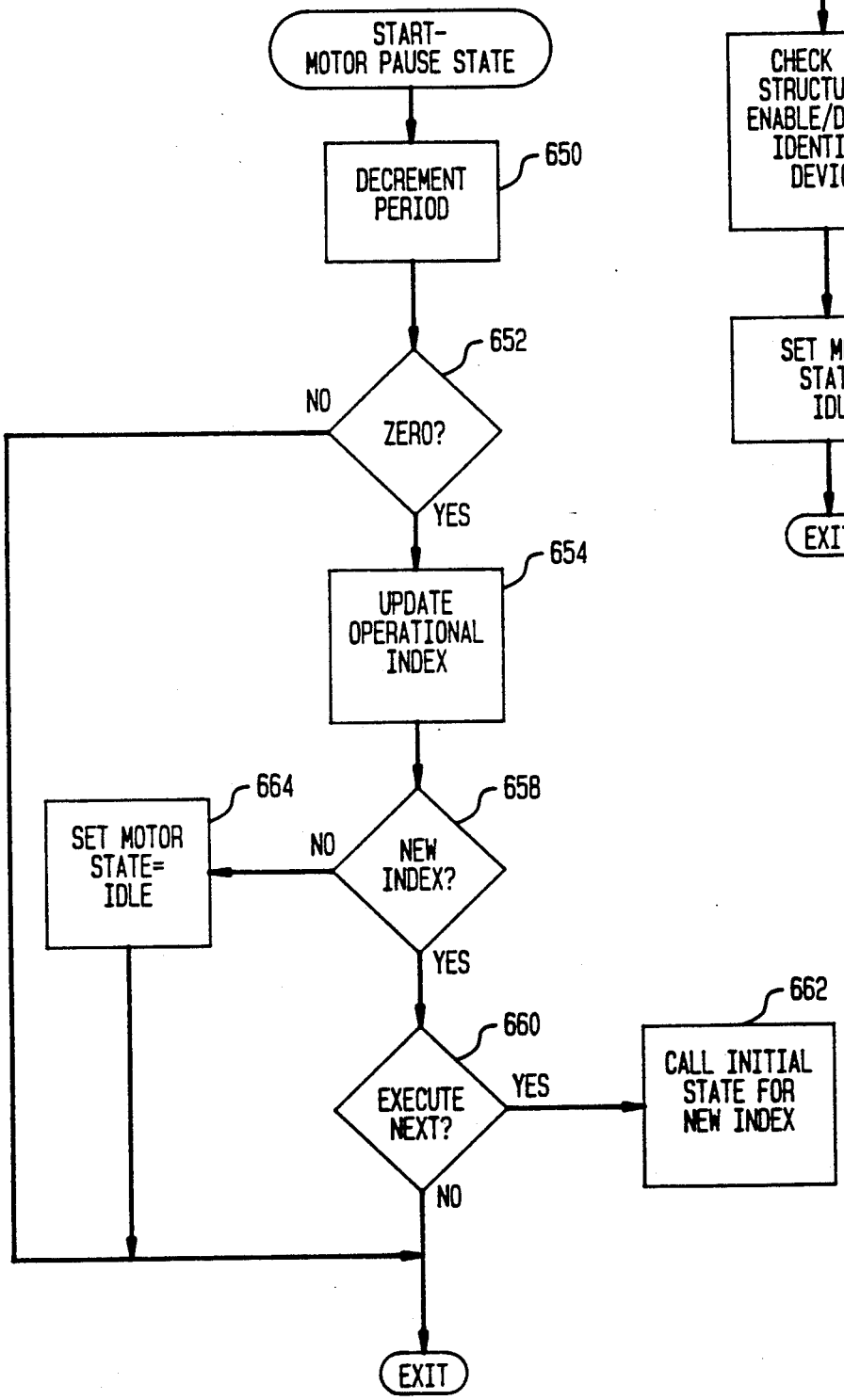

FIG. 11E shows the motor Motor Pause State. The sequence of the routine for this state is substantially similar to motor Running State shown in FIG. 11C, however the motor is not operated while the Motor Pause State. This state is initiated for timing purposes to allow a predetermined delay before a new operation index value is started.

Figure 12A:
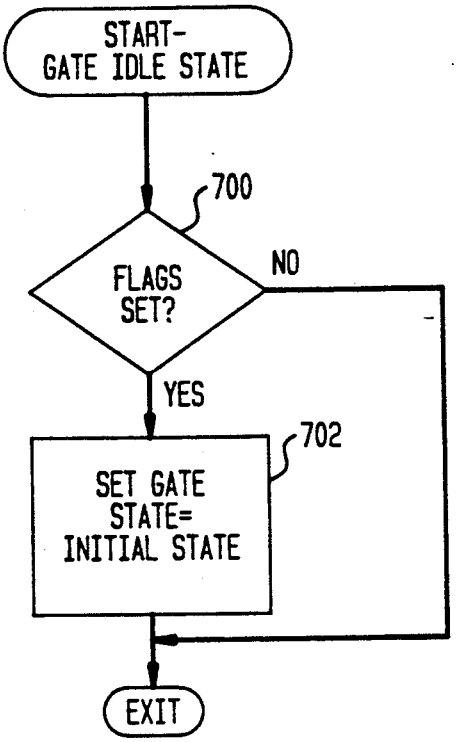
FIGS. 12A-12E show flow charts of State Routines for gates shown in FIG. 6.

FIG. 12A shows a flow chart for the gate Idle State. At 700 the routine checks to determine if all flags are set for the gate corresponding to the current device. If the flags are set than a t 702 the gate state is set equal to the Initial State, and in either case the routine than exits.

Figure 12B:
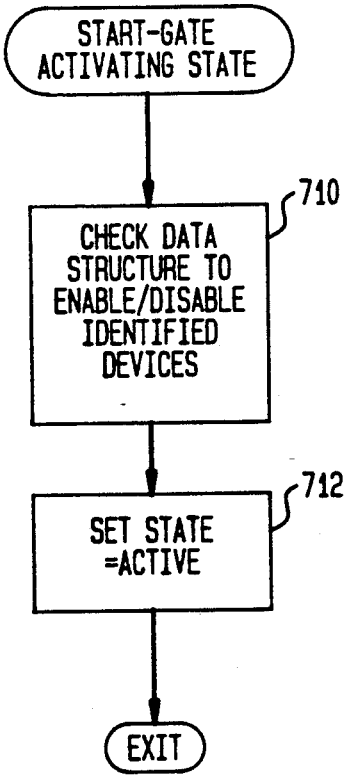

FIG. 12B shows a flow chart of the gate Activating State. At 710 the routine checks the data structure to enable or disable devices and routines identified in he corresponding data element, and at 712 the state is set equal Active.

Figure 12C:
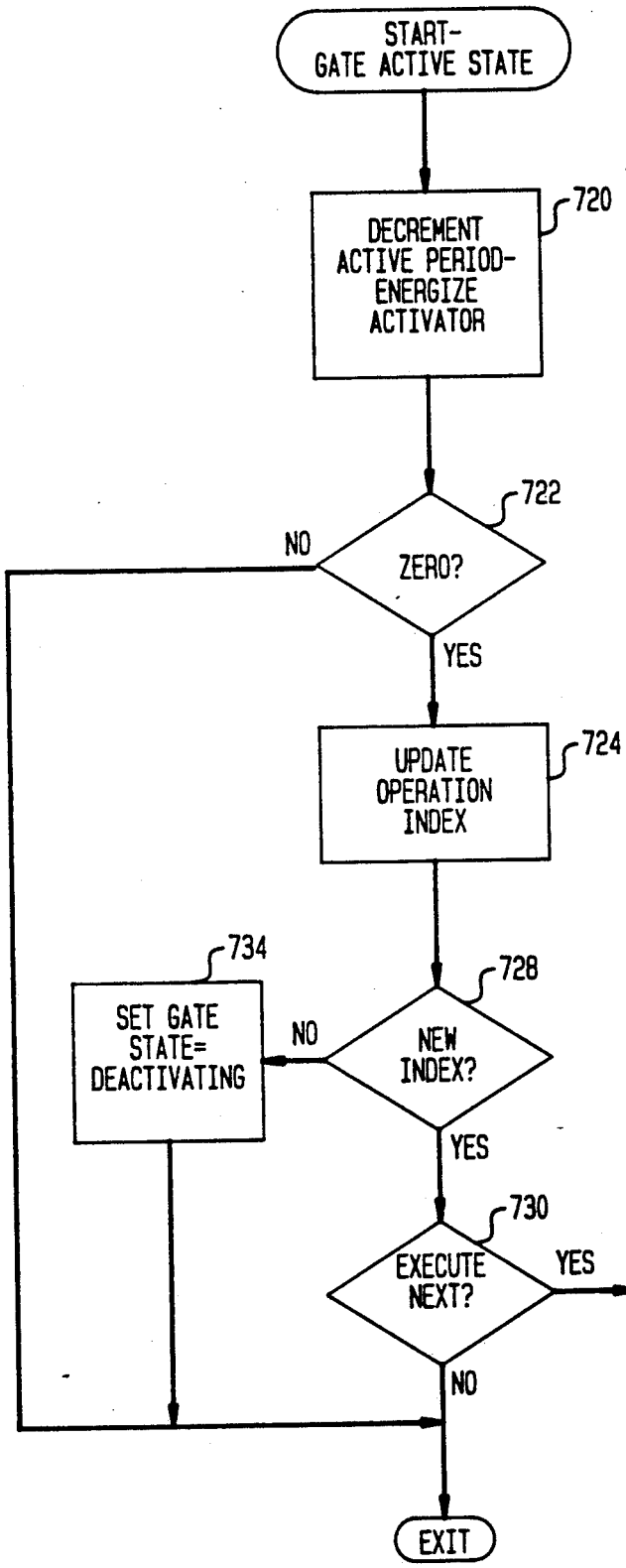

FIG. 12C shows the gate Active State. At 710 the gate active period is decremented and the activator for the corresponding gate is maintained in an energized state. At 722 the routine determines if the active period is finished. If it is, then at 724 the routine updates the operation index value, then at 728 determines if a new index value has been set. Then, at 730, the routine determines if EXECUTE NEXT is set. If it is not the routine exits. If EXECUTE NEXT is set at 732 the routine directly calls the Initial State for the new operation index value. If at 728 the index value remains unchanged than at 734 the gate state is set equal to Deactivating and the routine exits. If at 722 the period is not finished the routine exits.

Figure 12D:
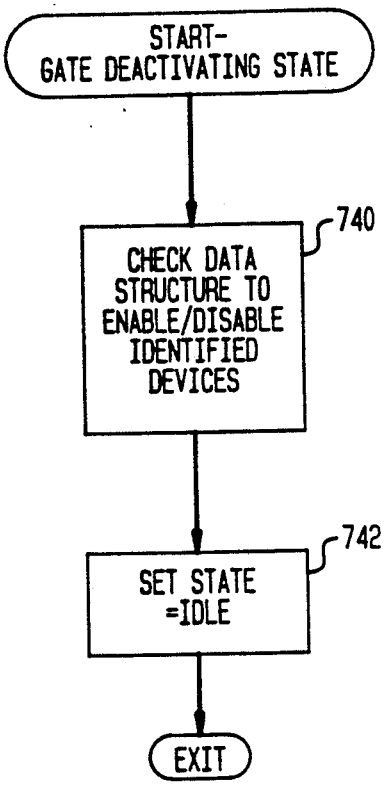

FIG. 12D shows a flow chart for the gate Deactivating State. At 740 the routine checks the data structure to enable or disable identified devices or routines in accordance with the corresponding data element, and at 742 the state is set equal to Idle and the flags are reset and the routine exits.

Figure 12E:
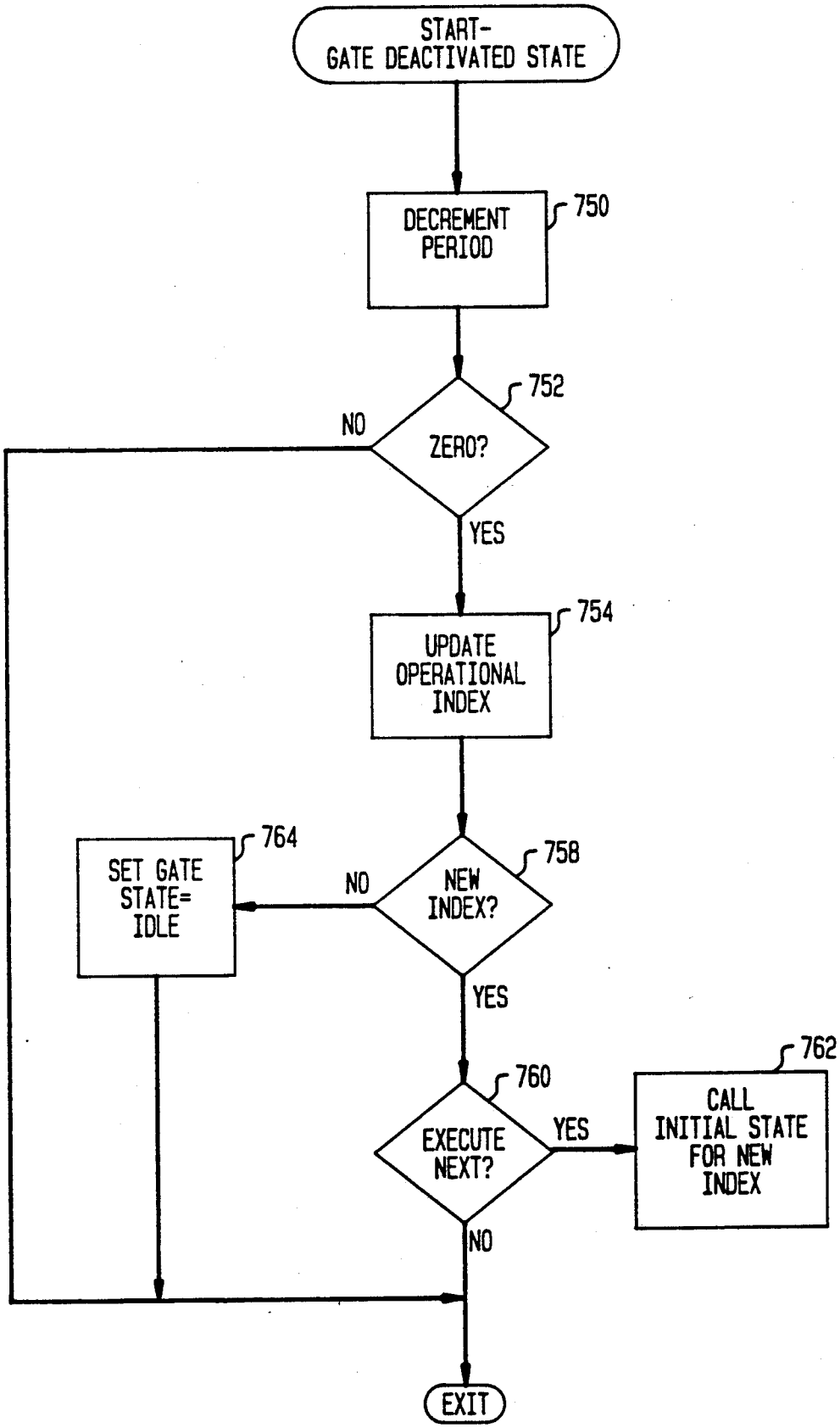

FIG. 12E shows a gate Deactivated State. This state is provided to allow the system to pause for predetermined period before initiating a new OP STATE for the corresponding gate and its sequence is identical to the gate Active State shown in FIG. 12C, except that the actuator for the corresponding gate is not energized.

It should be noted that the above states include various preset periods to determine the timing of the operation of the corresponding devices. The approximate values for the values of these periods may be readily determined from a knowledge of an operating speeds of the system and the geometry of the various sheets to be processed. These approximate values may than be readily optimized for peak performance by a person of ordinary skill in the art through a simple process of trial and error.

In addition to activation of other state routines state routines may directly call Check Excess Pages, Piece Pre-Acknowledge, or Piece Completed Routines; which are simple routines for communicating status to data processor 1 and for testing the configuration against the allowed limits. These routines need only be described briefly for an understanding of the subject invention. Check Excess Pages tests the data structure to determine if the specified number of pages, both printed and pre-printed, is greater than the maximum allowed, three pages. If it is the routine activates gate G1 to divert the printed pages and or any printed form 10, deactivates folder sealer 6 and sends acknowledge to data processor 1. Piece Pre-Acknowledge sends acknowledge to data processor 1 when a sheet is detected by a selected sensor Pieces Completed Acknowledge sends an Acknowledge signal to data processor 1 when the mail piece is completed.

The piece completed routine sends the Piece Identification to data processor 1.

Table 1 shows the information included in each data element in the data structure. Each data element identifies the device with which it is associated and a default Initial State in which that device will begin operation, unless otherwise specified by the activating device. The table also specifies the initial Operation Index Value for those device which perform more than one operation. As discussed above, each device is capable of activating other devices and each data element specifies the other devices activated by the associated device, if any, in terms of activating conditions (i.e. State Routine during which the other device is to be activated), and an optional Initial State different than the default state for the controlled device. The data element also specifies the next value of the Operation Index Value and the conditions under which the device will proceed to the next Index Value.

As discussed above, for sensors, the conditions under which the next operation is begun are page counts, which may be variable within a given mail run. For each piece, data processor 1 transmits the piece information; which for printed pages may be variable. In this case controller 6-1 will vary the page count for sensors 3 and 4 as the printed page count is varied form mail piece to mail piece in a given job run.

Also associated with the next Operation Index Value is EXECUTE NEXT flag byte which, when set, indicates that the next operation will begin immediately. When not set the device returns to the Idle State and waits for activation by another device before commencing the next operation.

Certain fixed, or system, parameters are also associated with each data element to specify operation characteristics such as delays. As discussed above, these system parameters may be easily estimated from the operating characteristics of a given system and then adjusted for optimal performance by a simply process of trail and error. Once determined these parameters remain fixed unless the operating characteristics of the system are changed. The fixed parameters are set whenever the system is initialized and may either be set in data processor 1 and transferred with each data element, or set in system controller 6-1 and identified by appropriate pointers in the data elements.

Table 2 shows the configuration information entered by the system user to specify the mail piece configuration for a given mail run. This information includes the tray which will act as the source, the sheet type for each tray, and the number of sheets to be included in each mail piece from each tray. As discussed above, for printed sheets this number may be variable and data processor 1 will determine the number of printed sheets for a mail piece and include that information with the piece information.

The configuration information also includes information for determining the address for each mail piece. Preferably, this is done by having the system user identify a field within the document format used in the JOB. The Control Application Program will then cause the information in this field to be printed on envelope form (if printed envelopes are specified) and appropriate pages in the mail piece. The ability to extract address information form designated fields is well known in the art, and for example is found in many commercial word processing programs, and need not be discussed further here for an understanding of the subject invention.

TABLE 1

| DATA ELEMENTS |
|---|
| 1. Device (type, ID) |
| 2. Default Initial state (state routine name) |
| 3. Operation Index Value (Op State No.) |
| 4. Other devices controlled (activating condition, controlled device, optional initial state) |
| 5. Next Operation Index Value (Op State No., activating condition, execute next flag) |

TABLE 1-continued

| DATA ELEMENTS |
|---|
| 6. System Parameters (delays, motor velocity profiles, etc.) |

TABLE 2

| CONFIGURATION INFORMATION |
|---|
| 1 Source (tray No.) |
| 2. Sheet type (window envelope, printed envelope, 3/3's, 2/3's printed sheet, 3/3's, 2/3's, 1/3's pre-printed sheet, or BRE) |
| 3. Number of sheets (No., variable) |
| 4. Addresses Information (text block) |

The following material describes components and subassemblies of folder sealer 6 in detail.

ACCUMULATOR FOLDER

Figure 13A:
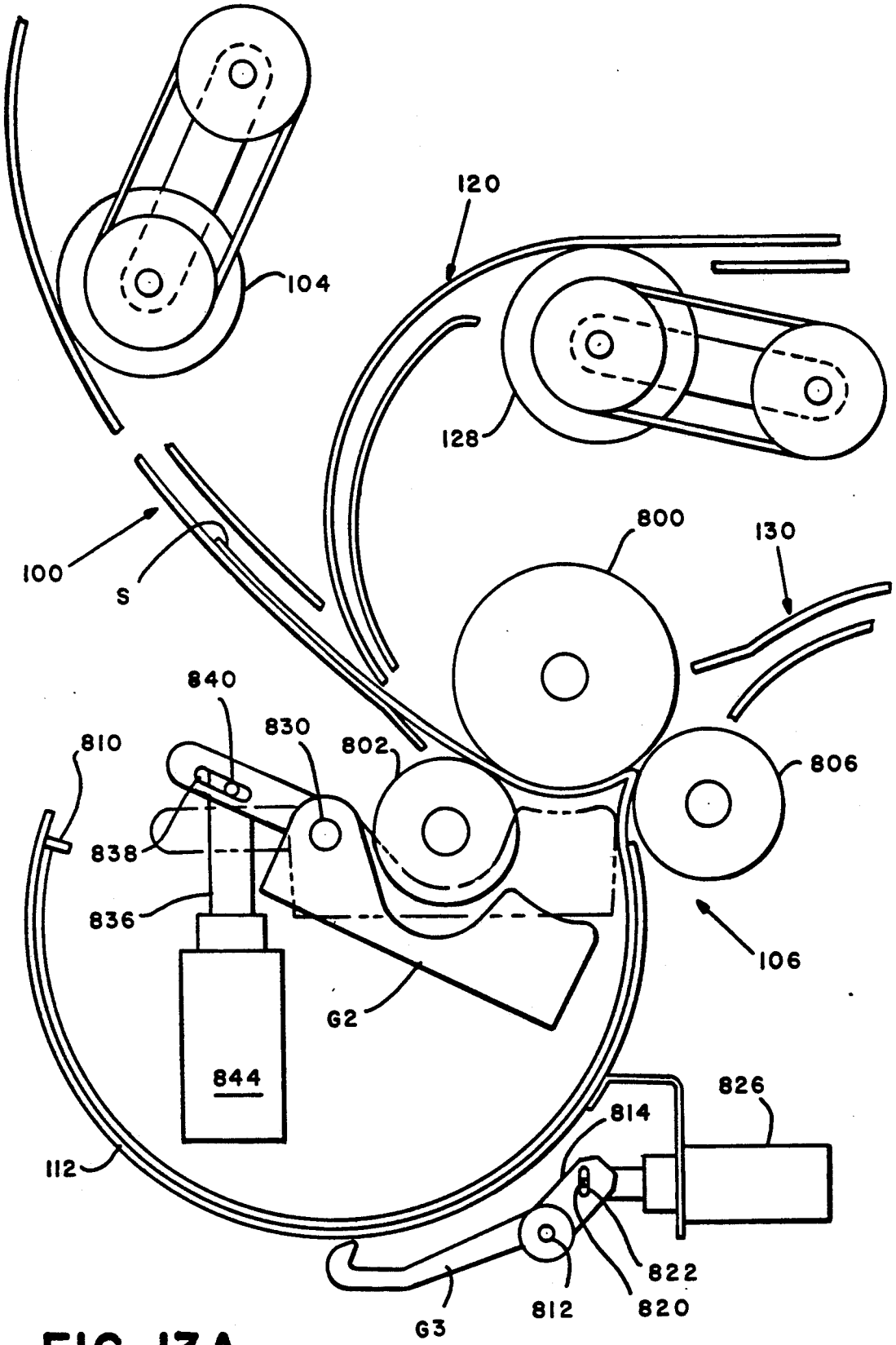
FIGS. 13A and 13B show a side view, partially broken away, view of a mechanism for accumulating and folding sheets.
Figure 13B:
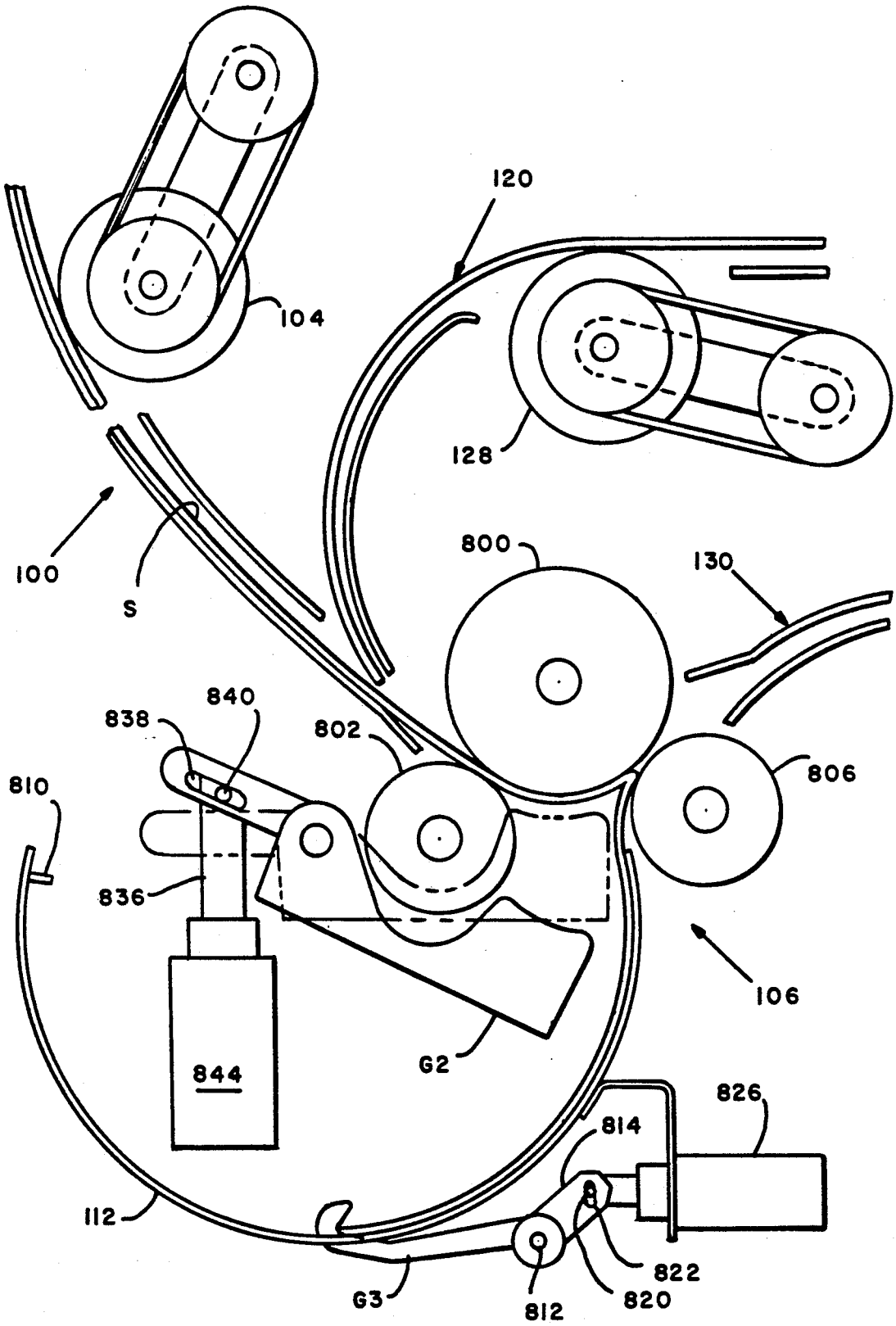

Turning now to FIGS. 13A and 13B a preferred mechanism for accumulating and folding sheets used in a preferred embodiment of the subject invention is shown. Accumulator folder assembly 106 includes a driven roller 800, which is driven by motor M1 (shown in FIG. 6), which is a stepper motor driven in accordance with a predetermined velocity profile, as will be described further below. Roller 800 and idler roller 802 form an intake roller pair. Sheets from printer 5 are successively urged along guides 100 by urge roller 104 into the nip of roller 800 and 802 to form an accumulation. Alternatively, preprinted sheets may be urged along guide 120 by urge roller 128 into the nip. During the period that the accumulation is formed rollers 800 and 802 are not operated to capture and intake these sheets, and are may be operated in a reverse direction so that sheets will not bind in the nip but will be urged against it by rollers 104 and 128 so that the leading edges of the sheet align parallel to the axes of rollers 800 and 802. Guides 100 and 120 are curved to increase the columnar strength of the sheets as they are urged into the nip of rollers 800 and 802.

Once any holding time has elapsed assembly 106 is activated and the accumulation is fed into a buckle chute 112. In FIG. 13A the accumulation, shown for convenience as a single sheet S is driven along chute 112 until it reaches stop 810. In an embodiment of the subject invention chute 112 is a curved, one-sided buckle chute as described in U.S. Pat. No. 4,834,699. Once sheet S reaches stop 810 it buckles and it is capture by a pair of fold rollers consisting of driven roller 800 and idler roller 806. Rollers 800 and 806 then folds sheet S in a conventional manner and urge it along guides 130 for further processing.

Figure 14A:
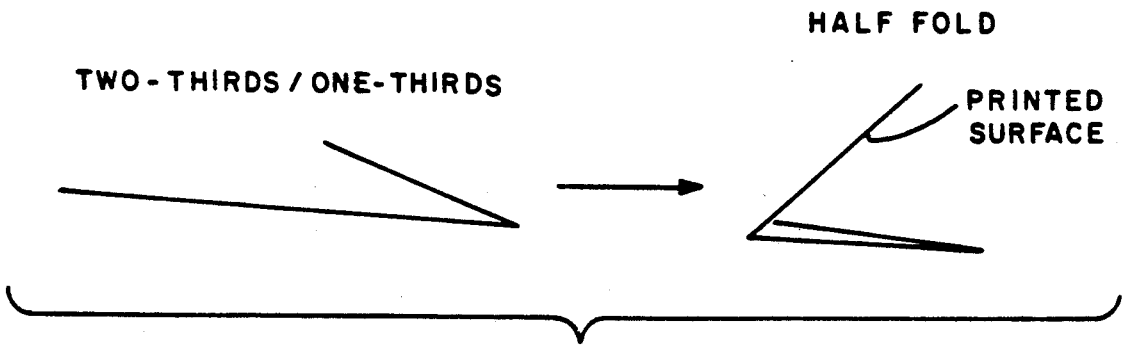
FIGS. 14A and 14B show a three thirds sheet in "C" and "Z" folds respectively.

In FIG. 13A stop 810 is positioned so that sheet S is folded two-thirds/one-thirds as shown in FIG. 14A. As further shown in FIG. 14A a further half fold from two-thirds to one-thirds produces a "C" fold, which is conventional for business letters.

Figure 14B:
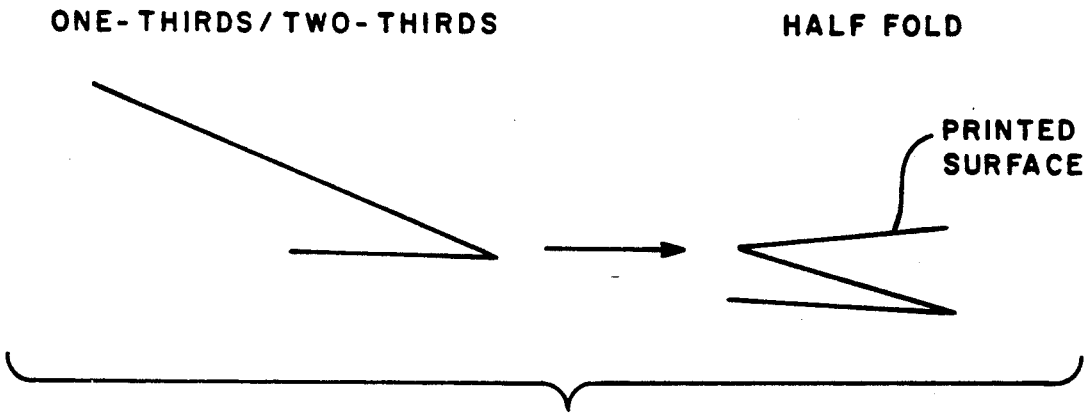

The mechanism of FIGS. 13A and 13B also includes gate G3 for selectively altering the fold geometry. Gate G3 is mounted on pivot 812 so that it may be rotated by arm 814 which is connected to actuator 818 by pin 820 and mounting slot 822. As shown in FIG. 13B when solenoid 826 is energized actuator 818 retracts and gate G3 pivots into the path of the sheet S through a slot 828 provided in buckle chute 112. Sheet S is thus stopped before it reaches stop 810 and is folded, as shown in FIG. 14B, one-thirds/two-thirds. Thus, a half fold from two-thirds to one-thirds produces a "Z" fold which is useful with windowed envelopes since the printed surface of sheet S, which is the side distal to buckle chute 112 is exposed in a "Z" fold and an address for a delivery of the mail piece may be printed where it will be visible through window 18 of window envelope form 10. (Those skilled in the art will recognize that text on sheets folded in "C" or "Z" folds must be printed in formats which are respectively inverted if both are to appear conventional to the recipient.)

The accumulator folder mechanism of FIGS. 13A and 13B also includes gate G2 which, when activated, deflects sheets from buckle chute 112 so that they are passed on, unfolded, to guides 130. Gate G2 is activated so that envelope form 10 is processed through assembly 106 without folding. Gate G2 is mounted on pivot 830 and connected by arm 832 to actuator 836 by slot 838 and pin 840. When solenoid 844 is energized actuator 836 retracts and Gate G2 pivots to a closed, deflecting position (shown in phantom).

Figure 15:
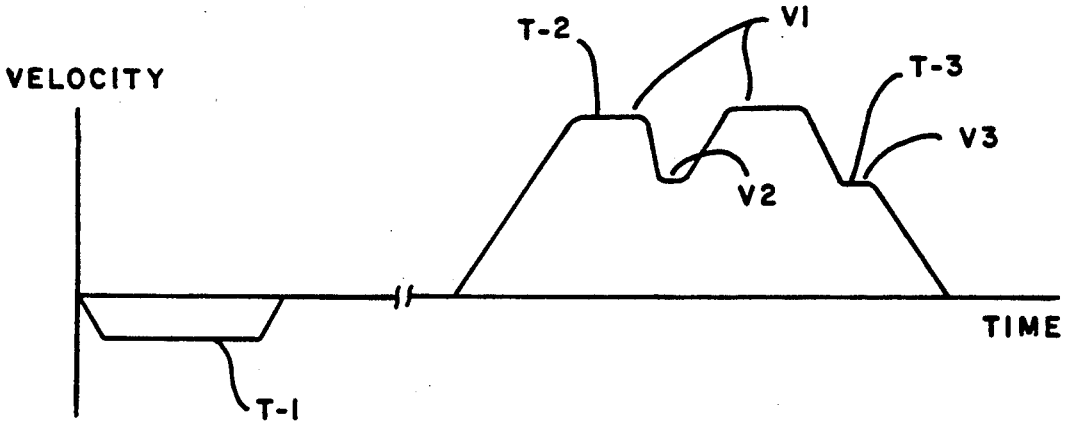
FIG. 15 shows a velocity profile for accumulator folder assemblies.

FIG. 15 shows the velocity profile for accumulator folder assembly 106. During time T-1 assembly 106 may rotate in a reverse direction to prevent sheets from binding in the nip of rollers 800 and 802 as they are accumulated.

Once any holding time has elapsed, during time T-2 assembly 106 is ramped up to a predetermined operating velocity V1 which is preferably approximately 8 inches per second, until, as shown in FIG. 13A the leading edge of sheet S reaches stop 810 and buckles to be captured by fold roller pair 800 and 806. Since the accumulation may include more than the single sheet S motor M1 is slowed to velocity V2 increase its torque to assure folding of the, possibly multiple, sheets without stalling. Assembly 106 then returns to its operating velocity and is then ramped down to a halt to await the next sheets.

Assembly 106 is slowed to velocity V3 during the time T-3 in which the sheets are handed-off for further processing, which helps to assure a smooth hand-off.

Assembly 140 operates in an similar manner, but is configured for a half fold. Because of its vertical orientation and the possible thickness of the final accumulation buckle chute 160 is not completely open; idler roller 161 and a spring support have been found to be useful to assure that the accumulation conforms to the curve of chute 160.

Appropriate velocities V2 and V3 may be easily determined for various types of sheets by simple experimentation while the times are determined in a straight forward manner from the sheet and system dimensions and the velocities.

FLAP OPENING MECHANISM

Figure 16A:
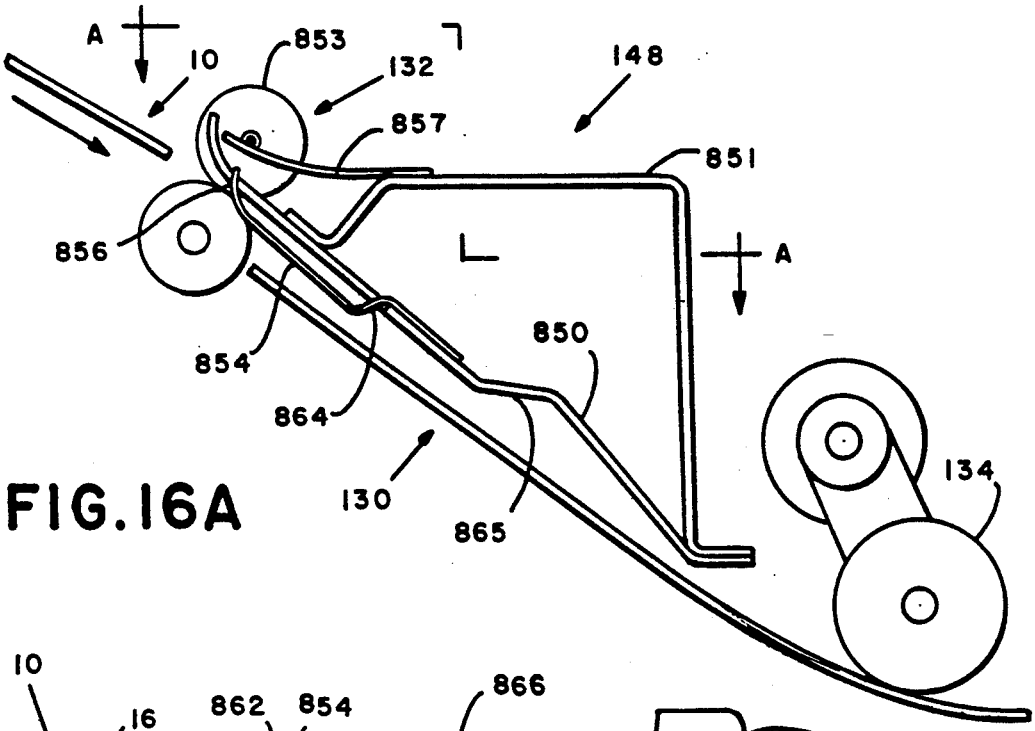
FIG. 16 shows a side view of a flap opening mechanism used in an embodiment of the subject invention.
Figure 17:
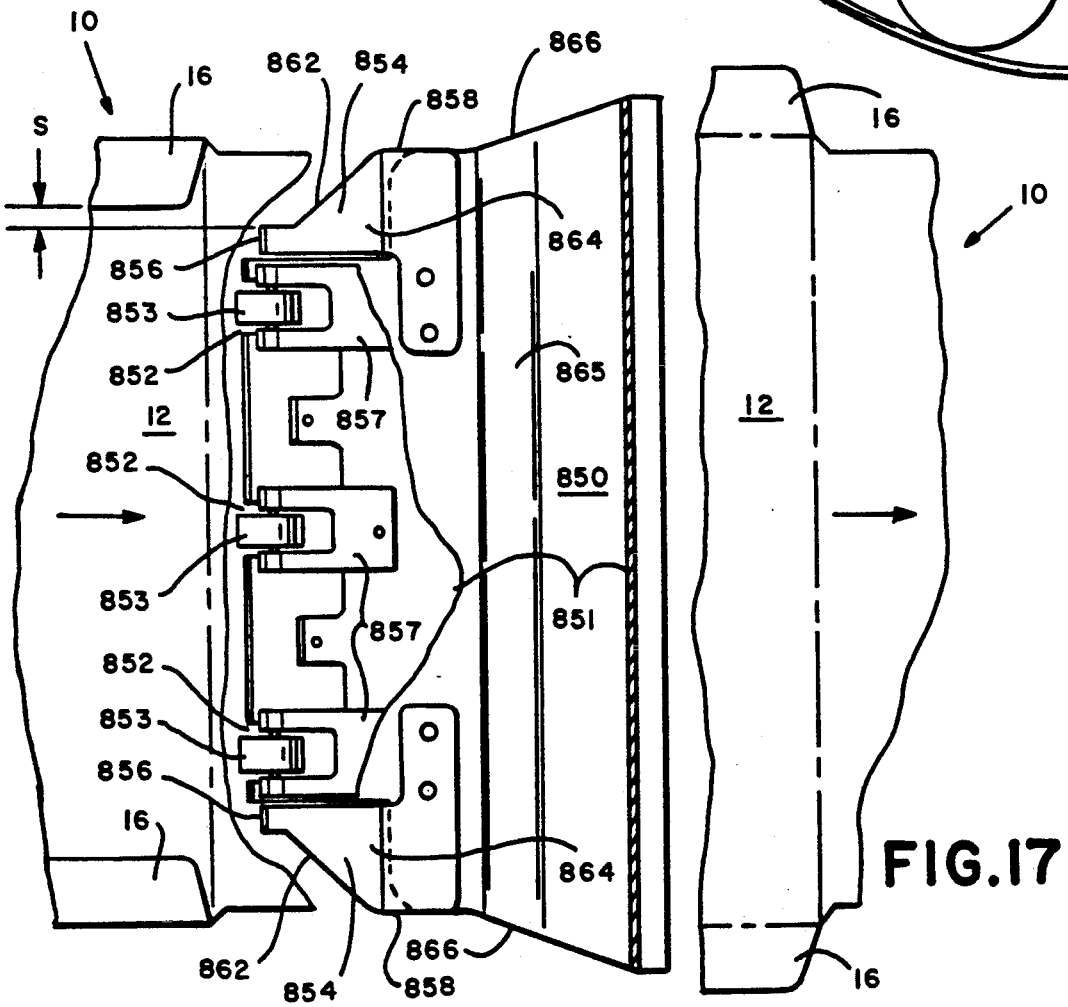
FIG. 17 shows a view along lines A—A of FIG. 16.

Because printer 5 will normally be a commercially available laser printing engine the paper path through printer 5 is normally designed for standard paper widths, typically 8½". Thus, where envelope form 10 is to be printed, form 10 must pass through printer 5 with side flap 16 folded inwards, so that the width of form 10 does not exceed the capacity of laser printer 5. Accordingly, a flap opening mechanism 148 is provided, positioned between roller pair 132 and urge roller 134 to open side flaps 16 before envelope form 10 is accumulated with the printed or pre-printed sheets or BRE. Opening mechanism 148 is shown in FIGS. 16 and 17 and includes a plate 850 fixed through bracket 851 to the frame of folder sealer 6 above guides 130 and provided with slots 852 through which segments of the segmented upper roller of roller pair 132 bear against the lower roller. A pair of thin, flexible separator elements 854 are fixed to plate 850 so that elements 854 extend outwards from plate 850 symmetrically and forward so that tips 856 are proximate to and slightly below the nip of roller pair 132. Separator elements 854 are essentially parallel to and co-planar with envelope form 10 as it passes through roller pair 132. Segments 853 are mounted on spring elements 857 to bear downwards against panel 12 to assist in separating flaps 16 from panel 12. Preferably tips 856 are curved upward so that they do not dig into sheets as they pass through roll ®r pair 132. Elements 854 include an outer edge 858 which is positioned parallel to and slightly inbound of fold line 24 of form 10 as it is urged along guide 130. Knife edges 862 angle inwards to connect edges 858 and tips 856. Separator elements 854 are mounted so that tips 856 lie inboard of side flaps 16 by a nominal spacing S.

As envelope form 10 is urged along guide 130 panel 20 is engaged by roller pair 32 and passes below separators 854 without binding since, as noted, tips 856 are curved upwards. As form 10 progresses flaps 16 are separated from panel 12 by knife edges 862, and as form 10 progresses further flaps 16 are fully engaged by separators 854 with fold lines 26 adjacent and outwards of edges 858, which are preferably rounded to avoid the possibility of cutting form 10. As form 10 progresses further flaps 16 are first lifted by steps 864, which lift side flaps 16 away from panel 12 so that outwards angled edges 866 of plate 850 bear against the inner surfaces of flaps 16 above fold lines 24. As form 10 progresses further edges 866 apply outward leverage against flaps 16 forcing flaps 16 out and down into parallel alignment with panel 12 before form 10 is engaged by urge roller 134. Preferably downstream step 865 is provided to again lift flaps 16 and assure that flaps 16 open smoothly and without tearing by assuring that leverage is applied well above fold lines 24.

Guides 130 are shaped so that panel 12 and flaps 16 lie flat as flaps 16 are opened; to avoid crimping or buckling and possible tearing of flaps 16 as they are opened.

In a preferred embodiment plate 850 angles downwards towards guides 130 to a minimum clearance of approximately 0.25 inches and edges 866 angle outwards so that at its widest plate 850 extends slightly outwards of flaps 16 in their unfolded position. This, together with the curvature of guides 130 as form 10 emerges from beneath plate 850, which further rotates partially open flaps 16, assures that flaps 16 are fully open and parallel to form 10.

ALIGNMENT GUIDE

Figure 18:
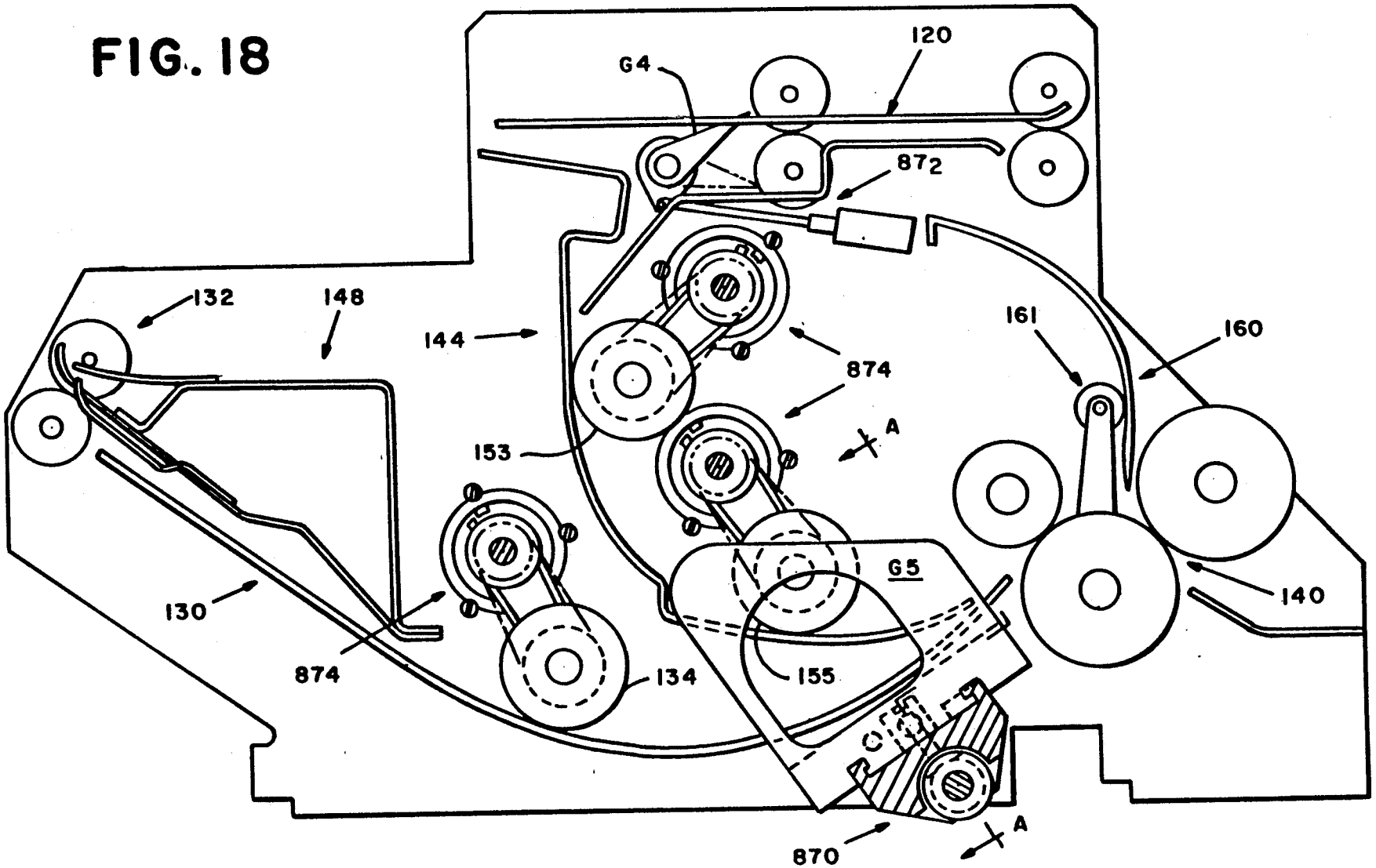
FIG. 18 shows a side view of a mechanism for forming an accumulation of sheets with an envelope form.

FIG. 18 shows a side view of the mechanism for forming the final accumulation of printed and/or preprinted sheets with envelope form 10 to assemble all elements of the mail piece. Form 10 is captured by roller pair 132 and, if necessary, flaps 16 are unfolded by mechanism 148 and form 10 is urged into the nip of accumulator folder assembly 140 by urge roller 134. Form 10 may than be followed by an accumulation of sheets, which if the accumulation includes three-thirds length sheets has been folded to two-thirds length by accumulator folder 106, which accumulation is also urged into the nip of accumulator folder assembly 140 to form the final accumulation.

Accumulator folder assembly 140 operates in a substantially identical matter to accumulator folder assembly 106 to accumulate form 10 with the following accumulated and or pre-printed sheets. Once the final accumulation is formed motor M2 (shown in FIG. 6) is energized to urge the accumulation into buckle chute 160 which is designed to fold the accumulation in half; that is from two-thirds to one-thirds length, and the final accumulation exits for folding and sealing of flaps 16 and 14.

Because buckle chute 160 is oriented substantially vertically idler assembly 161 and support springs (not shown) are provided to hold the final accumulation within chute 160 during folding.

To assure that form 10 and the accumulated sheets are laterally aligned lateral guides G5 are provided. These guides are symmetrically positioned outboard of guides 130 and 144, and, as the final accumulation is formed, are cycled inwards, in a symmetrical manner, until they are separated by the predetermined width of the sheets used; typically 8½". This aligns the sheets and form 10 and guides G5 are returned to their initial position where they will not interfere with further processing. The curvature of guides 130 facilities the alignment process by stiffening the sheets against the pressure exerted by lateral guides G5 so that the sheets slide laterally into alignment without buckling.

Preprinted sheets may be diverted from guides 120 by gate G4 when it is activated by solenoid assembly 872. These pre-printed sheets, which may be one-thirds or two-thirds in length are urged along guides 144 by urge rollers 146 and 148 into the nip of accumulator folder assembly 140 to form part of the final accumulation. These pre-print sheets are also laterally aligned by lateral guides G5 when it is operated.

For lateral guides G5 to be effective urge rollers 134, 153, and 155, which may be in contact with form 10 and/or various sheets, must be disengaged when guides G5 are activated. To achieve this rollers 134, 153, and 155, are mounted on identical pivoting cantilever assemblies 874, which assemblies both allow the rollers to be pivoted away when guides G5 are activated and allow the normal pressure with which the rollers bear to be adjusted, as will be described further below.

Preferably lateral guides G5 are cycled once each time a sheet (or accumulation of sheets) are urged into the nip of assembly 140. This assures that, when urge rollers 134, 153 and 155 are reengaged, each sheet will again be urged into the nip. Of course if sheets are accumulated on both guides 130 and 144 such sheets may be simultaneously aligned by one cycle of gates G5.

Figure 19:
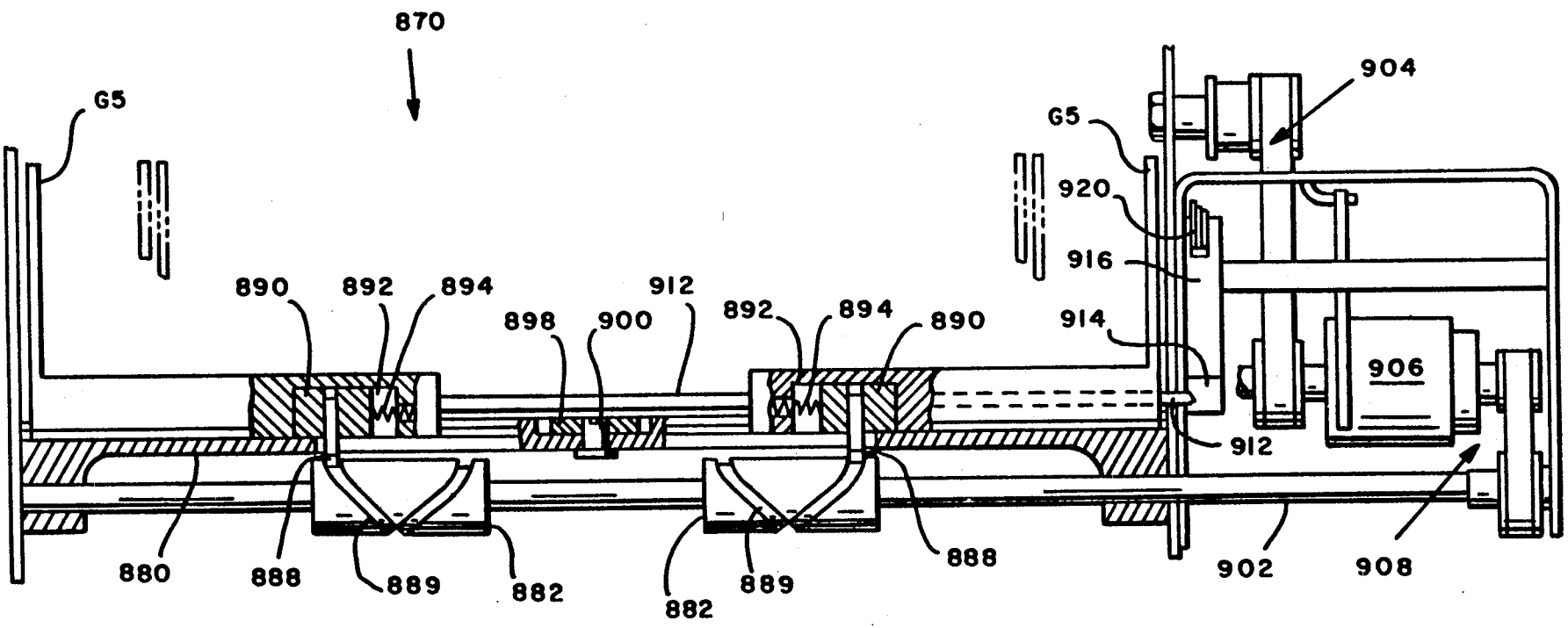
FIG. 19 shows a cross section view along lines A—A in FIG. 18 and partially broken away of a mechanism for operating lateral guides used in an embodiment of the subject invention.

FIG. 19 shows a cross section view of mechanism 870, which operates lateral guides G5. Guides G5 are supported and laterally guided by support structure 880, which is preferably formed of a low friction material such as nylon or teflon. Guides G5 are cycled inwards, in a symmetrical manner by helical cams 882. Cam followers 888 are mounted in blocks 890, which in turn are biased within cavities 892 by springs 894. As cams 882 makes two complete rotations cam followers 888 will follow double helix groves 889 in cams 882 causing guides G5 to cycle inwards to pre-determined positions (shown in phantom FIG. 19) and return to their starting position.

As shown (in phantom) in FIG. 19 mechanism 870 is adjustable for two standard paper sizes, typically 8½" and A4 size metric size paper. This is achieved by rotating rectangular central stop 898 to provide either a shorter path of travel for guides G5 (for wider 8½" paper), or by rotating rectangular stop 898 around pivot mount 900 providing a longer path of travel for guides G5 (for narrower A4 paper) When stop 898 is adjusted for 8½" sheets guides G5 are stopped by stop 898 before cam 882 has completed a full rotation. As cam 882 completes the rotation spring 894 is compressed within cavity 892 allowing block 890 to move within guide G5 and follower 888 to continue to follow grove 889. When stop 898 is adjusted for A4 size paper blocks 890 remain biased against the outside walls of cavities 892 throughout the full cycle of cams 882.

Cams 882 are mounted on and driven by shaft 902 by motor M4 through belt 904, one cycle clutch 906, and 1: 2 belt and pulley assembly 908. As the sheets and envelope form 10 are formed into the final accumulation at the nip of assembly 140 motor M4 is energized and clutch 906 is activated by controller 6-1. Thus, clutch 906 outputs a single revolution which, through 1: 2 belt and pulley assembly 908; causes shaft 902 and cams 882 to complete two revolutions; cycling guides G5.

In order to disengage rollers 134, 152 and 154, rod 912 is fixed to the left, or outboard, one of guides G5 and extends inboard to bear against angled surface 914 of lever 916. As lateral guides G5 move inward rod 912 is advanced and the angle of surface 914 causes lever 916 to be displaced as shown in phantom in FIG. 20.

Figure 20:
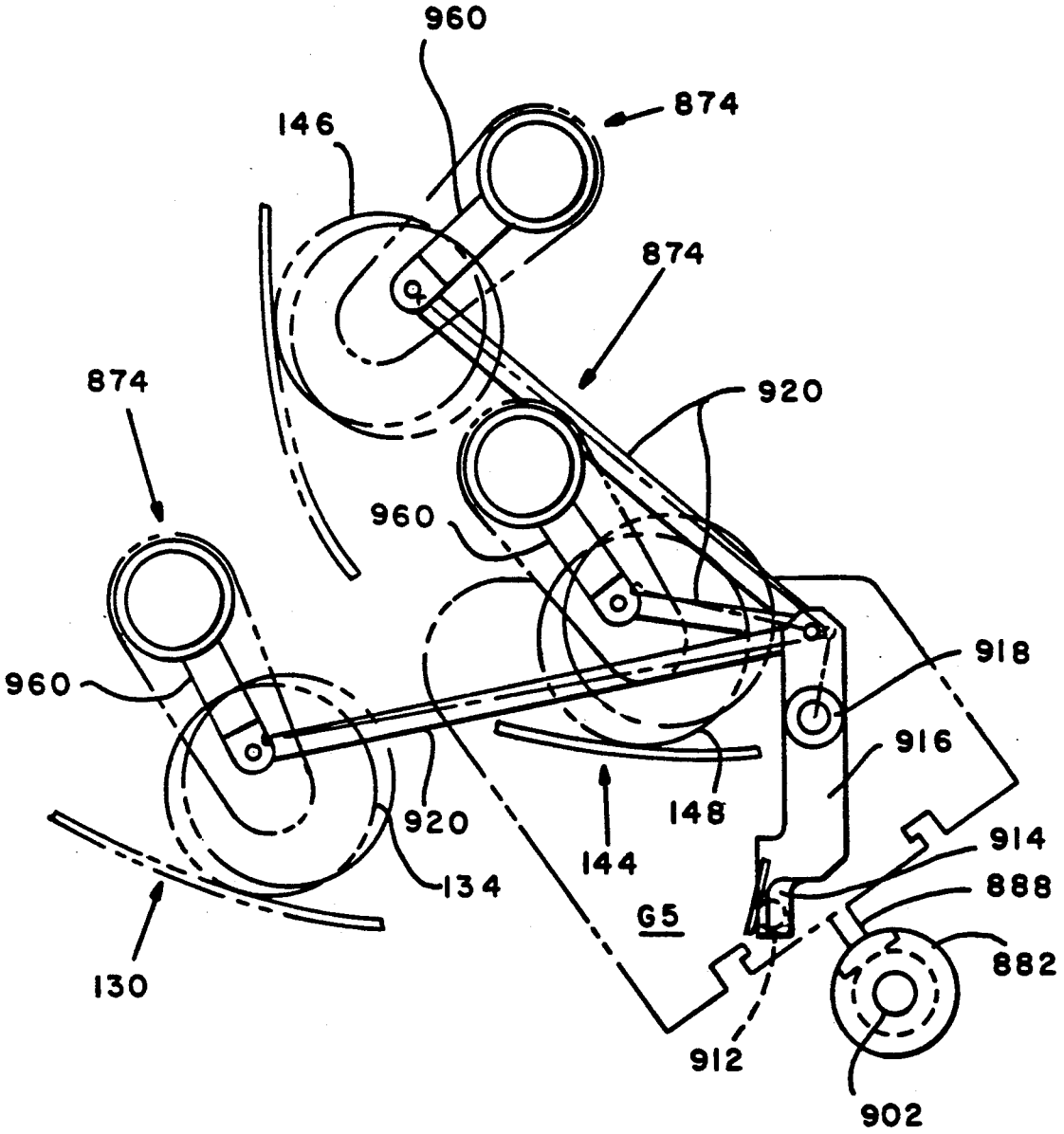
FIG. 20 shows a semi-schematic side view of a mechanism for displacing urge rollers used in the mechanism of FIG. 18.

As is seen in FIG. 20 lever 916 rotates about pivot 918 as it is displaced and is connected by links 920 to cantilever mounts 874. As will be described below, the action of lever 916 and links 920 is coupled through mounts 874 to displace urge rollers 134, 152 and 154 as shown in phantom in FIG. 20.

Cantilever Supports

Figure 21:
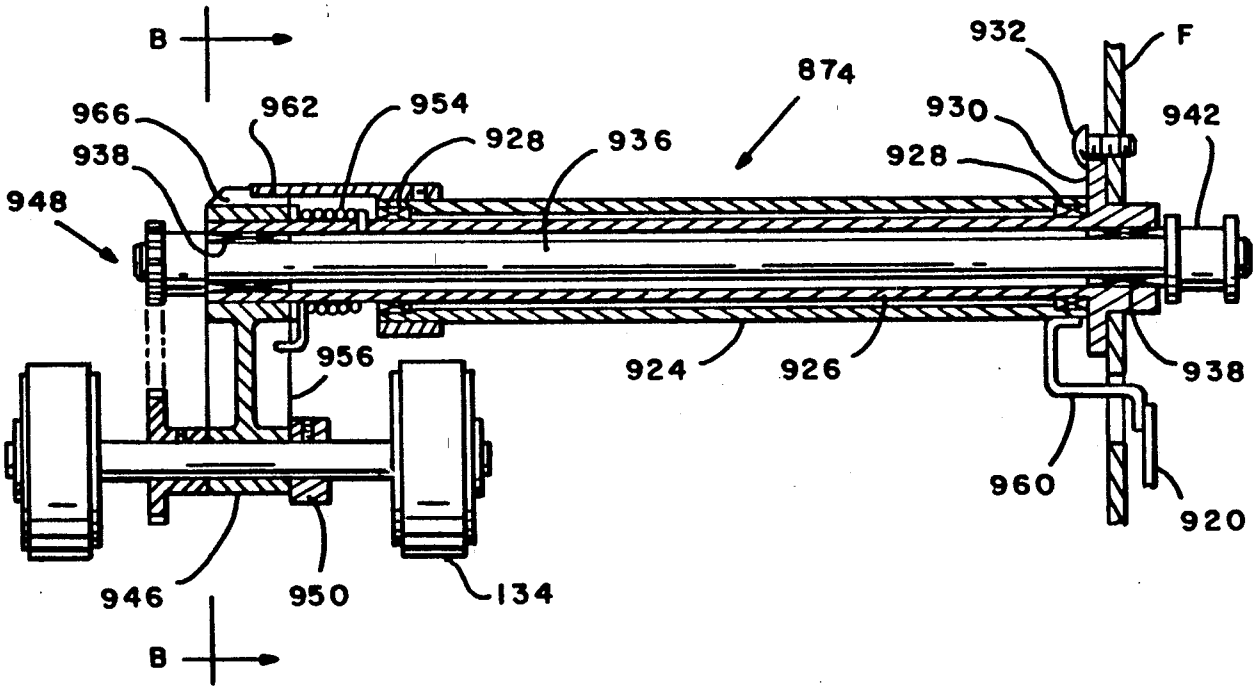
FIG. 21 shows a cross-section view of a cantilever support for urge roller, taken along lines A—A of FIG. 22.
Figure 22:
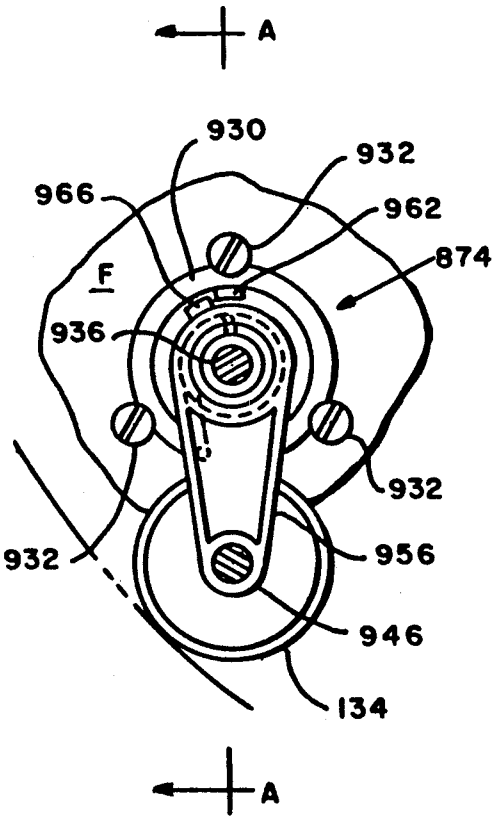
FIG. 22 is a sectional end view along lines B—B of FIG. 21.

Turning to FIGS. 21 and 22, cantilever support mechanism 874 is shown. Support mechanism 874 includes an outer tube 924 which is coaxial with and rotatable around inner tube 926 on bearings 928. Inner tube 926 includes a collar 930 which is secured against frame F of folder sealer 6 by screws 932 so as to hold inner tube 926 fixed. Shaft 936 is mounted within and is coaxial with inner tube 926 and rotates on bearings 938. Pulley 942 is fixed to the inboard end of shaft 936 which projects through and inboard of frame F. Pulley 942 is connected by a belt (not shown) to motor M4.

At the outboard end of inner tube 926, arm 946 is mounted to be free for rotation. Preferably arm 946 is formed from a low friction material such as nylon or teflon so as to allow free rotation. At the distal end arm 946 supports an urge roller (shown here as urge roller 134). Belt and pulley assembly 948 is fixed to shaft 936 and urge roller 134 to transmit the rotation of shaft 936 to roller 134. Collar 950 is also provided to secure urge roller 134 to arm 946.

Torsion spring 954 bears against surface 956 of arm 946 at one end, and at the other end is fixed to inner tube 936.

By adjusting the tension in spring 954 the force in with which roller 134 bears against envelope form 10 or printed or pre-printed sheets may be controlled. This tension may be adjusted by loosening screws 932 and rotating inner tube 936 to wind spring 954 and increase the force or to unwind spring 954 and decrease the force.

When lateral guides G5 are activated the motion of lever 916 is transmitted by link 920 to crank arm 960, as can be seen in FIG. 20. Crank arm 960 in turn causes outer tube 924 to rotate in a counter clockwise direction with respect to an observer looking inboard. Extended element 962 is fixed to the outboard end of outer tube 926 and bears against surface 966 of arm 946, coupling the rotation of outer tube 926 to urge roller 134 and causing it to rotate to a disengaged position, as shown in phantom in FIG. 20.

In accordance with the subject invention the coefficient of friction of roller 134 (and other urge rollers) and the force with which the urge rollers bear against form 10 or the printed or pre-printed sheets is chosen so that urge rollers will provide a limited amount of force to urge accumulations into the nip of accumulator folder assemblies 140 and 106 without buckling and will then slip on the paper surface. This force may be determined by selecting an appropriate surface material for rollers 104, 134, 152, and 154, and adjusting the normal force of these rollers on the guides as described above.

Note that urge rollers 104 and 128 associated with accumulator folder assemblies 106 and 140, respectively, are mounted similarly except that no provision is necessary to disengage rollers 106 or 128.

FLAP FOLDER SEALER MECHANISM

Figure 23:
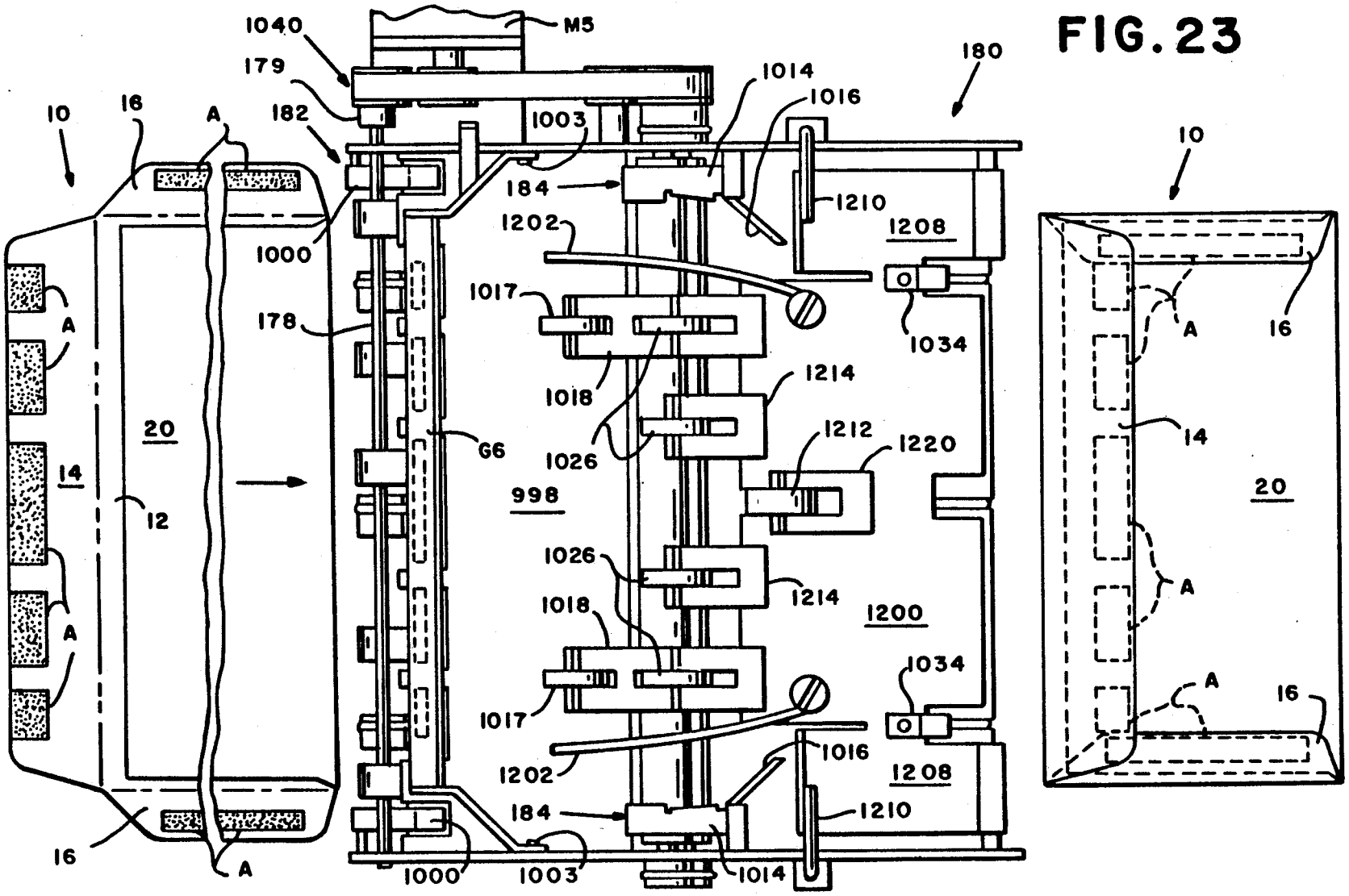
FIG. 23 is an top plan view of flap folder sealer mechanism used in an embodiment of the subject invention.
Figure 24:
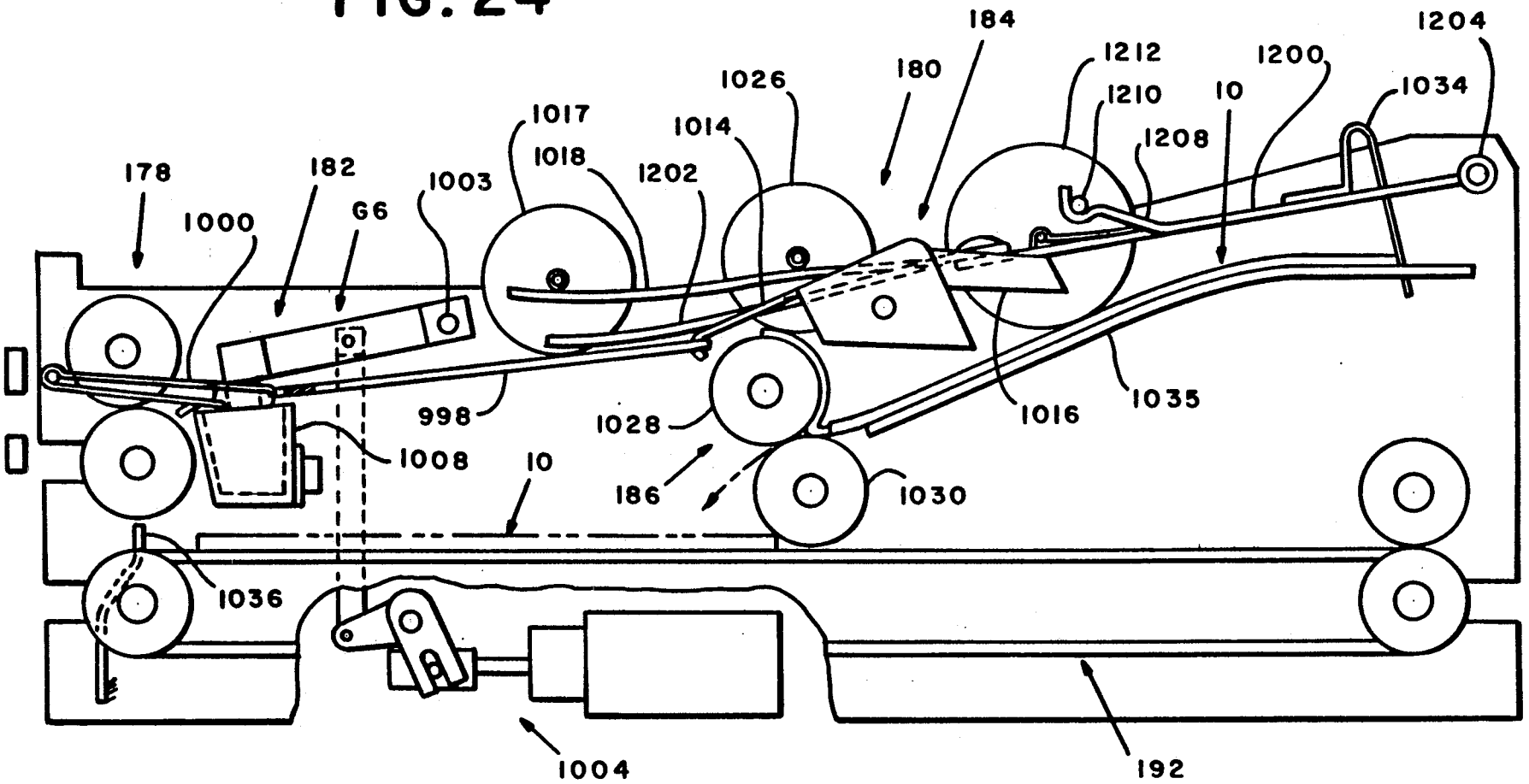
FIG. 24 is a side view of the mechanism of FIG. 23.

FIGS. 23 and 24 show flap folder sealer mechanism 180 which folds and seals side flaps 16 and trailing (or upper) flap 14 of envelope form 10, after it has been folded around accumulated printed or pre-printed sheets. After the accumulation is folded by accumulator folder assembly 140 it is captured by roller pair 178 and input to flap folder sealer 180 along guide 998. Since mechanism 180 is preferably operated at a velocity substantially slower than accumulator folder assembly 140, roller pair 178 is driven through a conventional overrunning clutch 179 so that the final accumulation of sheets and form 10 is not buckled as it is driven into the nip of roller pair 178.

As the accumulation is transported by rollers 178 flaps 14 and 16 are moistened by assembly 182. Side flaps 16 pass beneath a pair of spring biased moisteners 1000 to moisten the strips of adhesive A on flaps 16. Substantially at the same time, gate G6, which pivots about mounting 1003, is elevated by solenoid assembly 1004 so that it is not in contact with envelope form 10. Under control of controller 6-1 solenoid assembly 1004 is deactivated and gate G6 is lowered so that moisture is applied to adhesive A on trailing flap 14 only. Of course gate G6 need not be deactivated until flap 14 has passed if an unsealed mail piece is wanted.

Moistener 1000 and 1002 normally rest in trough 1008, in which a supply of water is maintained by a water supply (not shown). Preferably trough 1008 is filled with felt or a similar porous material to eliminate or reduce the problems of spillage.

After the flaps are moistened by moistener assembly 182 side flaps 16 are closed by closing mechanism 184. Mechanism 184 comprises a pair of first, upwards ramps 1014 positioned to intercept flaps 16 which deflect side flaps 16 upwards, followed by second, inwards and downwards directed ramps 1016 which fold flaps 16 closed. As flaps 16 are closed by mechanism 184 upper portion 12 is held down by spring biased rollers 1017 which are mounted on cantilevered arms 1018 to plate 1200. Spring fingers 1202, also mounted on plate 1200, may also be provided to assist in holding upper portion 12 down.

Plate 1200 pivots around mounting 1204 and is locked in place by upwards bent portions 1208 and horizontally pivoted levers 1210 so as to bias rollers 1017 downwards, as well as rollers 1026 and 1212, as will be described further below. As the accumulation is urged forwards and flaps 16 are closed it is engaged by sealing roller assembly 186.

Sealing roller assembly 186 (best seen in FIG. 24) comprises an upper roller 1026, which is a segmented roller with the segments positioned to pass between the spots of adhesive A on flap 14, and middle roller 1028 and lower roller 1030. Rollers 1028 and 1030 ar ®preferably solid rollers. Roller 1026 is preferably mounted approximately 10 degrees forward of the line connecting the centers of rollers 1028 and 1030 to further urge the accumulation in a downwards direction. Segments of roller 1026 are spring mounted on cantilever arms 1018 and 1214 and are biased downwards by plate 1200.

As the accumulation is driven forward by rollers 1026 and 1028 it reaches spring 1034 and as it is urged further forward the spring force of spring 1034, together With the downward deflection of the accumulation produced by extended roller 1212, which is spring mounted to, and biased downwards by, cantilever arm 1220, and the angle of roller 1026, combine to deflect the accumulation downwards and rearwards along guide 1055 to be captured at fold line 24 between flap 14 and panel 12 by the nip of rollers 1028 and 1030. As the accumulation is captured by rollers 1028 and 1030 trailing flap 14 is folded and sealed and the direction of the accumulation is reversed. As the accumulation, which has now been formed into a sealed mail piece, passes between rollers 1028 and 1030 the pressure of these rollers assures that adhesive A seals flaps 16 and 14 properly. Preferably, operation of assembly 180 pauses for approximately two seconds as flap 14 passes through the nip of rollers 1028 and 1030 to provide setting time for adhesive A.

The completed mail piece is now transported by rollers 1028 and 1030 onto transport assembly 192. Transport 192 again reverses the direction of the mail piece and transports it to the user for deposit with the postal service or delivery in some other matter. Spring 1036 is preferably provided to assure that the mail piece is captured in the nip formed by roller 1030 and transport 192.

Flap folder sealer mechanism 180 is driven by motor M5 through belt and pulley assembly 1040.

SHEET FEEDERS

Figure 25:
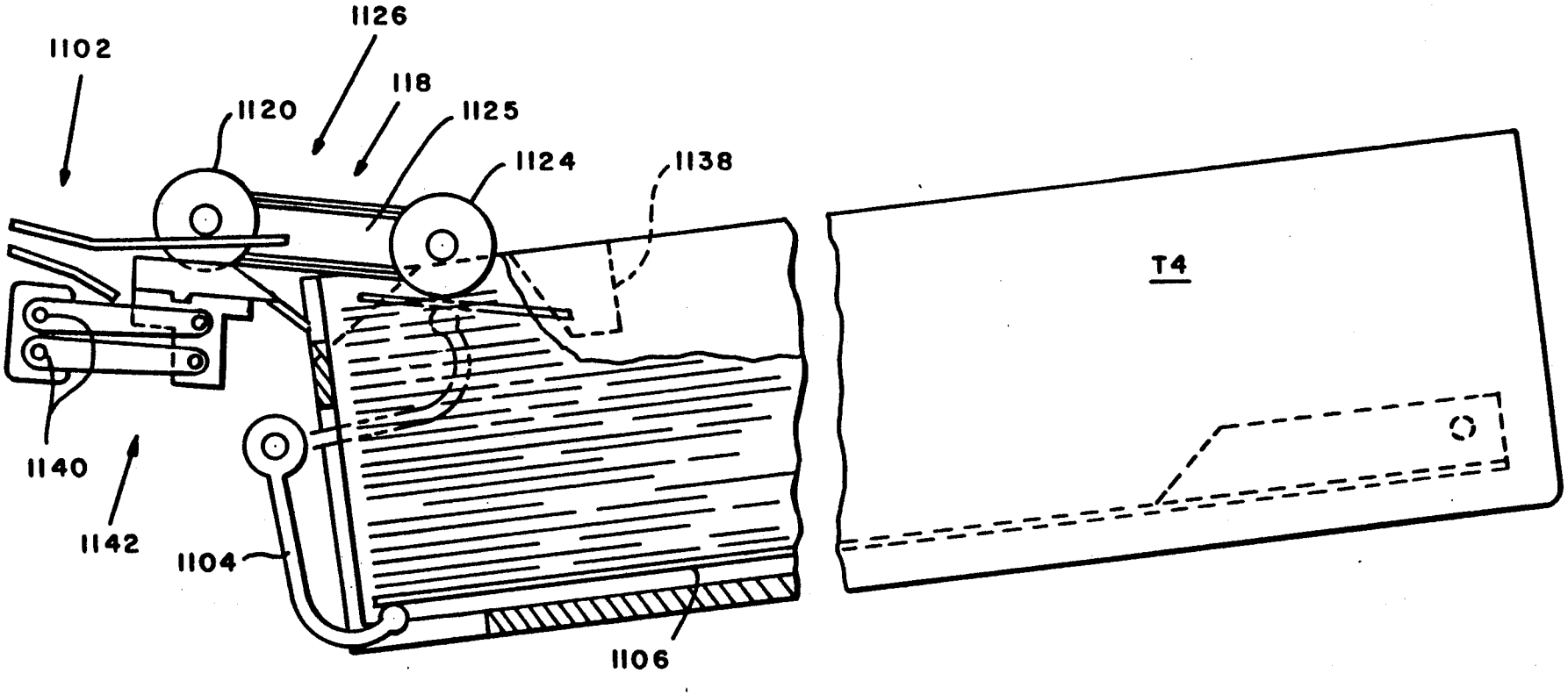
FIG. 25 is a side view, partially broken away, of a sheet feeder used in an embodiment of the subject invention.
Figure 26:
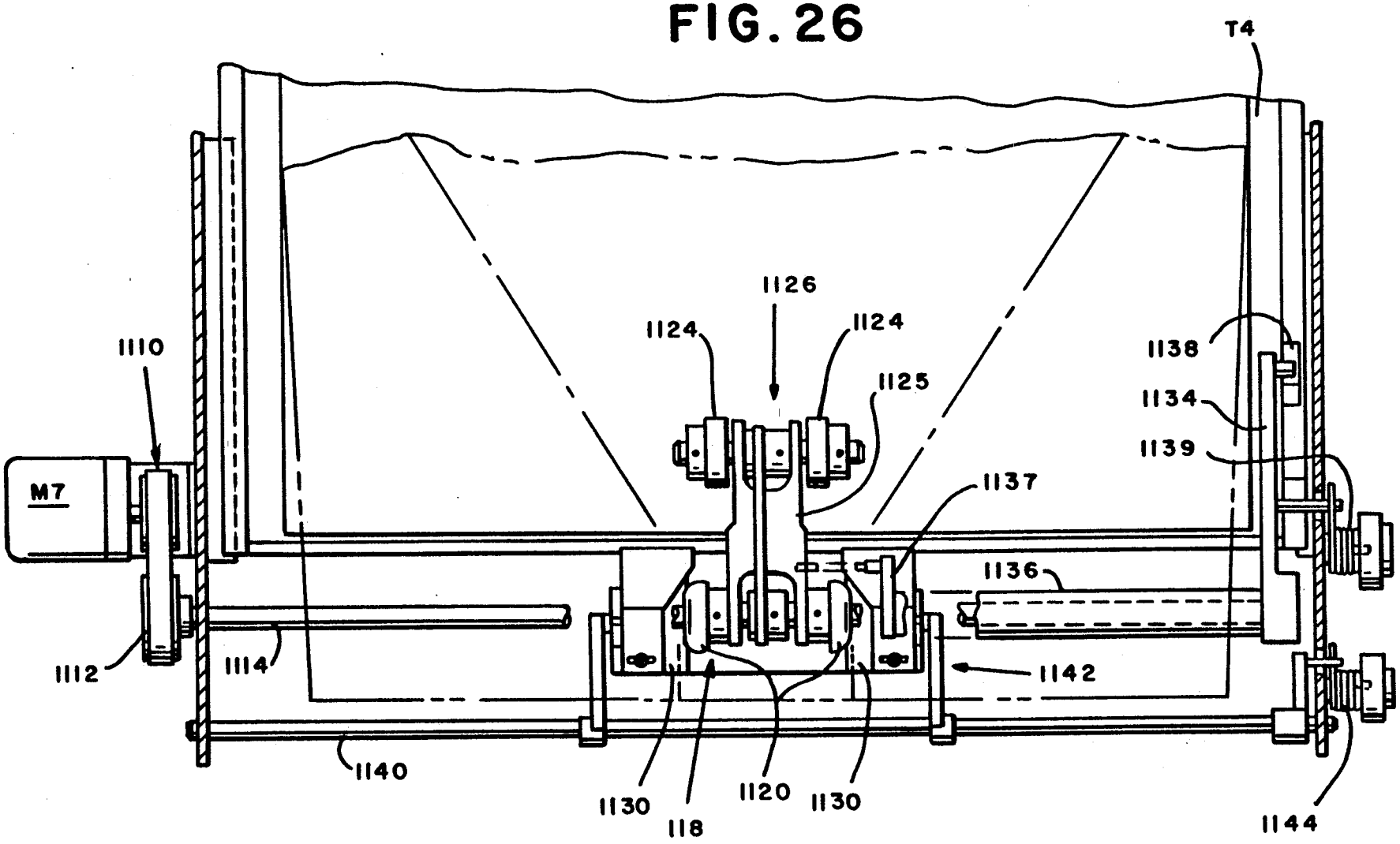
FIG. 26 is a top view, partially broken away, of the sheet feeder of FIG. 25.

FIGS. 25 and 26 show the sheet feeder used with tray T4. A substantially identical sheet feeder is used with tray T3, the only significant differences being those which result from the fact that tray T4 is made substantially deeper to allow feeding of a sufficient number of BRE's, which of course are substantially thicker than single sheets. As noted, either tray T3 or T4 may be used to provide pre-printed sheets of one-thirds, two-thirds, or three-thirds length. Conventional adjustable paper guides are provided within trays T3 and T4 for this purpose.

The sheet feeder also includes a corrugating feeder mechanism 118, which will be described more fully below, which outputs sheets to guides 1102 for further processing. To maintain contact between assembly 118 and the top sheet in tray T4 lever arm 1104 elevates pan 1106 as the number of sheets in tray T4 is reduced. Pan 1106 is hinged to tray T4 at its outboard end. Lever arm 1104 is activated by a separate motor (not shown) and controlled by a conventional sensor (not shown), such as a hall effect sensor, which senses the level of sheets in tray T4. As is known in the art, as the level of sheets in tray T4 drops below a pre-determined level lever 1104 is activated to raise pan 1106 to maintain contact between the top sheet and feeder mechanism 118 (as shown in phantom). Preferably an out of paper condition may be detected by determining when lever arm 1104 has reached the upper extent of its travel.

To facilitate feeding of the top sheet trays T3 and T4 will make minimal contact with the top sheets. Preferably the rear wall of the trays angles backwards to avoid bearing on the sheets as the pan rotates upwards.

Feeder mechanism 118 is activated by motor M7 through belt and pulley assembly 1110, and shaft 1114.

Feeder mechanism 118 includes a pair of crowned corrugating feed rollers 1120 and a pair of low force feed rollers 1124. Rollers 1120 are fixed to shaft 1114 and rollers 1124 are mounted parallel to shaft 1114 and inboard of rollers 1120 in a position where they rest upon the top sheet of the stack of sheets in tray T4. The inboard positioning (narrower spacing) of rollers 1124 with respect of rollers 1120 allows the top sheet to corrugate more easily as will be described more fully below. Rollers 1124 are mounted on arm 1125 which pivots about shaft 1114 to allow rollers 1124 to follow the level of sheets in tray T4. Rollers 1124 are driven from shaft 1114 by belt and pulley assembly 1126.

Rollers 1124 urge the top sheet in tray T4 forward until they are engaged by corrugating rollers 1120 which cooperate with quarter-round retarding elements 1130 to singulate the top sheet from any next sheet which may be carried along with the top sheet, as will be described more fully below.

To facilitate insertion of tray T4 lever arm 1134 is deflected as tray T4 is inserted and rotates concentric torque tube 1136, which, in turn, rotates crank 1137 to raise arm 1125 and rollers 1124 upwards to clear tray T4. When tray T4 is fully inserted lever 1134 drops into relief 1138 allowing rollers 1124 to rotate downward onto the top sheet. A torque from spring 1139 may also be applied to rollers 1124 through torque tube 1136 to adjust the force with which rollers 1124 bears on the top sheet to limit the frictional forces developed between the top and next sheets while generating sufficient friction force to take up the top sheet.

As will be described more fully below retarding elements 1130 are mounted on fixed, parallel shafts 1140 (best seen in FIG. 26) through a four bar linkage 1142 which is spring biased upwards against stops 1141 (shown in FIG. 27) to maintain a clearance approximately equal to the thickness of the thinnest sheets to be fed between retarding elements 1130 and corrugating rollers 1120. Four bar linkage 1142 allows retarding surfaces 1130 to deflect downward while retaining the correct orientation when thick sheets are fed from tray T3. Thus, feeder 118 can be used to feed thicker sheets, which might otherwise resist corrugation and jam.

Figure 27:
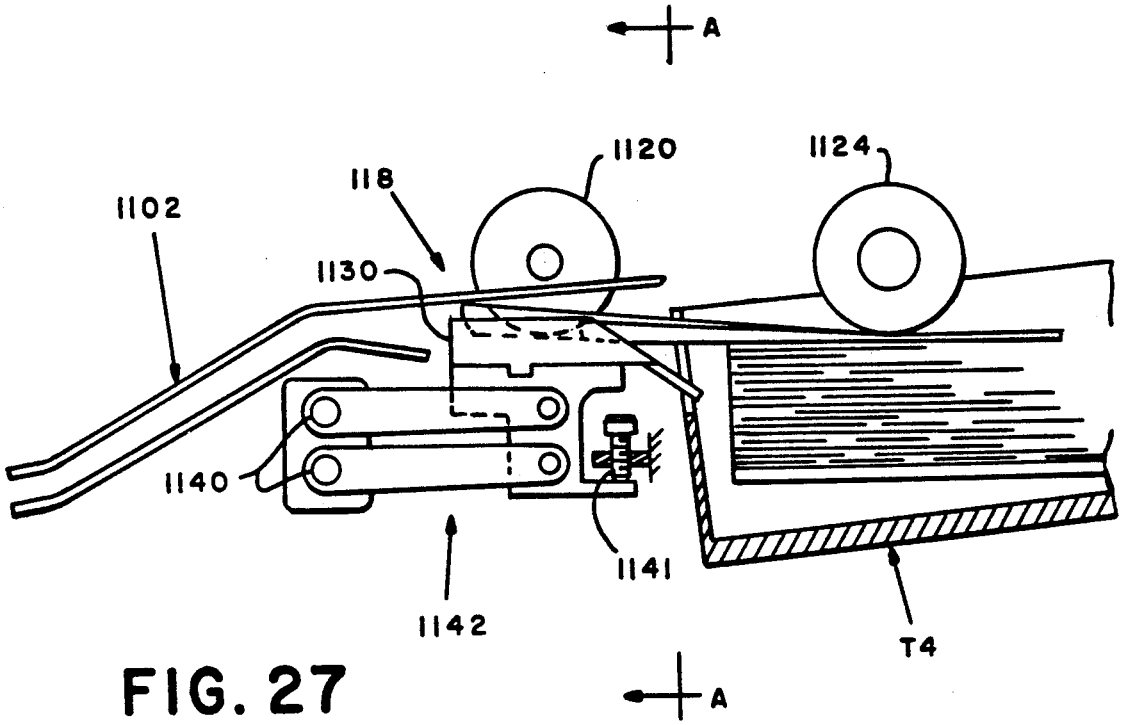
FIG. 27 is a side view, partially broken away, of the rollers of FIG. 26.
Figure 28:
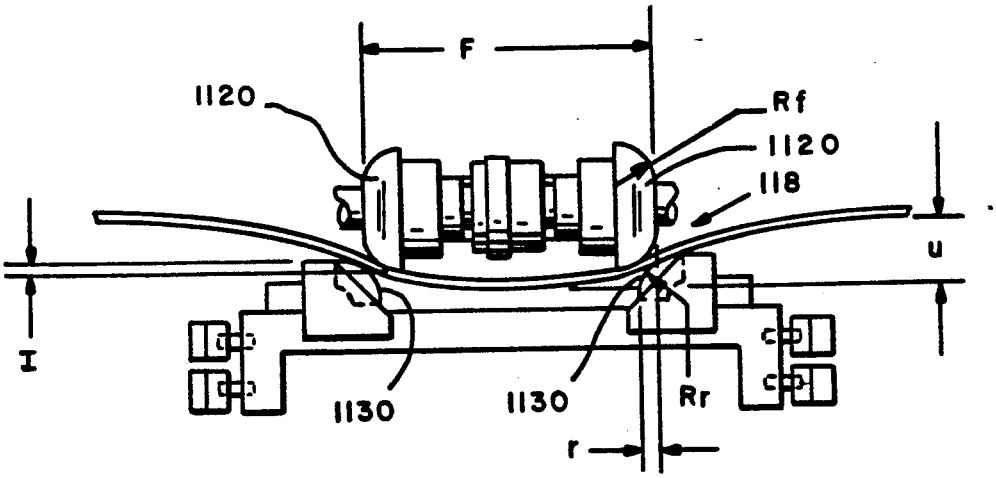
FIG. 28 is a view along lines A—A of FIG. 27.

FIGS. 27 and 28 shown the operation of corrugating feed rollers 1120 and retarding elements 1130 in singulating a top sheet from the next sheet. As the top sheet is urged into contact with rollers 1120 it is depressed downwards and outwards and led forwards between quarter-round retarding elements 1130 causing an upwards corrugation U of the top sheet away from the next sheet, as shown in FIG. 28. This corrugation U reduces the drag forces due to fiction and/or static electricity between the top sheet and the next sheet greatly facilitating singulation of the top sheet and stiffens the sheet in the feed direction, to improve feeding. Rollers 1120 are preferably formed of a high coefficient of friction material such as polyurethane so that rollers 1120 can drag the top sheet across fixed retarding elements 1130. Elements 1130 are also preferably formed of materials such as polyurethane which develops a sliding friction force sufficient to retard the next sheet against the reduced drag forces with the top sheet but which will not overcome the static friction of rollers 1120 and cause rollers 1120 to slip on a top sheet.

As noted above, and as best seen in FIG. 27 four bar linkage 1 142 allows retarding elements 1130 to deflect downward when a thick sheet, such as BRE is fed. By deflecting retarding elements 1130 downward the possibility of jams is reduced when sheets which are stiff enough to possibility resist corrugation are fed. The force with which retarding elements bear upwards against rollers 1120 or ny interposed sheets is determined by a torque applied by spring 1144 through shaft 1140.

As can best be seen in FIG. 27, the singulated top sheet is fed into guides 1102 which acts to smooth the corrugation from the leading edge of the sheet, allowing it to bend easily as it is fed, and which guide the singulated sheet to guides 120 for further processing. This smoothing, or decorrugating, action also improves the singulation between the top and next sheets as the smoothing action progates backwards, tending to flatten the sheet between retarding surfaces 1130, thus increasing the force with which elements 1130 bear against the bottom of the sheet. Note that the extended structure of elements 1130 combined with the corrugating of the sheets allows the retarding force to be applied over an extended area. This is as opposed to conventional retard feeders, where the retard is a plane or a cylinder, and where the retarding action must take place on the tangent line between that retard plane or cylinder and the feed roller.

EXAMPLE

A prototype system, substantially as shown in FIG. 3 has been developed and tested and is believed to have satisfactorily achieved the objects of the subject invention. The following parameters have been found acceptable in the prototype system.

A sheet and form are input from laser printers at a velocity of approximately 2 inches per second along guide 100.

The final accumulation of form 10 with printed and pre-printed sheets is transported through flap folder sealer 180 at a velocity of approximately 3 inches per second.

Accumulator folder assemblies 106 and 140 and all other urge rollers and roller pairs transport sheets and/or form 10 at approximately 8 inches per second.

An input velocity of two inches per second matches the output of laser printer 5, while the increase in velocity to eights inches per second allows time for, accumulating sheets with form 10, and to laterally align the final accumulation, and to fold it to one-third size (i.e. letter size). It is believed that the system speed can be increased to match higher speed printers with little effort.

Steps 864 and 865 in side flap opener mechanism 148 have a height of approximately 0.25 inches.

Form 10 and mechanism 148 are designed to provide a minimum nominal spacing S (shown in FIG. 17) between side flaps 16 and the beginning of knife edges 862 (i.e. the outboard edges of tips 856) of 0.25 inches.

The urge rollers apply a normal force in the range of two to five ounces. Lower levels of force are chosen where the sheet is urged over a longer distance, as the columnar stiffness of the sheet decreases with the length over which the load is applied.

The bearing surfaces of the urge rollers are micro-cellular urenthane and have a coefficient of friction of from 1.0 to 1.4.

In the following example for a feeder mechanism, which it is believed will perform satisfactory with a range of commercially available sheet stock, BRE's and with envelope forms, reference is made to the following dimensions and parameters as shown in FIG. 28.

"F"—is the separation between corrugating feed rollers 1120. F will be chosen large with stiffer material and with increased distance which the sheet is fed by rollers 1120. For thin sheets fed a short distance F may be reduced to a value small enough that it becomes desirable to include both of the roller bearing surfaces in a single element, and as used herein, the term "pair of feed rollers" includes such a single element as a limiting case. F will be chosen larger with stiffer material and with increased distance which the sheet is fed by rollers 1120. "r"—is the horizontal separation between rollers 1120 and retarding elements 1130. The smaller r is selected the tighter the sheet must bend. "I"—is the vertical interference between rollers 1120 and retarding elements 1130. The greater I is chosen the tighter the sheet must bend. "$R_f$", "$R_r$"—are radii of rollers 1120 and retard elements 1130, respectively, as shown in FIG. 9. The smaller $R_f$ and $R_r$ are chosen the tighter the sheet must bend.

"$f_f$", "$f_r$"—are the coefficients of friction of rollers 1120 and retarding elements 1130 respectively.

In general selection of particular values is guided by the relationship of the degree of corrugation (i.e. tightness with which the sheet is bent) to the separation efficiency, which increases, and the force need to feed a sheet, which also increases.

The following specific values are believed to provide satisfactory performance:

$F=1.75$ inches
$r=0.125$ inches (horizontal overlap)
$I=0.125$ inches
$R_f=0.250$ inches
$R_r=0.200$ inches
$f_f=2.0$
$f_r=1.0$ Buckle chutes, and the portions of guides supporting sheets in the nips of assemblies 106 and 140, have radii of curvature (not necessarily constant) of from 2 to 5 inches.

Those skilled in the art will readily appreciate that the system shown in FIG. 1 provides an almost limitless ability to produce mail pieces having a selected configuration. In the prototype system the allowable combinations are limited by the following rules:

1. Each feeder tray: T1, T2, T3, T4 will have homogenous stock.
2. Each mail piece will include exactly one envelope.
3. Each mail piece will include at least one non-envelope.
4. Each mail piece having a window envelope, will include at least one printed sheet.
5. For each mail piece a feeder will supply no more than two one-thirds sized sheets.
6. Each mail piece will include no more than one BRE.
7. Because of the practical limitations on folding ability each mail piece will include no more than a total of three two-thirds size or three three-thirds size sheets.

8. Because of the practical limitations on envelope thickness each mail piece will be no more than twelve sheets thick, where BRE's are considered to be two sheets thick.

The following Hypothetical Example illustrates the relation between a data structure and the corresponding mail piece configuration.

HYPOTHETICAL EXAMPLE

This example illustrates the operation of the system of the subject invention in producing a mail piece which has a printed (non-window) envelope, fed from tray T1, one printed three-thirds page, fed from tray T2, one pre-printed two-third insert fed from tray T3 and one one-thirds pre-printed insert fed from tray T4. These sheets and envelope form may be formed into mail piece in accordance with the example data structure set forth below.

Overall the entire process involves:

1) printing the envelope in printer 5 and positioning it at the nip of accumulator folder assembly 140; aligning it by activating registration gate G5, and jogging motor M2 to engage envelope form 10.

2) printing the three-thirds page from tray T2 in printer 5; making a three-thirds to two-thirds "C" fold in the three-thirds sheets by accumulator folder assembly 106; and accumulating the three-thirds sheets with envelope form 10 at the nip of a assembly 140; and aligning it by again operating gate G5.

3) the one-thirds pre-printed sheet (which may be a BRE) is fed from tray T4; followed by feeding the two-thirds pre-printed sheets from tray T3, for accumulation with envelope form 10 and the printed three-thirds sheets.

4) once all sheets are in the nip of assembly 140 motor M2 is turned on and the accumulation is folded approximately in half, from two-thirds to one-third.

5) trailing flap folder sealer assembly 180 is activated to fold and seal trailing flap 112 and side flaps 114 and the completed mail piece exits.

The above described operation is set forth in terms of the operation of the sensors, motors, and gates of the subject invention below. As each operation is described the corresponding data elements are identified parenthetically.

Steps:

0) Since the first element of the mail piece is a printed envelope form 10 to be fed from tray T1 the mainline program activates sensor S1.

1) (S1, Op. St. 1) Envelope form 10 is fed from tray T1 and printed by printer 5. When sensor S1 detects for 10 it activates sensor S3. When sensor S1 determines that one page has passed it returns to the Idle State.

2) (S3, Op. St. 1) When form 10 is detected by sensor S3 it activates motor M3 and sensor S4, and calls the CHK. EX. PGS. routine to determine if the number of pages specified exceeds the maximum allowed by the system, as described above. If the number of pages exceeds the maximum form 10 when the printed pages are diverted to the top of the printer by gate G1 to allow the operator to intervene and salvage the otherwise unprocessable mail piece. Assuming that the specified mail piece is correct the operation continues and after one page (i.e. form 10) has passed the next Op. St. is specified as 2 and the routine exits to the Idle State.

3) (S3, Op. St. 1) When sensor S4 senses form 10 it activates motor M3 to assure that the motor M3 is on. After it detects one page passed sensor S4 activates motor M1 and sensor S2 to prepare for the printed three-thirds page). After one page (i.e. form 10) has passed the next Op. St. is set equal to two and the routine exits.

4) (M1, Op. St. 1, Op. St. 2) Motor M1 first executes a Motor Pause State and than EXECUTES NEXT to Op. St. 2 to Start. When motor M1 is Starting it activates sensor S6, gate G3 and gate G2. When it is done running it exits to the Idle State.

5) (S6, Op. St. 1) Sensor S6 activates sensor S7 and motor M4 when its senses form 10 and sets gate G2 to the Deactivating State after form 10 has passed. (Accumulator form 106 is now conditioned to fold the following three-thirds printed page.) After one page has passed the next Op. St. is set equal to 2 and the routine exits to the Idle State.

6) (S7, Op. St. 1) After one page has passed (form 10) sensor S7 sets motor M1 to the Stopping State and activates gate G5 (the registration gate). After one page is passed the next Op. St. is set equal to 2 and the routine exits to the Idle State.

7) (G5, Op. St. 1) After gate G5 completes being active it activates motor M2. It also sets the next Op. St. equal to 2 and exits to Idle State.

(Form 10 is now in the nip of accumulator folder assembly 140, and while this was occurring printer 5 has printed the printed the three-third page under control of data processing system 1.)

8) (S2 Op. St. 1) When sensor S2 senses the three-thirds sheet it activates sensor S3. After one page (the three-thirds sheet has passed the next Op. St. is set equal to 1 and the routine exits to the Idle State.

9) (S3, Op. St. 2) Sensor S3 activates sensor S4 and starts motor M3 when it senses the printed sheet. When the printed sheet has passed it also again calls the CHK EX PGS routine as described above. After one page (the printed sheet) has passed the next Op. St. is set equal to 1 and the routine exits to the Idle State.

10) (S4 Op. St. 2) When sensor S4 senses the printed sheet it activates motor M3 to assure that it is running and when the sheet has passed it activates motor M1. After one page has passed the next Op. St. is set equal to 1 and the routine exits to Idle State.

11) (M1, Op. St. 1, Op. St. 2) After executing Motor Pause the motor will EXECUTE NEXT to the Starting State of Op. St. 2. When the motor starts it will activate sensor S6 and gate G2 and G3.

(Gate G3 is activated to allow the three-third to two-thirds "C" fold in the printed sheet.)

(Gate G2 is activated to allow the printed sheet to be diverted into buckled chute 112 for folding.)

12) (S6, Op. St. 2) Sensor S6 starts motor M4 and activates sensor S7 when it senses the printed sheet. When on page has passed sensor S6 will deactivate gate G2. After one page has passed sensor S6 will set the next Op. St. equal to 1 and exit to the Idle. State.

13) (S7, Op. St. 2) sensor S7 stops motor M1, activates gate G5, starts motor M7 (to feed from tray T4) and executes PCE PRE ACK when the printed sheet has passed. It also than sets the next Op. St. equal to 1 and exits to the Idle State At this point form 10 and the three-thirds sheet, folded to two-thirds, are at the nip of the accumulator folder assembly 140 and have been aligned by gate G5, the registration gate. Also at this point, the next mail piece is started while the current mail piece continues. Those skilled in the he art will readily recognized that the state routines may be executed by controller 6-1 concurrently thus allowing simultaneously processing of two mail pieces. It should also be noted, that, as discussed above, the number of printed pages may vary from mail piece to mail piece within a given mail run. If the following mail piece has a different number of printed pages the page count for Pages Passed for S3, Op. St. 2 and S4, Op. St. 2 will changed in accordance with the piece information transmitted from data processing system 1 for the following mail piece.

14) (G5, Op. St. 2) Gate G5 starts motor M2 to job the printed sheet into the nip of the assembly 140 when the gate reaches Deactivating State. It also sets the next Op. St. equal to 3 and exits to Idle State.

15) (M7, Op. St. 1) Motor M7 feeds the one-third insert or BRE from tray T4. It activates sensors S13 and motor M4 when it is the Starting State. When done running the next Op. St. is set equal to 1 and the routine exits to the Idle State.

16) (S13, Op. St. 1) Sensor S13 sets motor M7 to Stopping State activates Gate G4 to divert the one third insert to the nip of assembly 140, and activates sensor S8, all when the one-third insert is sensed. After one page is passed (the one-third insert) the Op St. is set equal to 2 and the routine exits to the Idle State.

17) (S8, Op. ST. 1) Sensor S8 will activate sensor S9 when it senses the one-third insert and activate motor M6 when it detects one page passed. Also the next Op. St. is set equal to 2 and the routine exits to the Idle State.

18) (M6, Op. St. 1) motor M6 activates motor M4 and sensor S13 when it is started. After motor M6 is done running it sets the next Op. St. equal 1 and exits to the Idle State.

19) (S13, Op. St. 2) Sensor S13 will set motor M6 to the Stopping State when it senses the two-thirds insert and activates gate G4 (to divert the two-thirds insert to apparatus 140), and enables sensor S8 at that time. When it detects one page passed it will set the Op. State equal 1 and exit to Idle State.

20) (S8, Op. St. 2) Sensor S8 will activate sensor S9 when it senses the two-thirds insert and activate gate G5 to register the inserts when it detects one page pass (the two-thirds insert). When one page has passed the next Op. St. is set equal to 1 and the routine exits to the Idle State. When gate G5 enters the Deactivating State it will activate motor M2 to fold the accumulated sheets and form 10. When it is done gate G5 sets the next Op. St. equal to 1 and exits to the Idle State.

21) (M2, Op. St. 3) Motor M2 will activate sensor S10 and start motor M5 to activate trailing flap folder sealer 180 when it is starting. When it is done running motor M2 sets the next Op. St. equal to 1 and exits to Idle State.

22) (S10 Op. St. 1) Sensor S10 will activate sensor S11 and activate gate G6 (to moisten trailing flap 12) and set motor M4 to Stopping State when it senses the mail piece exiting from accumulator folder assembly 140. When it senses one page passed (the mail piece) it will also set motor M2 to the Stopping State, and than set Op. St. equal to 1 and exit to the Idle State.

23) (S11, Op. St. 1) Sensor S11 will activate sensor S12 and disable sensor S9 and gate G4 when it senses the mail piece. After the mail piece has passed the next Op. St. is set equal to 1 and the routine exits Idle State. (Note that the Disabled control parameter forces the control device to reset to initial conditions and return to Idle State. For a motor this is equivalent to activating the motor with the Initial State equal to Stopping.)

24) (S12, Op. St. 1) Sensor S12 causes COMPLETE to execute and set motor M5 to Stopping State when it senses that the mail piece has passed. Then it also set the Op. St. equal to 1 and exits to the Idle State. The completed mail piece has now been folded and sealed and output from the system.

For each step the corresponding data element, as identified in parentheses and in the format shown in Table 1, initiates the necessary subsequent actions to complete the specified mail piece. The corresponding data elements for the example set forth above are listed in the above mentioned, commonly assigned related application Ser. No. 492,039; but are not believed necessary for an understanding of the subject invention.

The above descriptions and examples have been provided by way of illustration only, and those skilled in the art will recognize numerous embodiments of the subject invention from the Detailed Description and attached drawings. Particularly, those skilled in the art will note that there is, in principle, no reason why sheets of other fractional lengths less than 3/3's (such as ½ or ⅔'s length) cannot be processed by the subject invention; though some otherwise possible accumulations may tend to jam when such sheets are included. Accordingly, limitations on the scope of these subject invention are to be found only in the claims set forth below.

What is claimed is:

1. Apparatus for forming a mail piece, comprising:
a) means for input of text signals;
b) means for input of a sheet;
c) means for input of an envelope form;
d) a printer responsive to said text signals for printing corresponding text on at least one of said sheet or said envelope form; and,
e) folder sealer means for, after printing of said text;
e1) forming an accumulation including said sheet and said envelope form;
e2) simultaneously folding said sheet and said envelope form so that said envelope form surrounds said sheet; and
e3) sealing said envelope form to form a mail piece.

2. Apparatus as described in claim 1 further comprising means for input of information defining a mail piece configuration and wherein said folder sealer means is responsive to said defining information to produce said mail piece in said configuration.

3. Apparatus as described in claim 2, further comprising means for translating said defining information into a data structure.

4. Apparatus as described in claim 3, wherein said apparatus performs a sequence of operations selected from a predetermined plurality of operations to form said mail piece, and wherein said apparatus further includes control means for responding to said data structure to control said folder sealer means to perform said selected operations in accordance with said defining information, whereby said mail piece is produced in said configuration.

5. Apparatus as described in claim 4 wherein said control means comprises a data processor, said operations comprise sequences of states, and said control means controls said process by executing sequences of state routines in said data processor in accordance with said data structure, execution of said state routines in accordance with said data structure effecting said states.

6. Apparatus as described in claim 5 wherein said data structure comprises a plurality of data elements, each of said data elements specifying control parameters for one of said operations.

7. A control system as described in claim 5 wherein, during execution, at least one of said state routines selects, in accordance with said data structure, another of said state routines for later execution.

8. A control system as described in claim 5 wherein said process is carried out by an apparatus comprising a plurality of devices, said devices operating under control of said data processor, as it executes said state routines, to effect said states.

9. A system as described in claim 8 wherein said data elements are each associated with a particular one of said devices.

10. Apparatus as described in claim 1, wherein the length of said sheet is selected to be either three thirds or two thirds of a predetermined length.

11. Apparatus as described in claim 10, wherein said folder sealer is further for, when said sheet is selected to be of three thirds length, folding said sheet from three thirds to two thirds length prior to performing said simultaneous folding.

12. Apparatus as described in claim 11, wherein said simultaneous folding of said sheet and said envelope form folds said sheet from two thirds to one thirds length.

13. Apparatus as described in claim 12, wherein said folder sealer means is further for selectively folding said sheet from three thirds to two thirds length in one of two ways, so that said simultaneous folding then results in either a "C" fold or a "Z" fold of said sheet.

14. Apparatus as described in claim 1, wherein said envelope form has two side flaps for enclosing the sides of said mail piece and said envelope form is input with said side flaps folded inwards, and wherein said folder sealer is further for opening said side flaps outwards before forming said accumulation and folding said side flaps inwards before sealing said envelope.

15. Apparatus as described in claim 1, wherein said corresponding text includes an address, said envelope form includes a window, and said printer responds to said text signals to print said address on said sheet so that said address is positioned to be visible through said window.

16. Apparatus as described in claim 1, wherein said corresponding text includes an address and said printer responds to said text signals to print said address on said envelope form.

17. Apparatus as described in claim 1, wherein said sheet is pre-printed.

18. Apparatus as described in claim 1, wherein said mail piece further includes a business return envelope.

19. Apparatus as described in claim 1 wherein said folder sealer means is further for laterally aligning said sheet.

20. Apparatus for forming a mail piece, comprising:

a) means for input of text signals;

b) means for input of a sheet;

c) means for input of an envelope form;

d) a printer responsive to said text signals for printing corresponding text on at least one of said sheet or said envelope form; and, e) folder sealer means for, after printing of said text, and as said sheet and said envelope form are transported through said folder sealer;

e1) forming an accumulation including said sheet and said envelope form;

e2) folding said envelope form, transversely to the direction of said transport, so that said envelope form surrounds said sheet; and.

e3) sealing said envelope form to form a mail piece.

21. Apparatus as described in claim 20 further comprising means for input of information defining a mail piece configuration and wherein said folder sealer means is responsive to said defining information to produce said mail piece in said configuration.

22. Apparatus as described in claim 21, further comprising means for translating said defining information into a data structure.

23. Apparatus as described in claim 22, wherein said apparatus performs a sequence of operations selected from a predetermined plurality of operations to form said mail piece, and wherein said apparatus further includes control means for responding to said data structure to control said folder sealer means to perform said selected operations in accordance with said defining information, whereby said mail piece is produced in said configuration.

24. Apparatus as described in claim 23 wherein said control means comprises a data processor, said operations comprise sequences of states, and said control means controls said process by executing sequences of state routines in said data processor in accordance with said data structure, execution of said state routines in accordance with said data structure effecting said states.

25. Apparatus as described in claim 24 wherein said data structure comprises a plurality of data elements, each of said data elements specifying control parameters for one of said operations.

26. Apparatus as described in claim 24 wherein, during execution, at least one of said state routines selects, in accordance with said data structure, another of said state routines for later execution.

27. Apparatus as described in claim 24 wherein said process is carried out by an apparatus comprising a plurality of devices, said devices operating under control of said data processor, as it executes said state routines, to effect said states.

28. Apparatus as described in claim 27 wherein said data elements are each associated with a particular one of said devices.

29. Apparatus as described in ,claim 20, wherein the length of said sheet is selected to be either three thirds or two thirds of a predetermined length.

30. Apparatus as described in claim 29, wherein said folder sealer is further for, when said sheet is selected to be of three thirds length, folding said sheet from three thirds to two thirds length prior to transversely folding said envelope form.

31. Apparatus as described in claim 20, wherein said envelope form has two side flaps for enclosing the sides of said mail piece and said envelope form is input with said side flaps folded inwards, and wherein said folder sealer is further for opening said side flaps outwards before forming said accumulation and folding said side flaps inwards before sealing said envelope.

32. Apparatus as described in claim 20, wherein said corresponding text includes an address, said envelope form includes a window, and said printer responds to said text signals to print said address on said sheet so that said address is positioned to be visible through said window.

33. Apparatus as described in claim 20, wherein said corresponding text includes an address and said printer responds to said text signal to print said address on said envelope form.

34. Apparatus as described in claim 20, wherein said sheet is pre-printed.

35. Apparatus as described in claim 20, wherein said mail piece further includes a business return envelope.

36. Apparatus as described in claim 20 wherein said folder sealer means is further for laterally aligning said sheet.

37. Apparatus for forming a mail piece, comprising:

a) means for input of text signals;

b) means for input of a sheet;

c) means for input of an envelope form;

d) a printer responsive to said text signals for printing corresponding text on at least one of said sheet or said envelope form; and, e) folder sealer means for, after printing of said text, forming an accumulation including said sheet and said envelope form, and folding said accumulation, and sealing said envelope form to form a mail piece; wherein, d) said printer is mounted above said folder sealer means and said folder sealer means transports said accumulation and said mail piece beneath said printer and in a direction substantially opposite to the direction in which materials are transported through said printer.

38. Apparatus for folding and sealing a sheet and an envelope form, comprising:

a) means for input of a sheet;

b) means for input of an envelope form;

c) means for forming an accumulation including said sheet and said envelope form;

d) means for simultaneously folding said sheet and said envelope form so that said envelope form surrounds said sheet; and, e) means for sealing said envelope form to form a mailpiece.

39. Apparatus as described in claim 38, wherein the length of said sheet is selected to be either three thirds or two thirds of a predetermined length.

40. Apparatus as described in claim 39, wherein said folder sealer is further for, when said sheet is selected to be of three thirds length, folding said sheet form three thirds to two thirds length prior to performing said simultaneous folding.

41. Apparatus as described in claim 40, wherein said simultaneous folding of said sheet and said envelope form folds said sheet form two thirds to one thirds length.

42. Apparatus as described in claim 41, wherein said folder sealer means is further for selectively folding said sheet from three thirds to two thirds length in one of two ways, so that said simultaneous folding then results in either a "C" fold or a "Z" fold of said sheet.

43. Apparatus as described in claim 38, wherein said envelope form has two side flaps for enclosing the sides of said mail piece and said envelope form is input with said side flaps folded inwards, and wherein said folder sealer is further for opening said side flaps outwards before forming said accumulation and folding said side flaps inwards before sealing said envelope.

44. Apparatus for folding and sealing a sheet and an envelope form, as said sheet and said envelope are transported through said apparatus, comprising:

a) means for input of a sheet;

b) means for input of an envelope form;

c) means for forming an accumulation including said sheet and said envelope form;

d) means for folding said envelope form transversely to the direction of said transport; and, e) means for sealing said envelop form to form a mailpiece.

45. Apparatus as described in claim 44, wherein the length of said sheet is selected to be either three thirds or two thirds of a predetermined length.

46. Apparatus as described in claim 44, wherein said folder sealer is further for, when said sheet is selected to be of three thirds length, folding said sheet form three thirds to two thirds length prior to performing said simultaneous folding.

47. Apparatus as described in claim 46, wherein said simultaneous folding of said sheet and said envelope form folds said sheet form two thirds to one thirds length.

48. Apparatus as described in claim 47, wherein said folder sealer means is further for selectively folding said sheet from three thirds to two thirds length in one of two ways, so that said simultaneous folding then results in either a "C" fold or a "Z" fold of said sheet.

49. Apparatus as described in claim 44, wherein said envelope form has two side flaps for enclosing the sides of said mail piece and said envelope form is input with said side flaps folded inwards, and wherein said folder sealer is further for opening said side flaps outwards before forming said accumulation and folding said side flaps inwards before sealing said envelope.

* * * * *